US012520902B2

(12) United States Patent
Girard et al.

(10) Patent No.: US 12,520,902 B2
(45) Date of Patent: Jan. 13, 2026

(54) ARTICLE OF FOOTWEAR HAVING A SOLE PLATE

(71) Applicant: PUMA SE, Herzogenaurach (DE)

(72) Inventors: Romain Girard, Lauf an der Pegnitz (DE); Andreas Siegismund, Rueckersdorf (DE); Mauro Bonin, Nuremberg (DE)

(73) Assignee: PUMA SE, Herzogenaurach (DE)

( * ) Notice: Subject to any disclaimer, the term of this patent is extended or adjusted under 35 U.S.C. 154(b) by 0 days.

(21) Appl. No.: 17/383,954

(22) Filed: Jul. 23, 2021

(65) Prior Publication Data

US 2022/0022595 A1 Jan. 27, 2022

Related U.S. Application Data

(60) Provisional application No. 63/195,320, filed on Jun. 1, 2021, provisional application No. 63/055,506, filed on Jul. 23, 2020.

(51) Int. Cl.
*A43B 13/12* (2006.01)
*A43B 13/02* (2022.01)
(Continued)

(52) U.S. Cl.
CPC ..... *A43B 13/122* (2013.01); *A43B 13/127* (2013.01); *A43B 13/145* (2013.01);
(Continued)

(58) Field of Classification Search
CPC ... A43B 13/122; A43B 13/127; A43B 13/145; A43B 13/37; A43B 13/026; A43B 13/04;
(Continued)

(56) References Cited

U.S. PATENT DOCUMENTS 2,245,706 A 6/1941 Nutt
4,837,949 A 6/1989 Dufour
(Continued)

FOREIGN PATENT DOCUMENTS

CN 101611953 B 4/2011
CN 202145942 U 2/2012
(Continued)

OTHER PUBLICATIONS

European Search Report from corresponding European Patent Application No. 21 187 302.1 dated Dec. 8, 2021 (9 pages).
(Continued)

*Primary Examiner* — Bao-Thieu L Nguyen
(74) *Attorney, Agent, or Firm* — Quarles & Brady LLP

(57) ABSTRACT

A sole structure for an article of footwear that includes an upper. The sole structure can include an outsole having a ground-engaging surface. The midsole member can be disposed between the outsole and the upper, and can include a pocket extending from a heel region to a forefoot region. A sole plate can be disposed within the pocket. The sole plate can have a uniform thickness and can extend from the heel region into the forefoot region. A cutout portion can be formed in each of the midsole member and the outsole in an arched section of the sole structure. A cushion layer can be disposed over the sole plate and within the pocket.

29 Claims, 28 Drawing Sheets

(51) Int. Cl.
*A43B 13/04* (2006.01)
*A43B 13/14* (2006.01)
*A43B 13/37* (2006.01)

(52) U.S. Cl.
CPC ..... *A43B 13/37* (2013.01); *A43B 13/026* (2013.01); *A43B 13/04* (2013.01)

(58) Field of Classification Search
CPC ... A43B 13/183; A43B 13/185; A43B 13/186; A43B 13/12; A43B 13/181; A43B 13/187; A43B 23/0245
See application file for complete search history.

(56) References Cited

U.S. PATENT DOCUMENTS 5,179,791 A 1/1993 Lain
5,611,152 A 3/1997 Richard et al.
6,151,806 A * 11/2000 Morris ..... A43B 5/00 36/107
6,625,905 B2 9/2003 Kita
7,114,269 B2 * 10/2006 Meschan ..... A43B 5/00 36/35 R
7,437,835 B2 10/2008 Marvin et al.
7,536,808 B2 5/2009 Myers et al.
7,946,059 B2 5/2011 Borel
7,984,569 B2 7/2011 Chaney et al.
8,186,079 B2 5/2012 Carboy et al.
8,296,973 B2 10/2012 Roberti
8,307,569 B2 11/2012 McInnis et al.
8,387,285 B2 3/2013 Hartveld
8,479,417 B2 7/2013 Flannery et al.
8,568,548 B2 10/2013 Park et al.
8,635,785 B2 1/2014 Seo
8,732,984 B2 5/2014 Ha
8,752,307 B2 6/2014 Cooper et al.
8,969,453 B2 3/2015 Park et al.
9,015,962 B2 4/2015 Boudreau et al.
9,210,967 B2 12/2015 Gerber
9,591,891 B1 * 3/2017 Baucom ..... A43B 13/223
9,605,191 B2 3/2017 Park et al.
9,936,765 B2 * 4/2018 Sato ..... A43B 13/186
9,961,959 B2 5/2018 Gerber
10,081,716 B2 9/2018 Chang et al.
10,130,140 B2 11/2018 Dyer et al.
10,172,416 B2 1/2019 Hatfield et al.
10,253,149 B2 4/2019 Watkins et al.
10,314,369 B2 6/2019 Auger et al.
10,441,027 B2 * 10/2019 Bartel ..... A43B 7/148
10,477,919 B2 11/2019 Taylor et al.
10,485,294 B2 11/2019 Schneider
10,512,300 B2 12/2019 Rushbrook
10,555,580 B2 2/2020 Peyton
10,588,378 B2 3/2020 Groeneweg et al.
10,609,984 B2 4/2020 Adeagbo et al.
2002/0017036 A1 2/2002 Berger et al.
2005/0267775 A1 * 12/2005 Willis ..... A43B 3/24 705/1.1
2006/0277796 A1 * 12/2006 Gallegos ..... A43B 17/02 36/44
2008/0244932 A1 * 10/2008 Nau ..... A43B 3/0036 36/102
2009/0019730 A1 * 1/2009 Salminen ..... A43B 7/1425 36/102
2009/0119951 A1 5/2009 Hartveld
2010/0307032 A1 * 12/2010 Geer ..... A43D 3/02 36/47
2012/0079740 A1 * 4/2012 Zhou ..... A43B 13/141 36/43
2013/0205619 A1 8/2013 Hartveld
2016/0081427 A1 * 3/2016 Iuchi ..... A43B 13/141 36/28
2016/0353836 A1 12/2016 Luedecke et al.
2016/0353838 A1 12/2016 Takeshita et al.
2017/0095033 A1 * 4/2017 Farina ..... A43B 13/026
2017/0196307 A1 7/2017 Keating et al.
2018/0132564 A1 * 5/2018 Bruce ..... A43B 13/189
2018/0153254 A1 6/2018 Fusco et al.
2018/0163009 A1 6/2018 Baghdadi
2018/0213886 A1 8/2018 Connell et al.
2018/0263335 A1 * 9/2018 Iuchi ..... A43B 13/122
2019/0150554 A1 * 5/2019 Strickland ..... A43B 7/143
2019/0150562 A1 * 5/2019 Bartel ..... A43B 13/22
2019/0174873 A1 6/2019 Baucom et al.
2019/0200700 A1 7/2019 Hale
2019/0223549 A1 7/2019 Howley et al.
2019/0320759 A1 10/2019 Conrad et al.
2019/0351592 A1 11/2019 Falken
2019/0373982 A1 12/2019 Dupre et al.
2019/0387837 A1 12/2019 Luh
2020/0046068 A1 2/2020 Choi et al.
2020/0121021 A1 4/2020 Bartel et al.
2020/0154819 A1 5/2020 Matthews et al.
2020/0323307 A1 10/2020 Kim
2020/0383421 A1 * 12/2020 Bidal ..... A43C 15/162
2020/0383422 A1 * 12/2020 Bidal ..... A43B 13/41
2021/0137213 A1 * 5/2021 Stockbridge ..... A43B 7/1445
2022/0053879 A1 2/2022 Redon et al.
2022/0053886 A1 * 2/2022 Bramani ..... A43B 9/12
2022/0225729 A1 7/2022 Bonin et al.

FOREIGN PATENT DOCUMENTS

CN 109222324 A 1/2019
CN 209391167 U 9/2019
CN 212165086 U 12/2020
CN 212787628 U 3/2021
CN 113966893 A 1/2022
DE 112006002347 T5 7/2008
DE 102016118168 A1 11/2017
DE 112006002347 B4 7/2019
EP 3574787 A1 12/2019
GB 2288550 B 2/1998
GB 2425455 A 11/2006
GB 2431334 A 4/2007
GB 2431333 B 10/2010
GB 2437698 B 10/2010
GB 2499416 A 8/2013
JP 2509505 B2 6/1996
JP 2007089734 A 4/2007
JP 6307728 B1 4/2018
JP 2021030079 A 3/2021
WO 2007026175 A1 3/2007
WO 2016132927 A1 8/2016
WO 2018137649 A1 8/2018
WO 2019204358 A1 10/2019

OTHER PUBLICATIONS

Puma Fast-R Nitro Elite, Retrieved Jan. 15, 2025 via website https://us.puma.com/us/en/pd/fast-r-nitro%E2%84%A2-elite-2-mens-running-shoes/310683?search=true&swatch=05.
Brooks Aurora BL, Retrieved Jan. 15, 2025 via website https://www.brooksrunning.com/en_dk/aurora-bl-mens-road-running-shoe/110367.html.
David Henry, "Brooks Neuro Review", published Jun. 6, 2016 ("Henry"), Retrieved Jan. 15, 2025 via website https://runblogger.com/2016/06/brooks-neuro-review.html.
Brooks Neuro, Retrieved Jan. 15, 2025 via website https://www.rei.com/product/123930/brooks-neuro-road-running-shoes-mens.
Puma evoSpeed Naio Nitro, Retrieved Jan. 15, 2025 via website https://about.puma.com/en/newsroom/news/puma-takes-its-forever-faster-spirit-world-athletics-championships-strong-athletes.
Puma evoSpeed Naio Nitro Elite, Retrieved Jan. 15, 2025 via website https://us.puma.com/us/en/pd/evospeed-long-distance-nitro-elite+-track-spikes/378222?srsltid=AfmBOooLiVhSLhpQbpee4y1-K8qgMsKxj1QFywd-zLfwoX0edlaiGeTI.
PUMA evoSpeed Naio Jump Nitro, Retrieved Jan. 15, 2025 via website https://www.deporvillage.net/puma-evospeed-long-jump-nitro-2-shoes-orange?country=US&srsltid=

(56) References Cited

OTHER PUBLICATIONS

AfmBOoovnt9hqdvZiRJ7dYzXGh9B58GviBqmwMSMEZ7Hy9KkmLL-viLBrq0&gQT=2.
Puma Fast-FWD Nitro Elite, Retrieved Jan. 15, 2025 via website https://www.roadtrailrun.com/2023/04/puma-fast-fwd-nitro-elite-multi-tester.html.
Brooks Hyperion Elite MD, Retrieved Jan. 16, 2025 via website https://www.brooksrunning.com/en_us/featured/unisex-running-shoes/hyperion-elite-md/100048.html.
Brooks Hyperion Elite LD, Retrieved Jan. 16, 2025 via website https://www.brooksrunning.com/en_us/featured/unisex-running-shoes/hyperion-elite-ld/100047.html.
Bryan Byrne, "Adidas Predator 20.1 Mutator 'Low Cut' Review", published Sep. 26, 2020 ("Byrne"), Retrieved Jan. 16, 2025 via website https://www.soccercleats101.com/2020/09/26/adidas-predator-20-1-mutator-low-cut-review/.
Adidas Predator 20.1 Mutator, ("Adidas Predator"), Retrieved Jan. 16, 2025 via website https://www.ebay.com/itm/405388871735?chn=ps&mkevt=1&mkcid=28&google_free_listing_action=view_item&gQT=2.
Sam Grawe, "Nike: Better Is Temporary," published 2020 by Phaidon Press Limited ("Grawe"), Retrieved Jan. 16, 2025 via website https://www.phaidon.com/store/design/nike-better-is-temporary-9781838660512/.
Hunter York, "Hypervenom Phantom 3 Review", published Apr. 20, 2017 ("York"), Retrieved Jan. 16, 2025 via website https://www.soccerpro.com/theinstep/hypervenom-phantom-3-review/.
Christian Habermeier and Sebastian Jager, "The Adidas Archive," published 2020 by Taschen GmbH ("Adidas Archive"), Retrieved Jan. 16, 2025 via website https://www.taschen.com/en/books/fashion/40739/the-adidas-archive-the-footwear-collection-40th-ed.
Solereview Editors, "Nike Vaporfly 4% Flyknit Review", published Jun. 13, 2019 ("Vaporfly Review"), Retrieved Jan. 16, 2025 via website https://www.solereview.com/nike-vaporfly-4-flyknit-review/#expand.
Nike Vaporfly 4%, Retrieved Jan. 16, 2025 via website https://shop.redcoyoterunning.com/product/4497/nike/vaporfly-4-flyknit?gQT=2.
Hoka One One Carbon X ("Hoka Carbon X"), Retrieved Jan. 16, 2025 via website https://www.hoka.com/en/us/carbon-x/192410627981.html.
Dan Roe, "The Carbon X Is a Stiff, Quick Hoka", published May 16, 2019 ("Roe"), Retrieved Jan. 16, 2025 via website https://www.runnersworld.com/gear/a27495253/hoka-one-one-carbon-x/.
Brooks Hyperion Elite 2, Retrieved Jan. 16, 2025 via website https://www.brooksrunning.com/en_us/featured/unisex-running-shoes/hyperion-elite-2/1000371D111.050.html.
Brooks Hyperion Elite 4, Retrieved Jan. 16, 2025 via website https://www.brooksrunning.com/en_us/featured/unisex-running-shoes/hyperion-elite-4/100046.html.
Hoka Bondi X, Retrieved Jan. 16, 2025 via website https://US.shop.runningroom.com/en_us/hoka-men-s-bondi-x-d-width-running-shoe.html?srsltid=AfmBOor6unVUTyOnfmj7iHwt5LbnzX2v_2R1_WeGNszeCMB5B_rWDHV5Ap4&gQT=2.
Nike Zoomx Vaporfly Next% 2 ("Nike Zoomx"), Retrieved Jan. 16, 2025 via website https://www.nike.com/t/zoomx-vaporfly-next-2-by-you-mens-road-racing-shoes-LJwJjl.
Paul Ronto, "Nike ZoomX Vaporfly Next% 2", published Mar. 13, 2021 ("Ronto"). Retrieved Jan. 16, 2025 via website https://runrepeat.com/nike-zoom-x-vaporfly-next-2.
Nike Air Zoom Alphafly Next% ("Nike Alphafly"), Retrieved Jan. 16, 2025 via website https://www.nike.com/t/alphafly-3-womens-road-racing-shoes-LQX5b4/FD8315-700.
Michael Le, "Nike's Elite Roster of 2020 Runners Are on the Cusp of a World Record Breaking Run", published Feb. 5, 2020 ("Le"), Retrieved Jan. 16, 2025 via website https://sneakernews.com/2020/02/05/nike-elite-running-shoes-2020-release-info/).
Ruggero Loda, "New Generation of Nike Next%—Now it's 3 different Shoes plus a Track Spike", published Feb. 6, 2020 ("Loda"), Retrieved Jan. 16, 2025 via website https://www.runningshoesguru.com/2020/02/new-generation-of-nike-next-now-its-3-different-shoes-plus-a-track-spike/.
Jane Mcquire, "Nike reveal Air Zoom Alphafly Next%, which will be legal for Tokyo 2020", published Feb. 6, 2020 ("Mcquire"), Retrieved Jan. 16, 2025 via website https://runnersworldonline.com.au/nike-reveal-air-zoom-alphafly-tokyo-2020-legal-which-will-be-next-for/.
Jarrod Castillo, "Check Out This Pretty Clean Colorway of the Nike Air Max 270 SE", published Jun. 7, 2019 ("Castillo"), Retrieved Jan. 16, 2025 via website https://weartesters.com/nike-air-max-270-se/.

* cited by examiner

ARTICLE OF FOOTWEAR HAVING A SOLE PLATE

CROSS REFERENCE TO RELATED APPLICATIONS

This application claims priority to U.S. Provisional Application Ser. No. 63/055,506, filed Jul. 23, 2020, and U.S. Provisional Application Ser. No. 63/195,320, filed on Jun. 1, 2021, the contents of which are incorporated by reference herein in their entireties and are to be considered a part of this application.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear including a sole plate.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, which receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and an insole. The outsole may provide traction to a bottom surface of the sole, and the midsole may be attached to an inner surface of the outsole, and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulable by a user to permit entry or exit of a foot from the internal space or cavity. In addition, the lacing system may allow a user to adjust certain dimensions of the upper or the sole, thereby allowing the upper to accommodate a wide variety of foot types having varying sizes and shapes.

The upper of many shoes may comprise a wide variety of materials, which may be utilized to form the upper and chosen for use based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

Further, many conventional shoes or other articles of footwear, when used as a running shoe, promote an impact force at the heel region of the wearer. In particular, the impact force can be transferred from a heel of a foot, to an ankle, to a shin, to a knee, and into the hips and back of the wearer. Such impact can lead to unwanted stress on limbs when there is an instant that leg muscles are improperly tensioned and the limbs and bones are left to absorb the impact forces. The excess stress on limbs and bones can have long-term, adverse effects, such as, for example, arthrosis.

However, in many cases, articles of footwear could benefit from having uppers with an increased comfort and better fit are desired, along with soles having improved cushioning systems or structural characteristics such as a sole plate to add rigidity or spring-like properties. Additionally, articles of footwear could benefit from having a ground-engaging profile that promotes constant muscle tension to absorb and distribute impact forces are desired.

SUMMARY

An article of footwear, as described herein, may have various configurations. The article of footwear may have an upper and a sole structure connected to the upper.

In some embodiments, the present disclosure can provide a sole structure for an article of footwear having an upper. The sole structure can include an outsole having a ground-engaging surface. A midsole member can be disposed between the outsole and the upper, and can have a pocket extending from a heel region to a forefoot region. A sole plate can be disposed within the pocket. The sole plate can have a uniform thickness and can extend from the heel region into the forefoot region. A cutout portion formed in each of the midsole member and the outsole in an arched section of the sole structure.

In some embodiments, the sole structure can further include a cushion layer disposed over the sole plate and within the pocket. The cushion layer can extend along a portion of at least one of the heel region, the midfoot region, or the forefoot region. The cushion layer can be formed from PEBAX® foam.

In some embodiments, the sole plate can be formed from carbon fiber. In some embodiments, the sole plate can have a plurality of cutouts in the forefoot region.

In some embodiments the midsole member can be formed from polyether block amide. In some embodiments, the midsole member can include a first midsole member and a second midsole member. The first midsole member can be formed from polyurethane plastic and the second midsole member can be formed from ethylene-vinyl acetate polymer.

In some embodiments, the sole plate can be exposed at the cutout portion.

In some embodiments, the sole structure can have an exit angle of about 15 degrees with respect to a flat ground surface and can be disposed from a point of contact with the flat ground surface and can be configured to be located at an area underneath the approximate location of the balls of a user's foot.

In some embodiments, the sole structure can have an entry angle of about 30 degrees with respect to a flat ground surface and can be disposed from a point of contact with the flat ground surface and can be configured to be located at an area underneath the approximate location of a heel of a user's foot.

In some embodiments, the present disclosure can provide an article of footwear with a forefoot region, a midfoot region, and a heel region. The article of footwear can include an upper, an outsole having a ground-engaging surface, and a midsole member disposed between the outsole and the upper. The midsole member can have a pocket extending from the heel region to the forefoot region. A sole plate can be disposed within the pocket. The sole plate can have a uniform thickness and can extend from the heel region into the forefoot region. A cutout portion can be formed in each of the midsole member and the outsole in an arched section of the sole structure.

In some embodiments, the article of footwear can also include a cushion layer disposed over the sole plate and within the pocket. The cushion layer can extend along a portion of at least one of the heel region, the midfoot region, or the forefoot region.

In some embodiments, the sole plate can have a plurality of cutouts in the forefoot region. In some embodiments, the sole plate can be exposed at the cutout portion.

In some embodiments, the midsole member can include a first midsole member and a second midsole member.

In some embodiments, the present disclosure can provide a midsole assembly for an article of footwear having a forefoot region, a midfoot region, and a heel region. The midsole assembly can include a midsole member having a pocket extending along the midfoot region, from the forefoot region to the heel region, and a cutout portion extending through the pocket in the midfoot region. A sole plate can be disposed within the pocket. The sole plate can have a uniform thickness and can extend within and along the entirety of the pocket and can be exposed at the cutout portion. A cushion layer can be disposed within the pocket and over the sole plate in at least one of the heel region, the midfoot region, or the forefoot region.

In some embodiments, the midsole member can include a first midsole member and a second midsole member. The first midsole member can be concentrated in the areas underneath the balls and heel of a user's foot.

Other aspects of the article of footwear, including features and advantages thereof, will become apparent to one of ordinary skill in the art upon examination of the figures and detailed description herein. Therefore, all such aspects of the article of footwear are intended to be included in the detailed description and this summary.

DETAILED DESCRIPTION OF THE DRAWINGS

Figure 1:
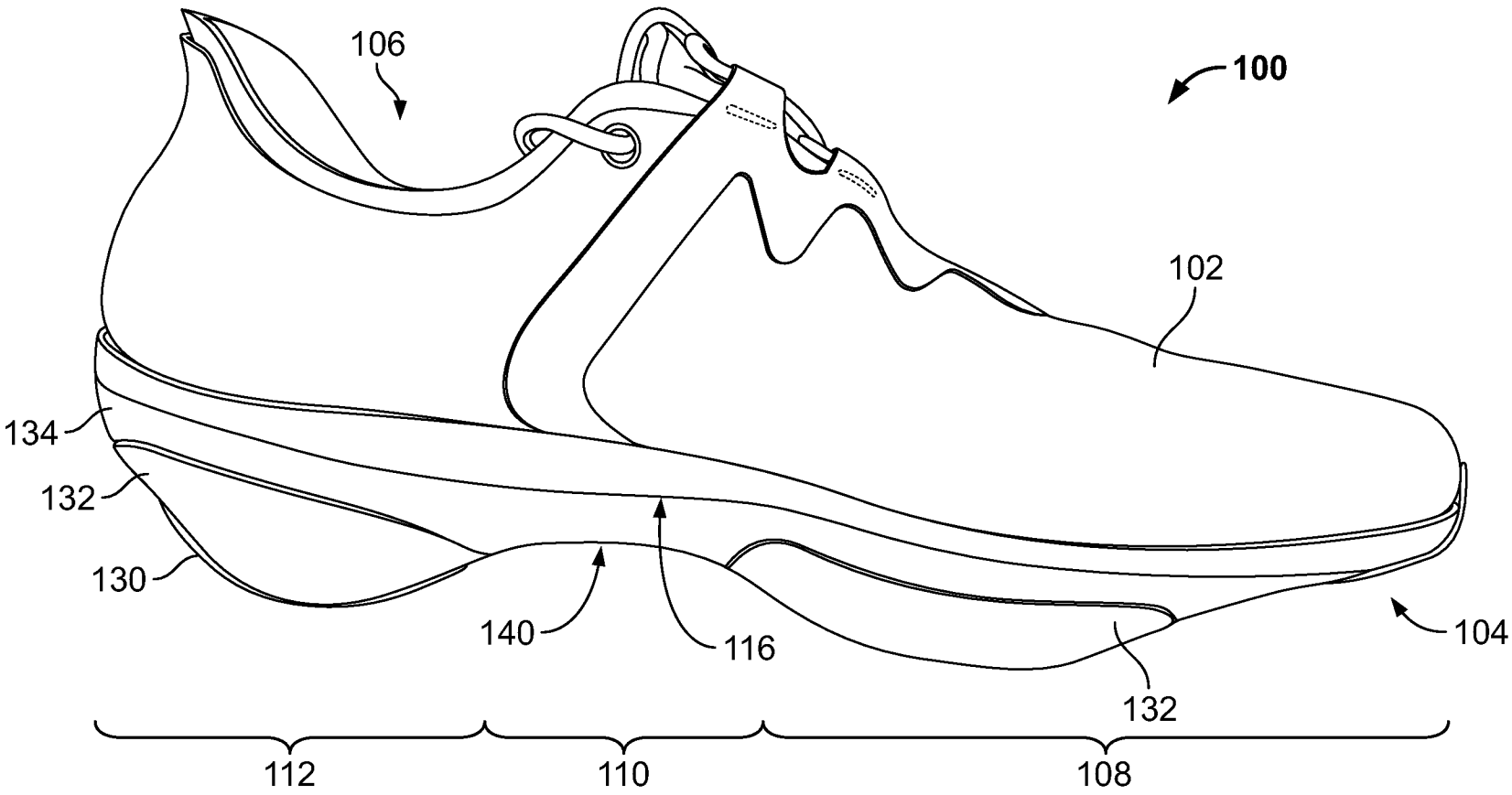
FIG. 1 is a medial side view of an article of footwear configured as a left shoe that includes an upper and a sole structure according to an embodiment of the disclosure.

The following discussion and accompanying figures disclose various embodiments or configurations of a shoe and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels.

In addition to footwear, particular concepts described herein may also be applied and incorporated in other types of apparel or other athletic equipment, including helmets, padding or protective pads, shin guards, and gloves. Even further, particular concepts described herein may be incorporated in cushions, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values±5% of the numeric value that the term precedes.

The terms "weight percent," "wt-%," "percent by weight," "% by weight," and variations thereof, as used herein, refer to the concentration of a substance or component as the weight of that substance or component divided by the total weight, for example, of the composition or of a particular component of the composition, and multiplied by 100. It is understood that, as used herein, "percent," "%," and the like may be synonymous with "weight percent" and "wt-%."

The present disclosure is directed to an article of footwear and/or specific components of the article of footwear, such as an upper and/or a sole or sole structure. The upper may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

Figure 2:
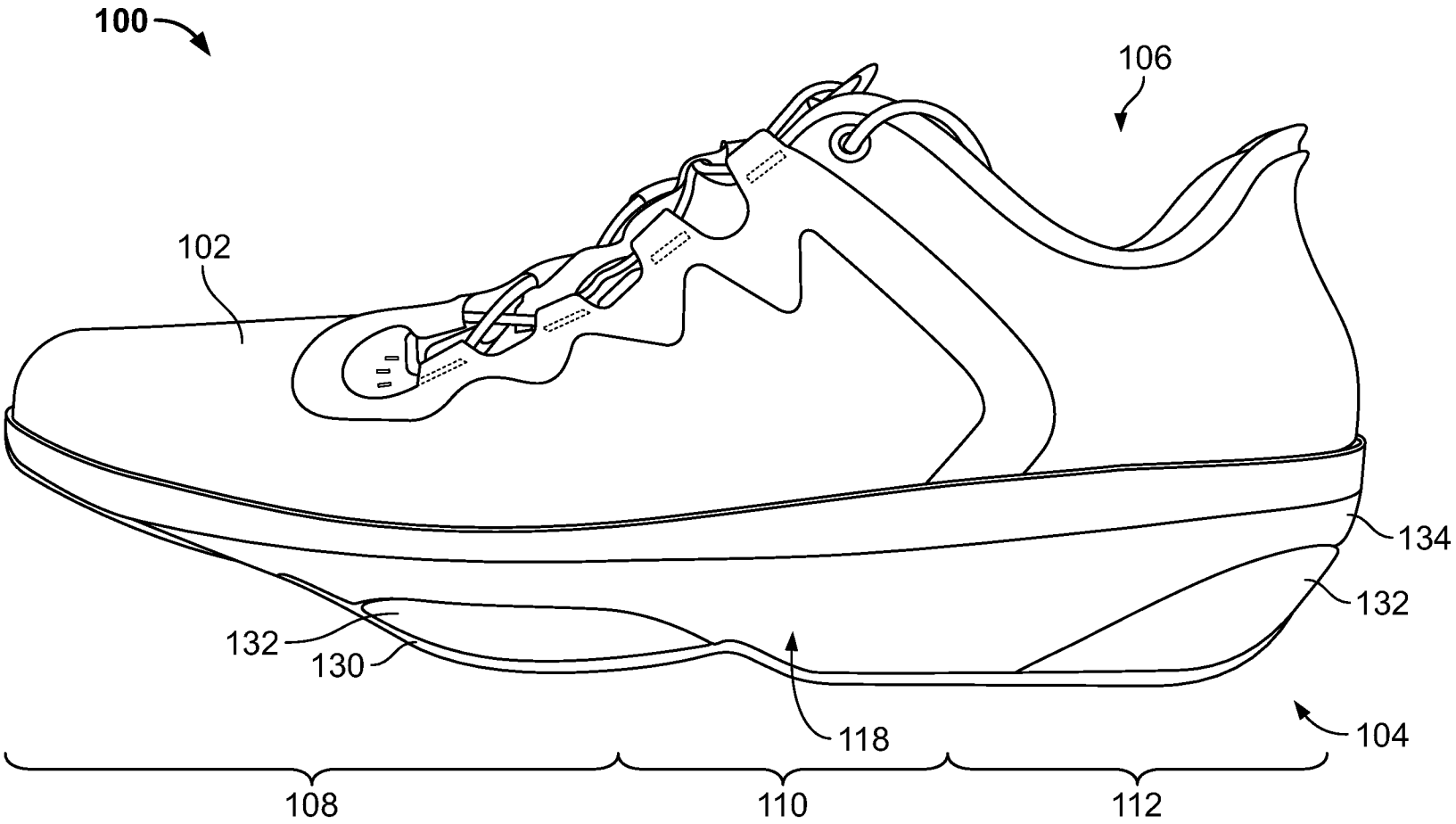
FIG. 2 is a lateral side view of the shoe of FIG. 1.
Figure 3:
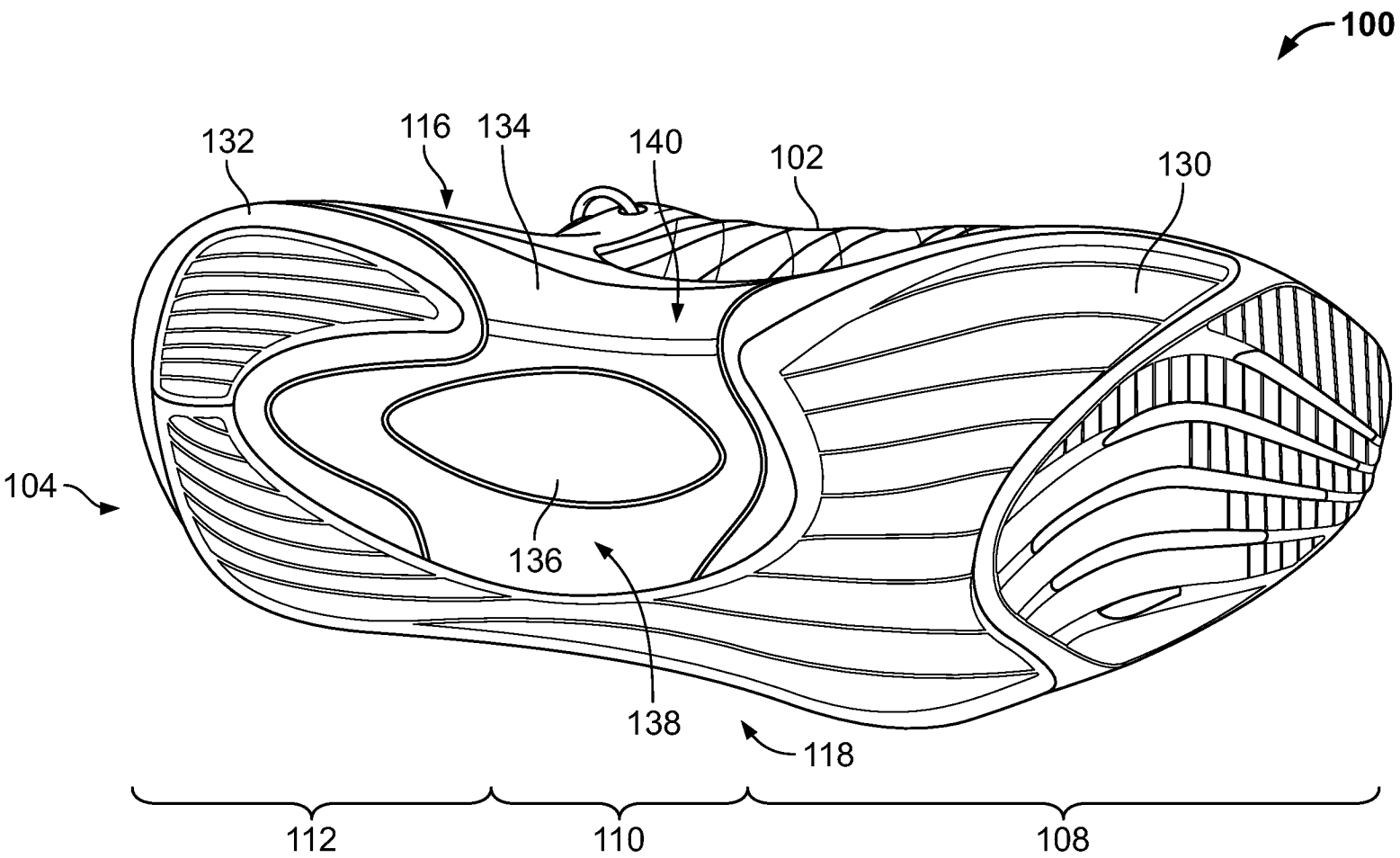
FIG. 3 is a bottom view of the shoe of FIG. 1.

FIGS. 1-3 depict an embodiment of an article of footwear 100, configured as a shoe, including an upper 102 and a sole structure 104. The upper 102 is attached to the sole structure 104 and together define an interior cavity 106 into which a foot may be inserted. For reference, the article of footwear 100 defines a forefoot region 108, a midfoot region 110, and a heel region 112. The forefoot region 108 generally corresponds with portions of the article of footwear 100 that encase portions of the foot that include the toes, the ball of the foot (shown in FIG. 4), and joints connecting the metatarsals with the toes or phalanges (also shown in FIG. 4). The midfoot region 110 is proximate and adjoining the forefoot region 108, and generally corresponds with portions of the article of footwear 100 that encase the arch of a foot, along with the bridge of a foot. The heel region 112 is proximate and adjoining the midfoot region 110 and generally corresponds with portions of the article of footwear 100 that encase rear portions of the foot, including the heel or calcaneus bone, the ankle, and/or the Achilles tendon.

While only a single article of footwear is depicted, i.e., a shoe that is worn on a left foot of a user, it should be appreciated that the concepts disclosed herein are applicable to a pair of shoes (not shown), which includes a left shoe and a right shoe that may be sized and shaped to receive a left foot and a right foot of a user, respectively. For ease of disclosure, a single shoe will be referenced to describe aspects of the disclosure. The disclosure below with reference to the article of footwear 100 is applicable to both a left shoe and a right shoe. However, in some embodiments there may be differences between a left shoe and a right shoe other than the left/right configuration. Further, in some embodiments, a left shoe may include one or more additional elements that a right shoe does not include, or vice versa.

Many conventional footwear uppers are formed from multiple elements (e.g., textiles, polymer foam, polymer sheets, leather, and synthetic leather) that are joined through bonding or stitching at a seam. In some embodiments, the upper 102 of the article of footwear 100 is formed from a knitted structure or knitted components. In various embodiments, a knitted component may incorporate various types of yarn that may provide different properties to an upper. For example, one area of the upper 102 may be formed from a first type of yarn that imparts a first set of properties, and another area of the upper 102 may be formed from a second type of yarn that imparts a second set of properties. Using this configuration, properties of the upper 102 may vary throughout the upper 102 by selecting specific yarns for different areas of the upper 102. In another example, an upper mesh layer may be warp knit, while a mesh backing layer may comprise a circular knit.

The article of footwear 100 also includes a medial side 116 illustrated in FIG. 1 and a lateral side 118 illustrated in FIG. 2. In particular, when a user is wearing the article of footwear 100, the lateral side 118 corresponds to an outside-facing portion of the article of footwear 100 and the medial side 116 corresponds to an inside-facing portion of the article of footwear 100. As such, left and right articles of footwear have opposing lateral and medial sides, such that the medial sides 116 are closest to one another when a user is wearing the articles of footwear 100, while the lateral sides 118 are defined as the sides that are farthest from one another while being worn. The medial side 116 and the lateral side 118 adjoin one another at opposing, distal ends of the article of footwear 100.

Unless otherwise specified, the forefoot region 108, the midfoot region 110, the heel region 112, the medial side 116, and the lateral side 118 are intended to define boundaries or areas of the article of footwear 100. To that end, the forefoot region 108, the midfoot region 110, the heel region 112, the medial side 116, and the lateral side 118 generally characterize sections of the article of footwear 100. Further, both the upper 102 and the sole structure 104 may be characterized as having portions within the forefoot region 108, the midfoot region 110, the heel region 112, and on the medial side 116 and the lateral side 118. Therefore, the upper 102 and the sole structure 104, and/or individual portions of the upper 102 and the sole structure 104, may include portions thereof that are disposed within the forefoot region 108, the midfoot region 110, the heel region 112, and on the medial side 116 and the lateral side 118.

Figure 4:
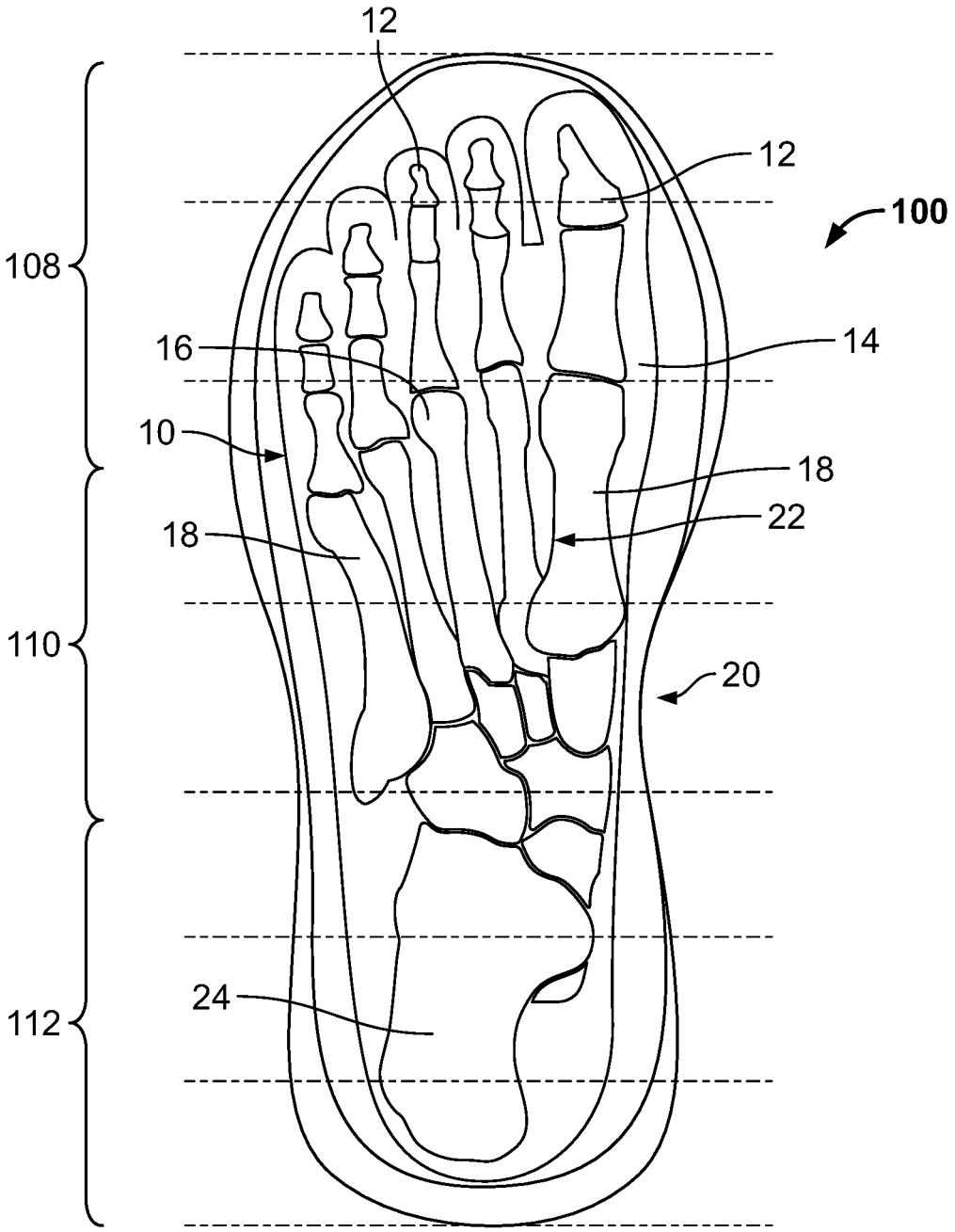
FIG. 4 is a top plan view of the article of footwear of FIG. 1, with an upper removed and a user's skeletal foot structure overlaid thereon.

Referring to FIG. 4, the forefoot region 108 may generally correspond with portions of the article of footwear 100 that encase portions of a foot 10 that include the toes or phalanges 12, the ball 14 of the foot 10, and one or more of the joints 16 that connect the metatarsals 18 of the foot 10 with the toes or phalanges 12. The midfoot region 110 is proximate and adjoins the forefoot region 108. The midfoot region 110 generally corresponds with portions of the article of footwear 100 that encase an arch 20 of a foot 10, along with a bridge 22 of the foot 10. The heel region 112 is proximate to the midfoot region 110 and adjoins the midfoot region 110. The heel region 112 generally corresponds with portions of the article of footwear 100 that encase rear portions of the foot 10, including the heel or calcaneus bone 24, the ankle (not shown), and/or the Achilles tendon (not shown).

The sole structure 104 is connected or secured to the upper 102 and extends between a foot of a user and the ground when the article of footwear 100 is worn by the user. The sole structure 104 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system (e.g., one or more midsole members, which can be configured as cushion layers), and an insole that provides support for an arch of a user. As will be further discussed herein, the sole structure 104 of the present embodiment of the invention includes one or more components that provide the sole structure 104 with preferable spring and damping properties.

The sole structure 104 includes an outsole 130, a first midsole member 132 (e.g., a first cushion layer), a second midsole member 134 (e.g., a second cushion layer), and a sole plate 136 (see, for example FIG. 3). The first midsole member 132, the second midsole member 134, and the sole plate 136 can form a cushioning system of the sole structure 104 (e.g., a midsole of the sole structure 104). The outsole 130 may define a bottom end or surface of the sole structure 104 across the heel region 112, the midfoot region 110, and the forefoot region 108. Further, the outsole 130 may be a ground-engaging portion or include a ground-engaging surface of the sole structure 104 and may be opposite of the insole thereof. The outsole 130 may be formed from one or more materials to impart durability, wear-resistance, abrasion resistance, or traction to the sole structure 104. In some embodiments, the outsole 130 may be formed from rubber, for example.

Together, the first midsole member 132 and the second midsole member 134 form a midsole and may be positioned adjacent to and on top of the outsole 130 in the heel region 112 and partially in the midfoot region 110 and forefoot region 108. The first midsole member 132 and the second midsole member 134 define a cutout portion 138. The first midsole member 132 may be constructed from a thermoplastic material, such as polyurethane (PU) plastic, for example and the second midsole member 134 may be constructed from ethylene-vinyl acetate (EVA), copolymers thereof, or a similar type of material. In other embodiments, each of the first midsole member 132 and the second midsole member 134 may be constructed from the same material.

In other embodiments, the first midsole member 132 and/or the second midsole member 134 may be an EVA-Solid-Sponge ("ESS") material, an EVA foam (e.g., PUMA® ProFoam Lite™, IGNITE Foam), polyurethane, polyether, an olefin block copolymer, a thermoplastic material (e.g., a thermoplastic polyurethane, a thermoplastic elastomer, a thermoplastic polyolefin, etc.), or a supercritical foam. The first midsole member 132 and/or the second midsole member 134 may be a single polymeric material or may be a blend of materials, such as an EVA copolymer, a thermoplastic polyurethane, a polyether block amide (PEBA) copolymer, and/or an olefin block copolymer.

The sole structure further includes the sole plate 136 disposed between the second midsole member 134 and the upper 102. As shown in FIG. 3, the sole plate 136 extends at least partially through the midfoot region 110 and is exposed at the cutout portion 138. The sole plate 136 is also disposed adjacent an arched section 140 of the article of footwear 100.

In some embodiments, the ground-engaging surface is not continuous along the medial side 116 of the midfoot region 110 of the article of footwear. For example, as illustrated in FIG. 3, the outsole 130 partially surrounds the arched section 140, the first midsole member 132 partially surrounds and partially defines the arched section 140, and the second midsole member 134 surrounds and partially defines the arched section 140.

In some embodiments, the sole plate 136 comprises a polyurethane (PU) plastic, such as a thermoplastic polyurethane (TPU) material, for example. Other thermoplastic elastomers and fiber reinforced thermoplastics consisting of block copolymers are also possible. In other embodiments, the sole plate 136 can include carbon fiber, for example. In some embodiments, these and other rigid, semi-rigid, or spring-like materials and combinations thereof may comprise the sole plate 136. The sole plate 136 can have varied stiffness along the length of the sole plate 136. For example, the stiffness in the forefoot region 108 of the sole plate 136 may be more or less flexible than the midfoot region 110 of the sole plate 136, which may be more or less flexible than the heel region 112 of the sole plate 136. Alternatively, the sole plate 136 can include a uniform stiffness. Additionally, the sole plate 136 may include additional or alternative geometries, such as, for example, notches, curves, protrusions, voids, angled edges, cutouts, etc. In some embodiments, the sole plate 136 can be configured as a shock plate to impart impact protection and facilitate leg muscle tension, thereby relieving stress on a heel, ankle, shin, knees, hips, and/or back of a user.

FIGS. 5A through 5M depict an exemplary embodiment of a sole structure 204 according to one embodiment of the invention. Similar to the sole structure 104, the sole structure 204 is configured to be attached to an upper 202 and together define an interior cavity 206 of an article of footwear 200 (shown in FIG. 5D) into which a foot may be inserted. For reference, the sole structure 204 defines a forefoot region 208, a midfoot region 210, and a heel region 212. The forefoot region 208 generally corresponds with portions of an article of footwear, such as the article of footwear 100, for example, that encase portions of the foot that include the toes, the ball of the foot (shown in FIG. 4), and joints connecting the metatarsals with the toes or phalanges (also shown in FIG. 4). The midfoot region 210 is proximate and adjoining the forefoot region 208, and generally corresponds with portions of the article of footwear that encase the arch of a foot, along with the bridge of a foot. The heel region 212 is proximate and adjoining the midfoot region 110 and generally corresponds with portions of the article of footwear that encase rear portions of the foot, including the heel or calcaneus bone, the ankle, and/or the Achilles tendon (shown in FIG. 4).

Figures 5A, 5B, 5C:
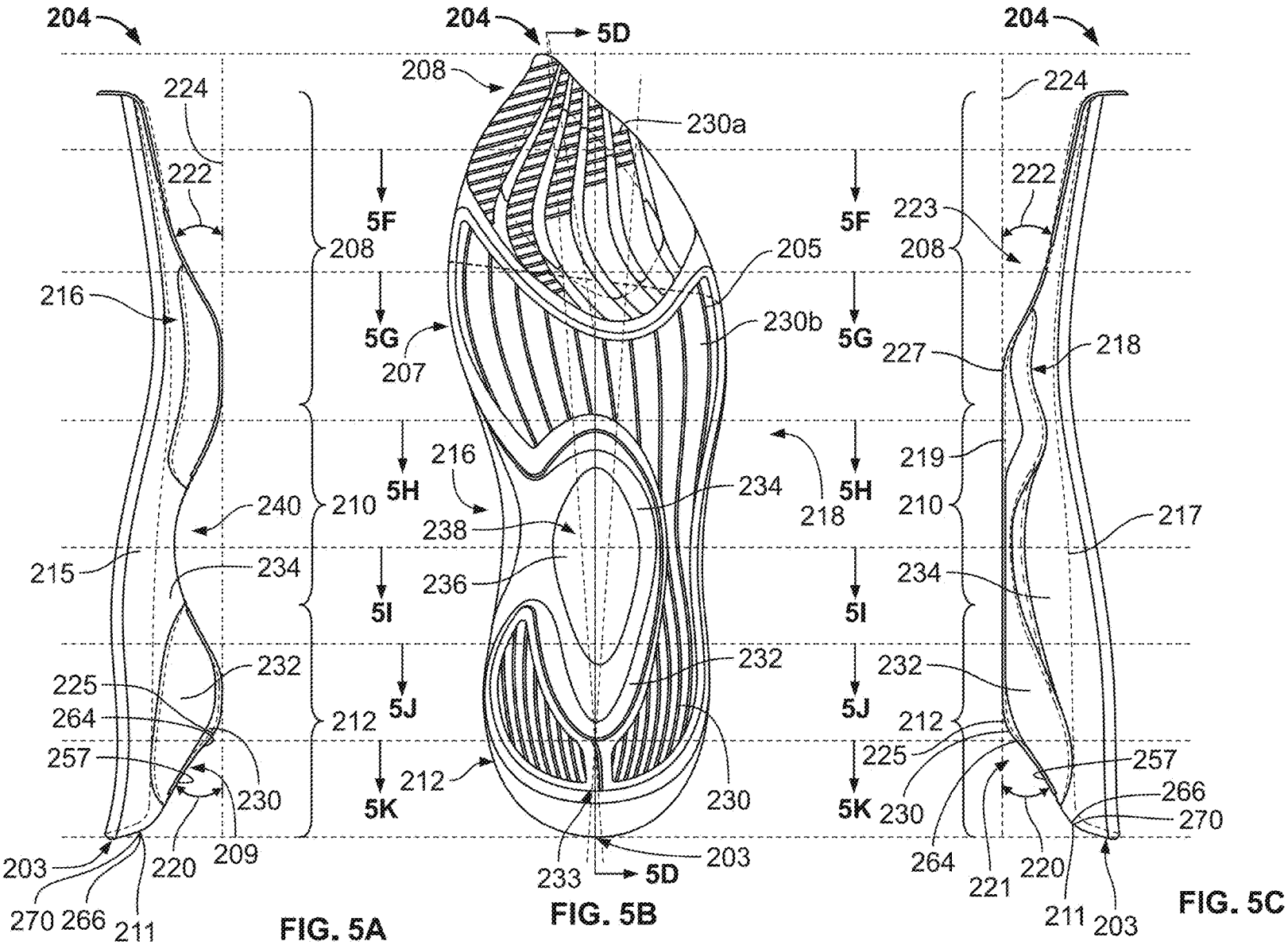
FIG. 5A is a medial view of a sole structure of an article of footwear that includes a sole plate according to an embodiment of the disclosure.
FIG. 5B is a bottom view of the sole structure of FIG. 5A.
FIG. 5C is a lateral side view of the sole structure of FIG. 5A.

The sole structure 204 also includes a medial side 216 illustrated in FIG. 5A and a lateral side 218 illustrated in FIG. 5C. In particular, the lateral side 218 corresponds to an outside portion of the article of footwear and the medial side 216 corresponds to an inside portion of the article of footwear. As such, left and right articles of footwear have opposing lateral and medial sides, such that the medial sides 216 are closest to one another when a user is wearing the articles of footwear, while the lateral sides 218 are defined as the sides that are farthest from one another while being worn. The medial side 216 and the lateral side 218 adjoin one another at opposing, distal ends of the article of footwear.

Unless otherwise specified, the forefoot region 208, the midfoot region 210, the heel region 212, the medial side 216, and the lateral side 218 are intended to define boundaries or areas of the article of footwear. To that end, the forefoot region 208, the midfoot region 210, the heel region 212, the medial side 216, and the lateral side 218 generally characterize sections of the article of footwear. Further, both the upper 202 and the sole structure 204 may be characterized as having portions within the forefoot region 208, the midfoot region 210, the heel region 212, and on the medial side 216 and the lateral side 218. Therefore, the upper 202 and the sole structure 204, and/or individual portions of the upper 202 and the sole structure 204, may include portions thereof that are disposed within the forefoot region 208, the midfoot region 210, the heel region 212, and on the medial side 216 and the lateral side 218.

The sole structure 204 is connected or secured to the upper 202 and extends between a foot of a user and the ground when the article of footwear is worn by the user. The sole structure 204 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system (e.g., one or more midsole members, which can be configured as cushioning layers), and an insole that provides support for an arch of a user. As will be further discussed herein, the sole structure 204 of the present embodiment of the invention includes one or more components that provide the sole structure 204 with preferable spring and damping properties.

The sole structure 204 includes an outsole 230, a first midsole member 232 (e.g., a first cushion layer), a second midsole member 234 (e.g., a second cushion layer), and a sole plate 236. The first midsole member 232, the second midsole member 234, and the sole plate 236 can form a cushioning system of the sole structure 204 (e.g., a midsole of the sole structure 204). The first midsole member 232 is coupled to the outsole 230 and the second midsole member 234 is positioned between the first midsole member 232 and the upper 202. The outsole 230 may define a bottom end or surface of the sole structure 204 across the heel region 212, the midfoot region 210, and the forefoot region 208. Further, the outsole 230 may be a ground-engaging portion or include a ground-engaging surface of the sole structure 204 and may be opposite of the insole thereof. The outsole 230 may be formed from one or more materials to impart durability, wear-resistance, abrasion resistance, or traction to the sole structure 204. In some embodiments, the outsole 230 may be formed from rubber, for example.

When in a rested state as shown in FIGS. 5A-5M, the sole structure 204 is shaped to define an entry angle 220 in the heel region 212 and an exit angle 222 in the forefoot region 208 with respect to a flat ground surface 224. More specifically, the first midsole member 232, the second midsole member 234, and the outsole 230 can be shaped to define the entry angle 220 and the exit angle 222. The sole structure 204 can also define a substantially flat region 219 that is approximately parallel with the flat ground surface 224. In some embodiments, the entry angle 220 can be about 30 degrees. Correspondingly, the sole structure 204 can define an entry region 221 in which a bottom surface 205 (e.g., a ground-engaging surface) of the sole structure 204 curves upwardly to start angling away from the ground surface 224 approximate the area underneath the heel of a user's foot (shown in FIG. 4). In some embodiments, the exit angle 222 can be about 15 degrees. Correspondingly, the sole structure 204 can also define an exit region 223 in which the bottom surface 205 of the sole structure 204 curves to start angling away from the ground surface 224 approximate the area underneath the balls of a user's foot (shown in FIG. 4).

The entry and exit angles 220, 222 can be configured to enhance contact with a user's heel during a heel strike and promoting engagement of a large surface area of the outsole 230 in the forefoot region 208 during a push-off by the user. Accordingly, the entry region 221 can extend rearward from the substantially flat region 219 and the exit region 223 can extend forward from the substantially flat region 219. In some embodiments, the junction between the substantially flat region 219 and the exit region 223 can be located at a widest portion 207 of the sole structure 204 (e.g., at a greatest distance between the medial and lateral sides 216, 218), so as to be aligned proximate to the metatarsal bones of the user.

Due to the curved nature of each of the entry region 221 and the exit region 223, the respective junctions with the substantially flat region 219 can form rocking regions 225, 227 (e.g., rocking members). The rocking regions 225, 227 can create a fulcrum for the sole plate 236. For example, the fulcrum created by the rocking region 227 can create a propulsion lever with the sole plate 236 between a midfoot region and a heel region of the wearer that allows the wearer to accelerate faster and create a toe-off movement where the forefoot region of the wearer propels the wearer forward.

As shown in FIGS. 5A-5D, the sole structure 204 includes a lower surface 209 that is visible when the article of footwear 200 is viewed from the bottom of the article of footwear 200. The lower surface 209 faces the ground surface 224 and away from the upper 202 when the article of footwear 200 is resting on the ground surface 224. The lower surface 209 includes the bottom surface 205, as well as other surfaces that are visible from the bottom of the article of footwear 200. The lower surface 209 includes surfaces of the sole plate 236 and the second midsole member 234 that are visible through the cutout portion 238. That is, the sole plate 236 and the second midsole member 234 are visible through the cutout portion 238. The lower surface 209 also defines the substantially flat region 219, the entry region 221, and the exit region 223.

Correspondingly, the sole structure 204 further includes side surfaces that extend between the lower surface 209 and the upper 202. More specifically, the sole structure 204 includes a medial side surface 215 (see FIG. 5A) and a lateral side surface 217 (see FIG. 5C) that are visible from the medial side 216 and the lateral side 218, respectively. The medial side surface 215 and the lateral side surface 217 adjoin one another at a heel end 203 of the article of footwear 200 (see also FIGS. 5D and 5M). Accordingly, as viewed from the medial side 216 and the lateral side 218, the side surfaces 215, 217 extend between the upper 202 and an angled portion 257 of the entry region 221 that defines the entry angle 220. The angled portion 257 extends from a first end 264 to a second end 266. The second end 266 corresponds with a heel end 211 of the lower surface 209 and a heel end 270 of the bottom surface 205. The first end 264 extends from a rocking region 225 that is curved and extends from the substantially flat region 219, e.g., away from the ground surface 224 when the article of footwear 200 is resting on the ground surface 224. Accordingly, the rocking region 225 extends from the substantially flat region 219 to the first end 264 of the angled portion 257.

The first midsole member 232 and the second midsole member 234 may be positioned adjacent and on top of the outsole 230 in the heel region 212 and partially in the midfoot region 210 and forefoot region 208, with the first midsole member 232 concentrated in the areas underneath the balls and heel of a user's foot. The first midsole member 232 and the second midsole member 234 define a cutout portion 238. The first midsole member 232 may be constructed from a thermoplastic material, such as PU, for example and the second midsole member 234 may be constructed from EVA, copolymers thereof, or a similar type of material. In other embodiments, each of the first midsole member 232 and the second midsole member 234 may be constructed from the same material. In some embodiments, the first midsole member 232 and/or the second midsole member 234 may be an EVA-Solid-Sponge ("ESS") material, an EVA foam (e.g., PUMA® ProFoam Lite™, IGNITE Foam), polyurethane, polyether, an olefin block copolymer, a thermoplastic material (e.g., a thermoplastic polyurethane, a thermoplastic elastomer, a thermoplastic polyolefin, etc.), or a supercritical foam. The first midsole member 232 and/or the second midsole member 234 may be a single polymeric material or may be a blend of materials, such as an EVA copolymer, a thermoplastic polyurethane, a polyether block amide (PEBA) copolymer, and/or an olefin block copolymer.

Figure 5E:
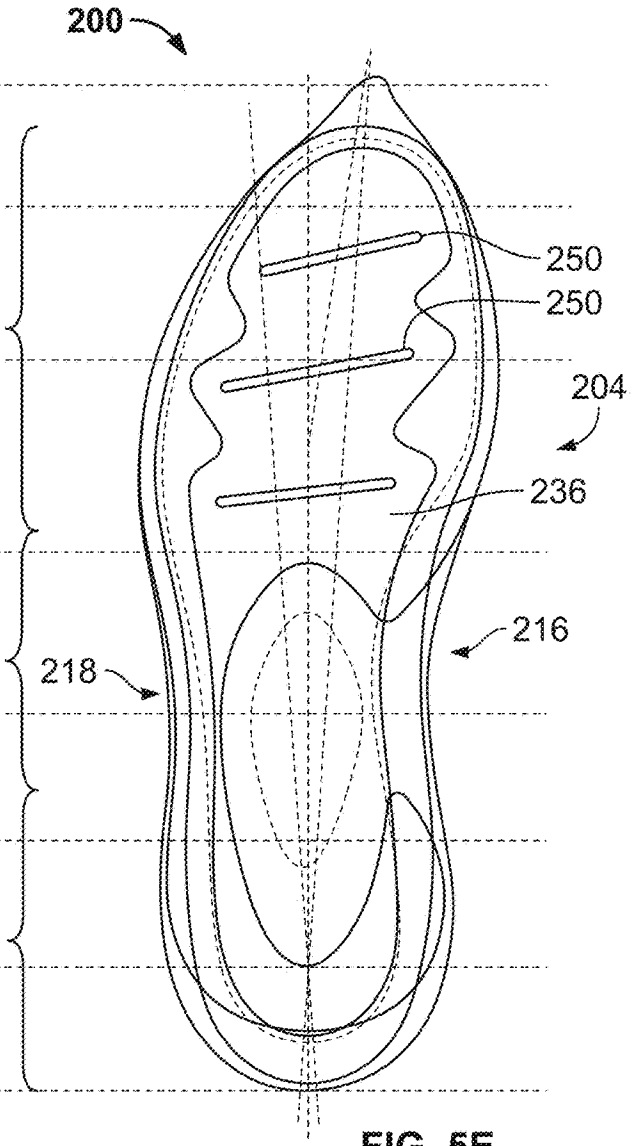
FIG. 5E is a top view of the sole structure of FIG. 5A.
Figure 5D:
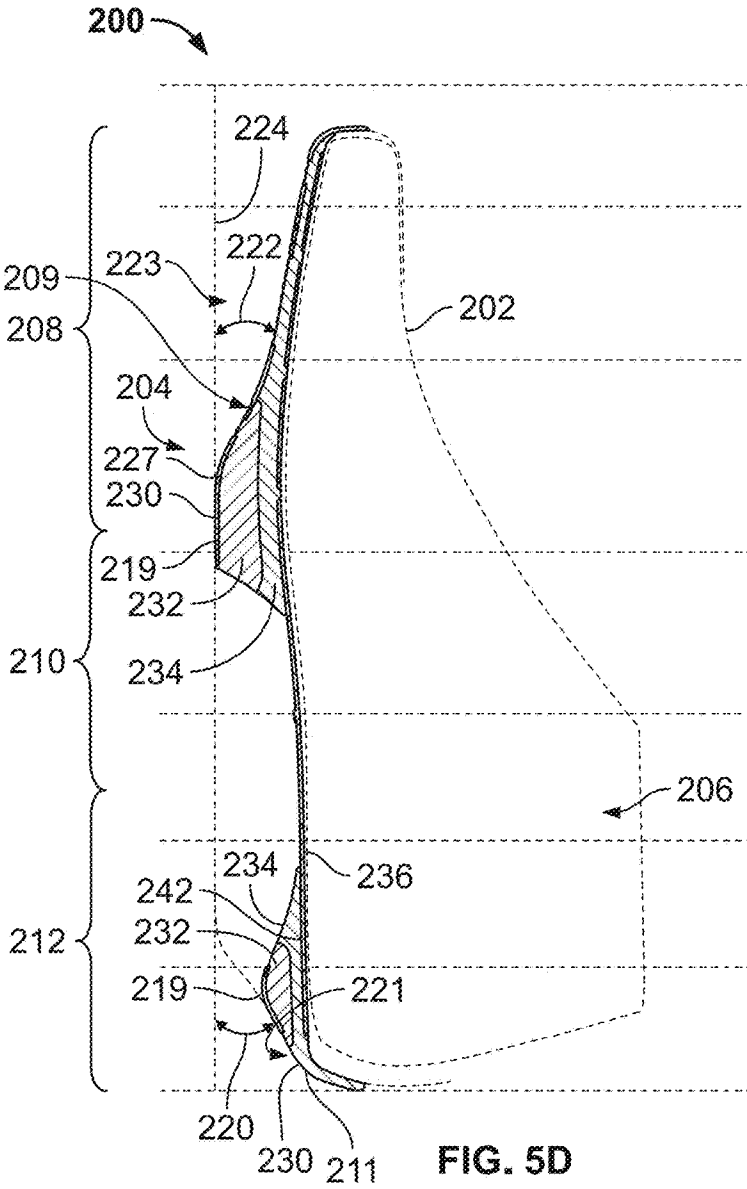
FIG. 5D is a cross-sectional view of the sole structure of FIG. 5A taken along line 5D-5D of FIG. 5B.

The sole structure further includes the sole plate 236 disposed between the second midsole member 234 and the upper 202. As shown in FIGS. 5D and 5E, the sole plate 236 extends through the midfoot region 210 and is exposed at the cutout portion 238 within an arched section 240 illustrated in FIG. 5B. Further illustrated in FIG. 5B, the outsole 230 partially surrounds the arched section 240, the first midsole member 232 partially surrounds and partially comprises the arched section 240, and the second midsole member 234 surrounds and partially comprises the arched section 240.

In some embodiments, the ground-engaging surface is not continuous along the medial side 216 of the midfoot region 210 of the article of footwear. Correspondingly, the outsole 230 may comprise multiple outsole portions that are spaced apart from one another, such that the ground engaging surface is not continuous between the outsole portions. For example, as illustrated in FIG. 5B, the outsole 230 includes a first outsole portion 230*a* positioned in the forefoot region 208 and generally forward of the widest portion 207 (e.g., to extend into the exit region 223). Additionally, the outsole 230 includes a second outsole portion 230*b* extending from the widest portion 207, along the lateral side 218 of the midfoot region 410, and around a periphery of the heel region 212 to the medial side 216 (e.g., to extend into the entry region 221).

In some embodiments, for example, as illustrated in FIGS. 5B, and 5I-5M, the first midsole member 232 can define a longitudinal channel 233 that extends from the heel region 212 and into the midfoot region 210.

Illustrated in FIG. 5E, the sole plate 236 extends between the heel region 212 and the forefoot region 208 and includes a plurality of cutouts 250 in the forefoot region 208. The plurality of cutouts 250 are oriented to approximate the angle of the path of the ball of user's foot (shown in FIG. 4) from medial side to lateral side. The plurality of cutouts 250 provide reliefs in the sole plate 250 allowing it to bend and flex more easily at the cutouts 250. Generally, the sole plate 236 has a shape that is similar to but proportionally smaller than the midsole member 232 in the midfoot and heel regions 210, 212. In the forefoot region 218, the sole plate 236 has an irregular periphery, wherein the periphery extends inward in the spaces between the cutouts 250. Decreasing the width of the sole plate 236 in the spaces between the cutouts 250 increases the flexibility of the sole plate 236 in the forefoot region 218 by making the sole plate 236 easier to bend. Illustrated in FIGS. 5F through 5K, the sole plate 236 has a uniform thickness. In some embodiments, the thickness of the sole plate 236 is approximately 1.2 millimeters. In some embodiments, the sole plate 236 can be configured as a shock plate to impart impact protection and facilitate leg muscle tension thereby relieving stress on a heel, ankle, shin, knees, hips, and/or back of a user.

Figure 5G:
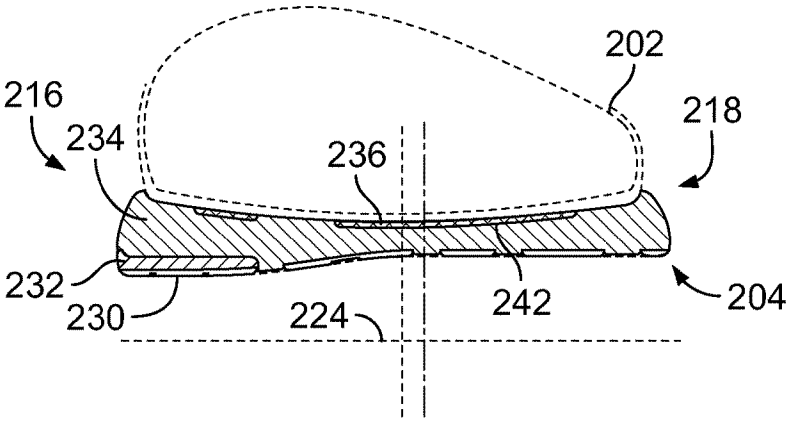
FIG. 5G is a cross-sectional view of the sole structure of FIG. 5A taken along the line 5G-5G of FIG. 5B.
Figure 5I:
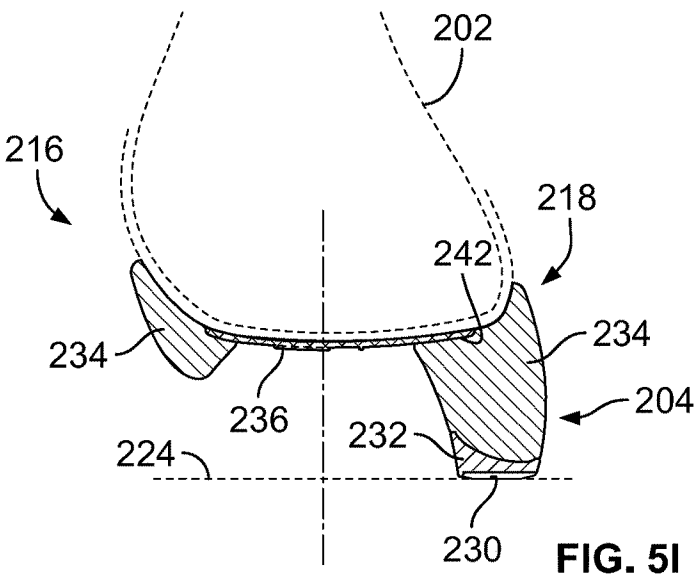
FIG. 5I is a cross sectional view of the sole structure of FIG. 5A taken along the line 5I-5I of FIG. 5B.
Figure 5F:
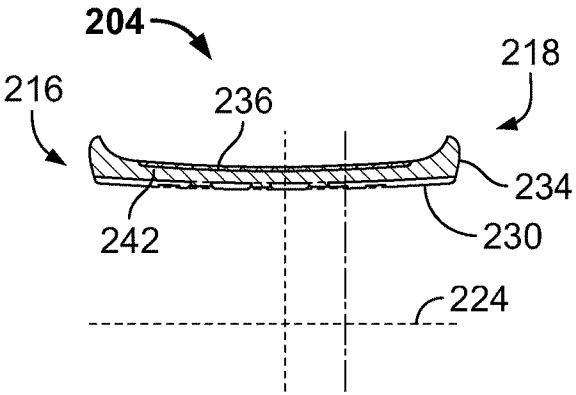
FIG. 5F is a cross-sectional view of the sole structure of FIG. 5A taken along line 5F-5F of FIG. 5B.

Continuing, FIGS. 5F and 5G show cross-sectional views of the forefoot region 208 of the article of footwear 200 along lines 5F-5F and 5G-5G in FIG. 5B. In FIG. 5F, the sole plate 236 is shown extending between the medial side 216 and the lateral side 218 and positioned within a pocket 242 and exposed along the top of the second midsole member 234. In FIG. 5G, the second midsole member 234 is shown extending through one of the plurality of cutouts 250 and contacting the upper 202. FIG. 5G further shows the first midsole member 232 in contact with the second midsole member 234 and the outsole 230 along the medial side 216.

Figure 5H:
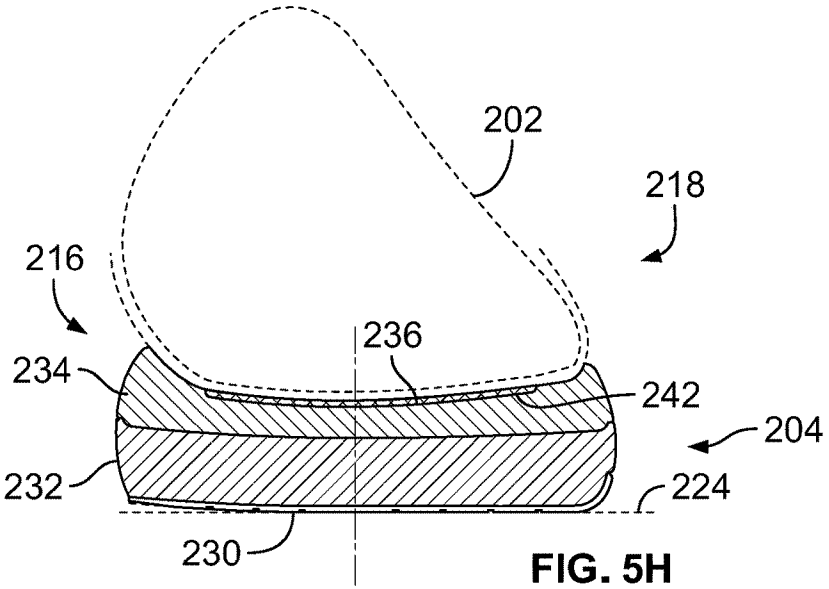
FIG. 5H is a cross-sectional view of the sole structure of FIG. 5A taken along the line 5H-5H of FIG. 5B.

FIGS. 5H and 5I illustrate cross-sectional views of the midfoot region 210 of the article of footwear 200 along lines 5H-5H and 5I-5I of FIG. 5B. The sole plate 236 is positioned within the pocket 242 and exposed along the top of the second midsole member 234 in FIG. 5H. Further, the second midsole member 234 extends continuously from medial side 216 to the lateral side 218 and the first midsole member 232 is sandwiched between the second sole member 234 and the outsole 230, with both the first midsole member 232 and the outsole 230 also extending continuously from the medial side 216 to the lateral side 218. Looking at FIGS. 5A, 5C, and 5D, and as mentioned above, this portion of the sole structure 204 is located underneath the ball of a user's foot (shown in FIG. 4) and creates a rocking member (i.e., a rocking region) with a fulcrum proximate to the metatarsal bones of the user. The position of the sole plate 236 in relation to the first and second midsole members 232, 234 effectively adjusts the running posture of the user to be a forward tilt and moves the running motion of the user toward their forefoot.

Continuing, in FIG. 5G, the sole plate 236 is also shown positioned within and exposed along the top of the second midsole member 234 but also exposed through the cutout portion 238. The first midsole member 232 is only shown along the lateral side 218. Along the medial side 216, the second midsole member 234 is spaced from the ground surface 224 and is configured to be capable of engaging an elevated ground surface or other external surface at the midfoot region 210.

Figure 5K:
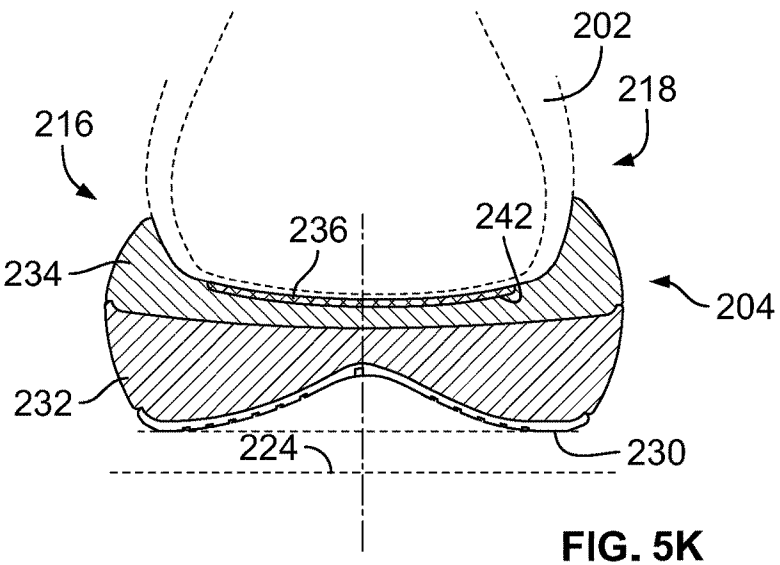
FIG. 5K is a cross-sectional view of the sole structure of FIG. 5A taken along the line 5K-5K of FIG. 5B.
Figure 5M:
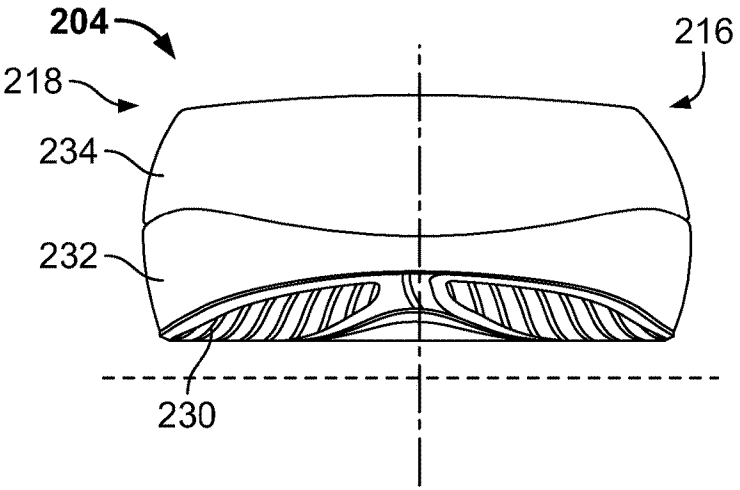
FIG. 5M is a heel view of the sole structure of FIG. 5A.
Figure 5J:
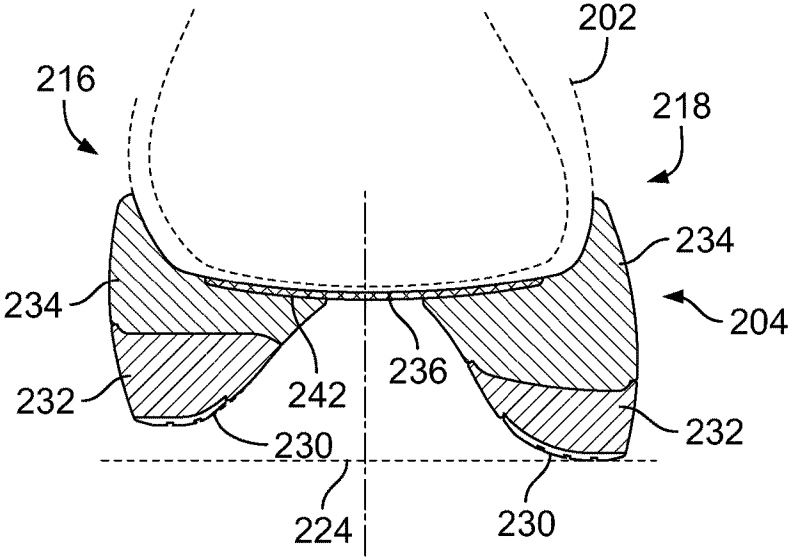
FIG. 5J is a cross-sectional view of the sole structure of FIG. 5A taken along the line 5J-5J of FIG. 5B.

Further, FIGS. 5J and 5K show cross-sectional views of the heel region 212 of the article of footwear 200 along lines 5J-5J and 5K-5K of FIG. 5B. The sole plate 236 is positioned within the pocket 242 of the second midsole member 234 as shown in both FIGS. 5J and 5K, but is exposed through the cutout portion 238 in at least the area of the heel region 212 of the sole structure 204 shown in FIG. 5J. Additionally, the first midsole member 232 is positioned between the second midsole member 234 and the outsole 230 along both the medial side 216 and the lateral side 218 of the heel region 212. In FIG. 5K, the sole plate 236 is shown positioned within the pocket 242 and exposed along the top of the second midsole member 234. Further, the second midsole member 234 extends continuously from the medial side 216 to the lateral side 218. The first midsole member 232 is positioned between the second midsole member 234 and the outsole 230. Both the first midsole member 232 and the outsole 230 extend continuously from the medial side 216 to the lateral side 218.

In some embodiments, the sole plate 236 comprises a PU plastic, such as a TPU material, for example. Other thermoplastic elastomers and fiber reinforced thermoplastics consisting of block copolymers are also possible. In other embodiments, the sole plate 236 can include carbon fiber, for example. However, these and other rigid, semi-rigid, or spring-like materials and combinations thereof may comprise the sole plate 236. The sole plate 236 can have varied stiffness along the length of the sole plate 236. For example, the stiffness in the forefoot region 208 of the sole plate 236 may be more or less flexible than the midfoot region 210 of the sole plate 236, which may be more or less flexible than the heel region 212 of the sole plate 236. Alternatively, the sole plate 236 can include a uniform stiffness. Additionally, the sole plate 236 may include additional or alternative geometries, such as, for example, notches, curves, protrusions, voids, angled edges, cutouts, etc.

Figure 5L:
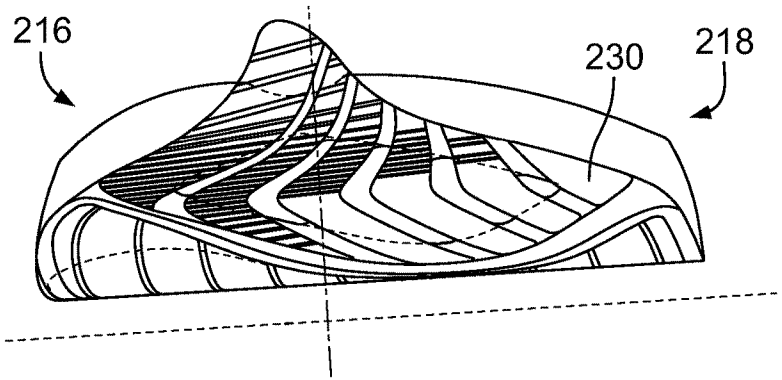
FIG. 5L is a toe view of the sole structure of FIG. 5A.

FIGS. 5L and 5G illustrate a toe view and a heel view, respectively, of the article of footwear 200. The outsole 230 extends up and around the second midsole member 234 and at least a portion of the upper 202 in the front of the forefoot region 208 (shown in FIGS. 5A, 5C and 5D).

FIGS. 6A through 6M depict an exemplary embodiment of a sole structure 304 according to one embodiment of the disclosure. Similar to the sole structures 104 and 204, the sole structure 304 is configured to be attached to an upper 302 and together define an interior cavity of an article of footwear 300 (shown in FIG. 6D) into which a foot may be inserted. For reference, the sole structure 304 defines a forefoot region 308, a midfoot region 310, and a heel region 312. The forefoot region 308 generally corresponds with portions of an article of footwear, such as the article of footwear 100, for example, that encase portions of the foot that include the toes, the ball of the foot (shown in FIG. 4), and joints connecting the metatarsals with the toes or phalanges (also shown in FIG. 4). The midfoot region 310 is proximate and adjoining the forefoot region 308, and generally corresponds with portions of the article of footwear that encase the arch of a foot, along with the bridge of a foot. The heel region 312 is proximate and adjoining the midfoot region 310 and generally corresponds with portions of the article of footwear that encase rear portions of the foot, including the heel or calcaneus bone, the ankle, and/or the Achilles tendon (shown in FIG. 4).

Figures 6A, 6B, 6C:
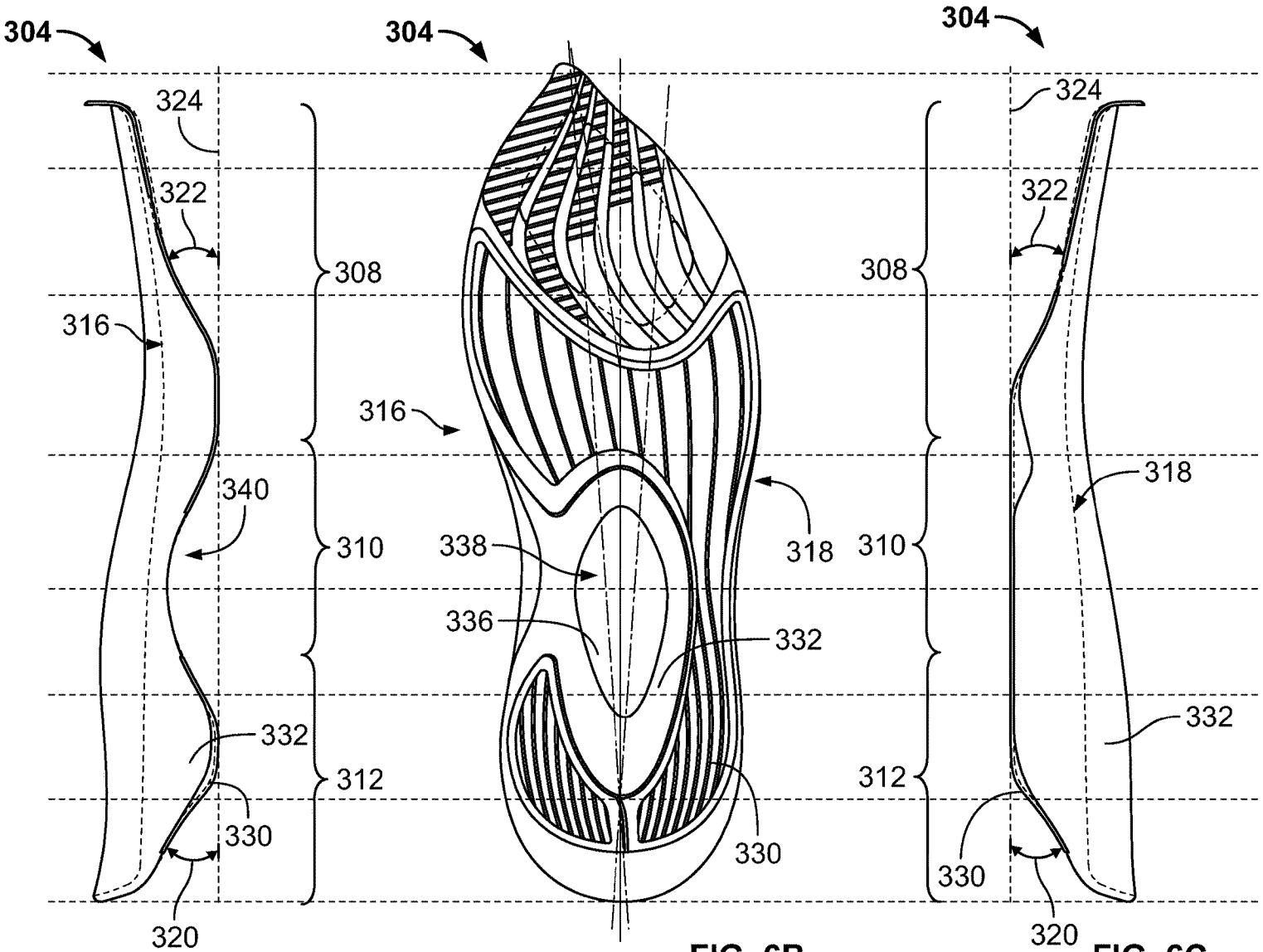
FIG. 6A is a medial side view of a sole structure of an article of footwear that includes a sole plate and a foam layer according to an embodiment of the disclosure.
FIG. 6B is a bottom view of the sole structure of FIG. 6A.
FIG. 6C is a lateral side view of the sole structure of FIG. 6A.

The sole structure 304 also includes a medial side 316 illustrated in FIG. 6A and a lateral side 318 illustrated in FIG. 6C. In particular, the lateral side 318 corresponds to an outside portion of the article of footwear and the medial side 316 corresponds to an inside portion of the article of footwear. As such, left and right articles of footwear have opposing lateral and medial sides, such that the medial sides 316 are closest to one another when a user is wearing the articles of footwear, while the lateral sides 318 are defined as the sides that are farthest from one another while being worn. The medial side 316 and the lateral side 318 adjoin one another at opposing, distal ends of the article of footwear.

Unless otherwise specified, the forefoot region 308, the midfoot region 310, the heel region 312, the medial side 316, and the lateral side 318 are intended to define boundaries or areas of the article of footwear. To that end, the forefoot region 308, the midfoot region 310, the heel region 312, the medial side 316, and the lateral side 318 generally characterize sections of the article of footwear. Further, both the upper 302 and the sole structure 304 may be characterized as having portions within the forefoot region 308, the midfoot region 310, the heel region 312, and on the medial side 316 and the lateral side 318. Therefore, the upper 302 and the sole structure 304, and/or individual portions of the upper 302 and the sole structure 304, may include portions thereof that are disposed within the forefoot region 308, the midfoot region 310, the heel region 312, and on the medial side 316 and the lateral side 318.

The sole structure 304 is connected or secured to the upper 302 and extends between a foot of a user and the ground when the article of footwear is worn by the user. The sole structure 304 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system (e.g., one or more midsole members, which can be configured as cushioning layers), and an insole that provides support for an arch of a user. As will be further discussed herein, the sole structure 304 of the present embodiment of the invention includes one or more components that provide the sole structure 304 with preferable spring and damping properties.

The sole structure 304 includes an outsole 330, a midsole member 332 (e.g., a first midsole member or cushion layer), a sole plate 336, and a cushion layer 352 (e.g., a second midsole member or cushion layer). The midsole member 332, the cushion layer 352, and the sole plate 336 can form a cushioning system of the sole structure 304 (e.g., a midsole of the sole structure 304). The outsole 330 may define a bottom end or surface of the sole structure 304 across the heel region 312, the midfoot region 310, and the forefoot region 308. Further, the outsole 330 may be a ground-engaging portion or include a ground-engaging surface of the sole structure 304 and may be opposite of the insole thereof. The outsole 330 may be formed from one or more materials to impart durability, wear-resistance, abrasion resistance, or traction to the sole structure 304. In some embodiments, the outsole 330 may be formed from rubber, for example. Similar to the outsole 230, the outsole 330 can have an entry angle 320 in the heel region 312 and an exit angle 322 in the forefoot region 308 relative to a ground surface 324. Further, in some embodiments, the entry angle 320 can be about 30 degrees, and in some embodiments the exit angle 322 can be about 15 degrees.

Accordingly, when in a rested state as shown in FIGS. 6A-6M, the sole structure 304 is shaped to define an entry angle 320 in the heel region 312 and an exit angle 322 in the forefoot region 308 with respect to a flat ground surface 324. The sole structure 304 can also define a substantially flat region 319 that is approximately parallel with the flat ground surface 324. Correspondingly, the sole structure 304 can define an entry region 321 in which a bottom surface 305 (e.g., a ground-engaging surface) of the sole structure 304 curves upwardly to start angling away from the ground surface 324 approximate the area underneath the heel of a user's foot (shown in FIG. 4). Correspondingly, the sole structure 304 can also define an exit region 323 in which the bottom surface 305 of the sole structure 304 curves upwardly to start angling away from the ground surface 324 approximate the area underneath the ball of a user's foot (shown in FIG. 4).

The entry and exit angles 320, 322 can be configured to enhance contact with a user's heel during a heel strike and promote engagement of a large surface area of the outsole 330 in the forefoot region 308 during a push-off by the user. Accordingly, the entry region 321 can extend rearward from the substantially flat region 319 and the exit region 323 can extend forward from the substantially flat region 319. In some embodiments, the junction between the substantially flat region 319 and the exit region 323 can be located at a widest portion 307 of the sole structure 304 (e.g., at a greatest distance between the medial and lateral sides 316, 318), so as to be aligned proximate to the metatarsal bones of the user.

Due to the curved nature of each of the entry region 321 and the exit region 323, the respective junctions with the substantially flat region 319 can form rocking regions 325, 327 (e.g., rocking members). The rocking regions 325, 327 can create a fulcrum for the sole plate 336. For example, the fulcrum created by the rocking region 327 can create a propulsion lever with the sole plate 336 between a midfoot region and a heel region of the wearer that allows the wearer to accelerate faster and create a toe-off movement where the forefoot region of the wearer propels the wearer forward.

The midsole member 332 may be positioned adjacent and on top of the outsole 330 in the heel region 312 and partially in the midfoot region 310 and forefoot region 308. The midsole member 332 may define a cutout portion 338. The midsole member 332 can be constructed from a PU plastic, such as a thermoplastic polyurethane (TPU) material, for example. The midsole member 332 may be constructed from a thermoplastic elastomer material such as a polyether block amide (PEBA). One example of a PEBA material is PEBAX® foam. In some embodiments, the midsole member 332 can be constructed from an EVA-Solid-Sponge ("ESS") material, an EVA foam (e.g., PUMA® ProFoam Lite™, IGNITE Foam), polyurethane, polyether, an olefin block copolymer, a thermoplastic material (e.g., a thermoplastic polyurethane, a thermoplastic elastomer, a thermoplastic polyolefin, etc.), or a supercritical foam. The midsole member 332 may be a single polymeric material or may be a blend of materials, such as an EVA copolymer, a thermoplastic polyurethane, a PEBA copolymer, and/or an olefin block copolymer.

Figures 6D, 6E:
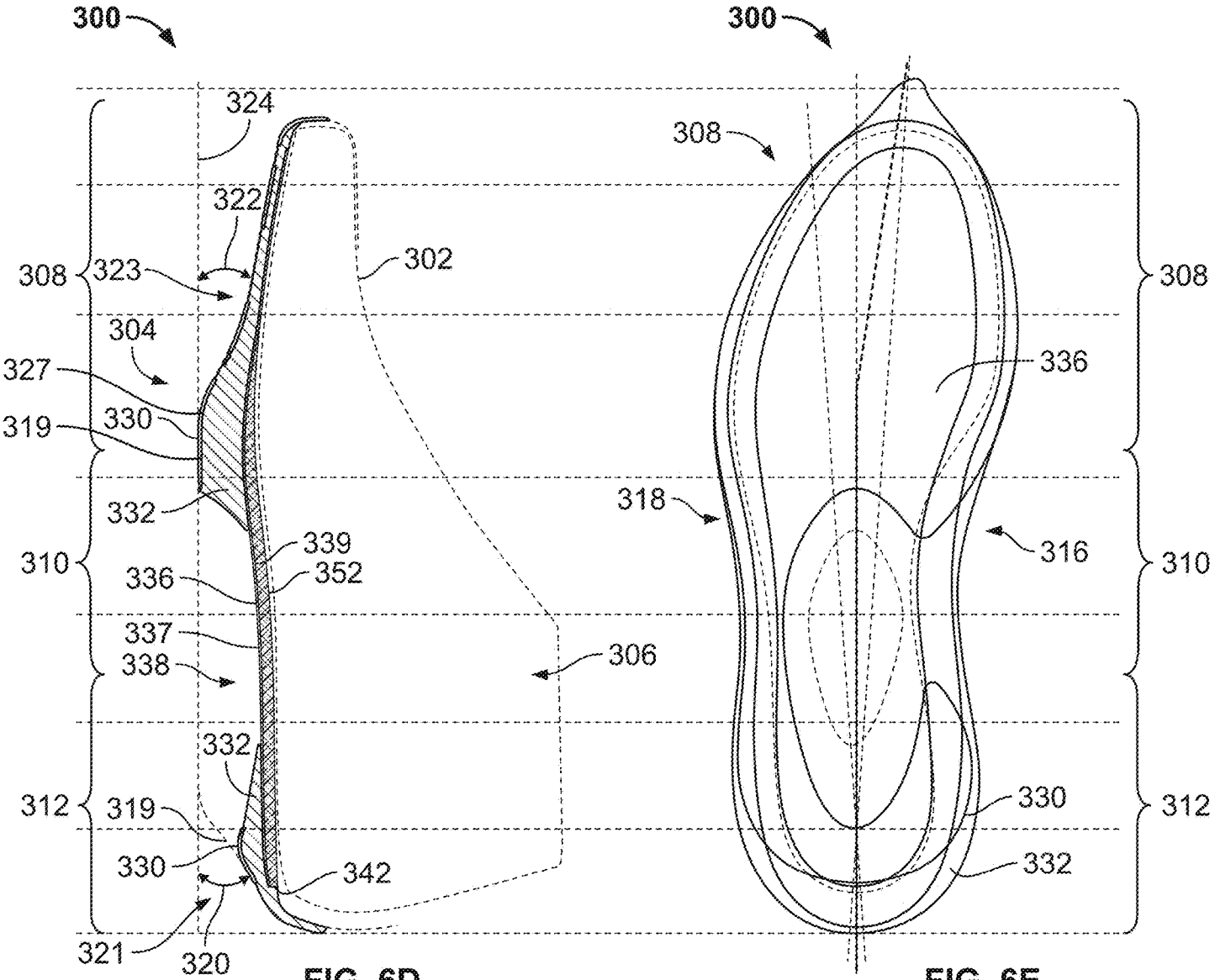
FIG. 6D is a cross-sectional view of the sole structure of FIG. 6A taken along line 6D-6D of FIG. 6B.
FIG. 6E is a top view of the sole structure of FIG. 6A.

The sole structure further includes the sole plate 336 disposed between the midsole member 332 and the upper 302. More specifically, the sole plate 336 is disposed between the midsole member 332 and the cushion layer 352 so that a first side 337 of the sole plate 336 contacts the midsole member 332 (e.g., to be directly coupled to the midsole member 332) and a second side 339 of the sole plate 336 contacts the cushion layer 352 (e.g., to be directly coupled to the cushion layer 352). In addition, the second side 339 of the sole plate 336 contacts the upper 302 (e.g., to be directly coupled to the upper 302). The first side 337 of the sole plate 336 is opposite the second side 339 of the sole plate 336. In the illustrated example, the first side 337 of the sole plate 336 faces the ground-engaging surface and the second side 339 of the sole plate 336 faces the upper 302. As shown in FIGS. 6D and 6E, the sole plate 336 extends through the midfoot region 310 and is exposed at the cutout portion 338 within an arched section 340 illustrated in FIG. 6B. Further illustrated in FIG. 6B, the outsole 330 partially surrounds the arched section 340 and the midsole member 332 partially surrounds and partially comprises the arched section 340.

In some embodiments, the ground-engaging surface is not continuous along the medial side 316 of the midfoot region 310 of the article of footwear. Correspondingly, the outsole 330 may comprise multiple outsole portions that are spaced apart from one another, such that the ground engaging surface is not continuous between the outsole portions. For example, as illustrated in FIG. 6B, the outsole 330 includes a first outsole portion 330*a* positioned in the forefoot region 308 and generally forward of the widest portion 307 (e.g., to extend into the exit region 323). Additionally, the outsole 330 includes a second outsole portion 330*b* extending from the widest portion 307, along the lateral side 318 of the midfoot region 410, and around a periphery of the heel region 312 to the medial side 316 (e.g., to extend into the entry region 321).

In some embodiments, for example, as illustrated in FIGS. 6B, and 6I-6M, the first midsole member 332 can define a longitudinal channel 333 that extends from the heel region 312 and into the midfoot region 310.

Illustrated in FIG. 6E, the sole plate 336 extends between the heel region 312 and the forefoot region 308. Illustrated in FIGS. 6F through 6K, the sole plate 336 has a uniform thickness throughout of approximately 0.8 millimeters. Generally, the sole plate 336 has a shape that is similar to but proportionally smaller than the midsole member 332 throughout the forefoot, midfoot, and heel regions 308, 310, 312 (shown in FIG. 6E). In some embodiments, the sole plate 336 comprises carbon fiber, for example. In other embodiments, the sole plate 336 can include a PU plastic, such as a thermoplastic polyurethane (TPU) material, for example. Other thermoplastic elastomers and fiber reinforced thermoplastics consisting of block copolymers are also possible. However, these and other rigid, semi-rigid, or spring-like materials and combinations thereof may comprise the sole plate 336. In some embodiments, the sole plate 336 can be configured as a shock plate to impart impact protection and facilitate leg muscle tension thereby relieving stress on a heel, ankle, shin, knees, hips, and/or back of a user.

The sole plate 336 can have varied stiffness along the length of the sole plate 336. For example, the stiffness in the forefoot region 308 of the sole plate 336 may be more or less flexible than the midfoot region 310 of the sole plate 336, which may be more or less flexible than the heel region 312 of the sole plate 336. Alternatively, the sole plate 336 can include a uniform stiffness. Additionally, the sole plate 336 may include additional or alternative geometries, such as, for example, notches, curves, protrusions, voids, angled edges, cutouts, etc. The sole plate 336 further defines an outer periphery that would fit into a peripheral envelope of a pocket formed in the sole structure 304 (e.g., a midsole member thereof).

Figure 6G:
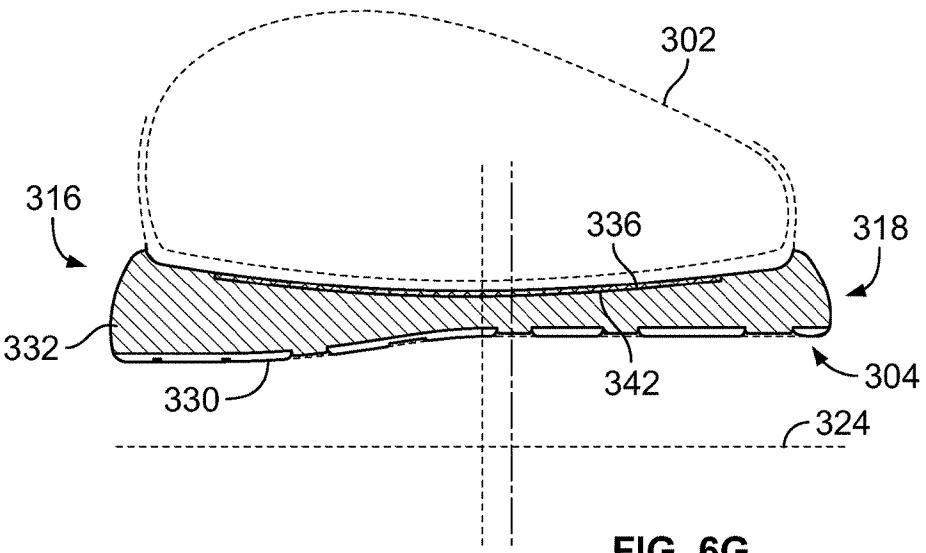
FIG. 6G is a cross-sectional view of the sole structure of FIG. 6A taken along the line 6G-6G of FIG. 6B.
Figure 6F:
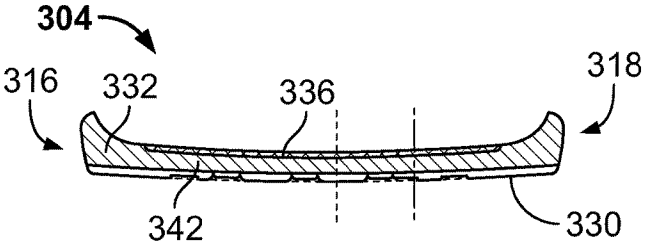
FIG. 6F is a cross-sectional view of the sole structure of FIG. 6A taken along line 6F-6F of FIG. 6B.
Figure 6I:
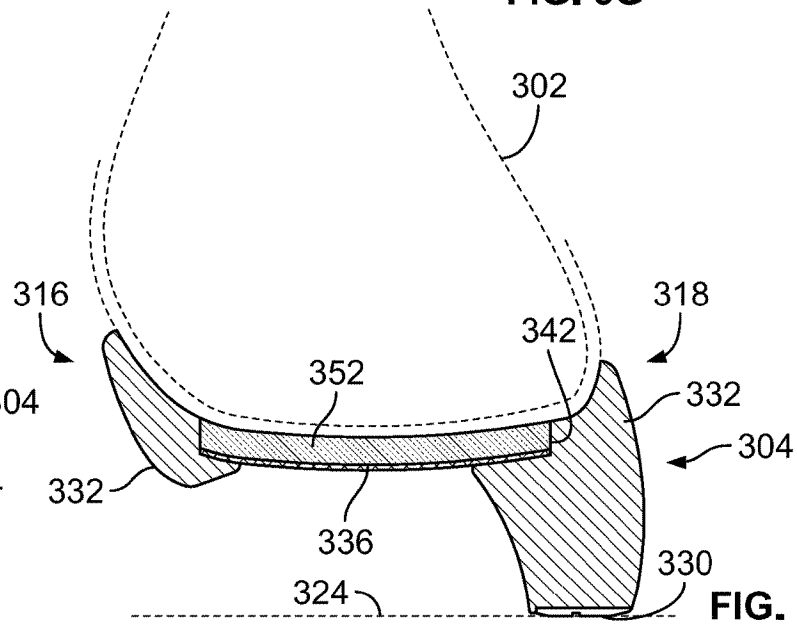
FIG. 6I is a cross sectional view of the sole structure of FIG. 6A taken along the line 6I-6I of FIG. 6B.
Figure 6H:
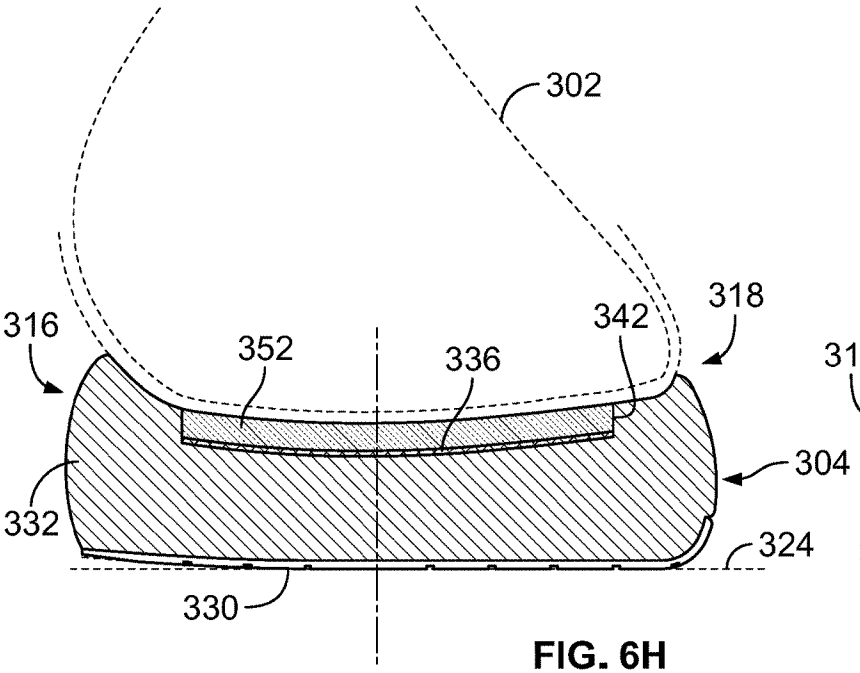
FIG. 6H is a cross-sectional view of the sole structure of FIG. 6A taken along the line 6H-6H of FIG. 6B.
Figure 6K:
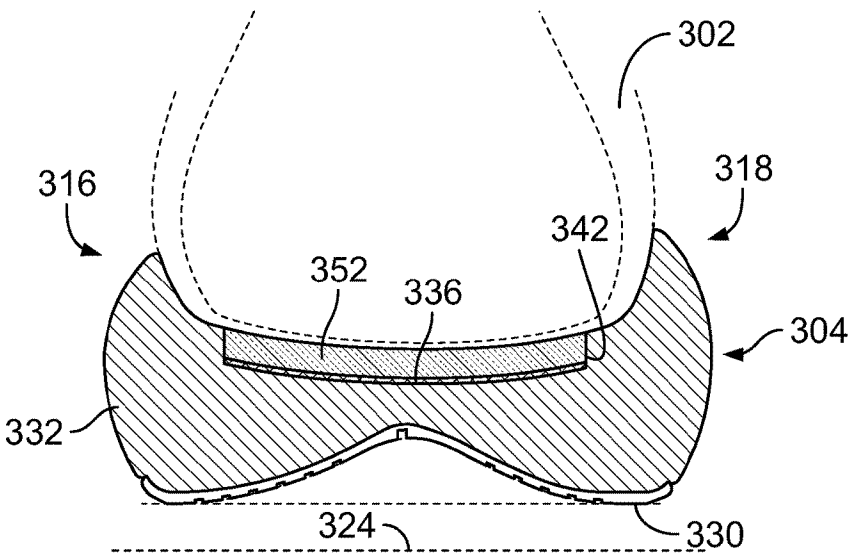
FIG. 6K is a cross-sectional view of the sole structure of FIG. 6A taken along the line 6K-6K of FIG. 6B.
Figure 6M:
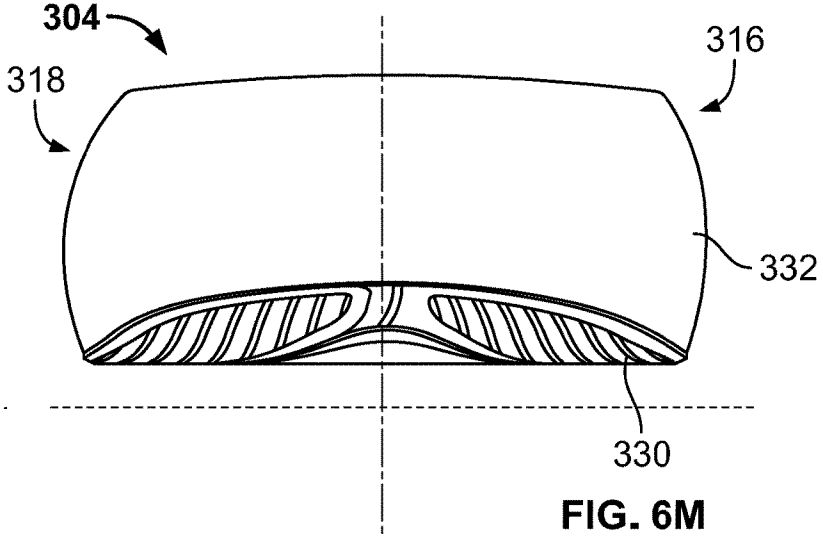
FIG. 6M is a heel view of the sole structure of FIG. 6A.
Figure 6J:
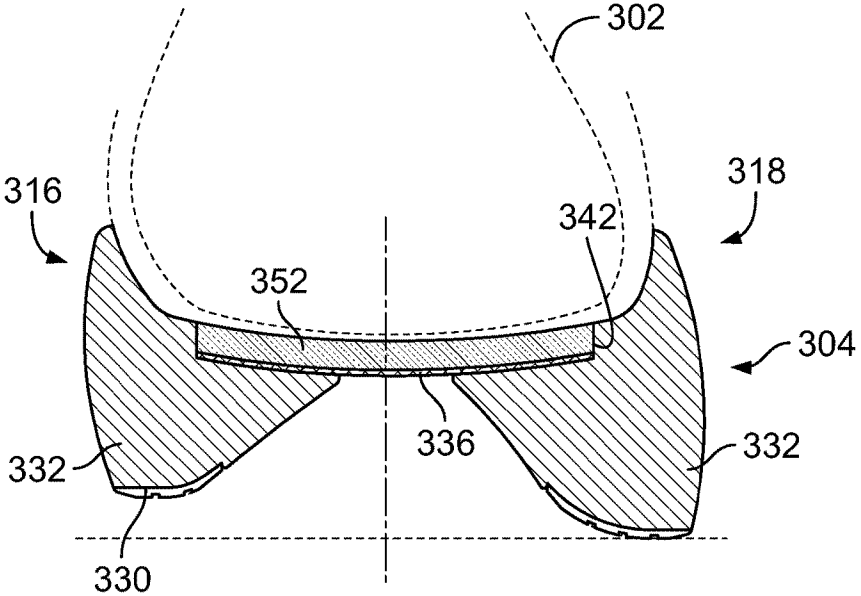
FIG. 6J is a cross-sectional view of the sole structure of FIG. 6A taken along the line 6J-6J of FIG. 6B.

The cushion layer 352 extends between the heel region 312 and the midfoot region 310 as illustrated in FIG. 6J and is positioned on top at least a portion of the sole plate 336 and between the sole plate 336 and the upper 302. The cushion layer 352 is configured as a thin foam layer having a thickness of approximately 4 millimeters in the heel region 312 and a portion of the midfoot region 310. In some embodiments, the cushion layer 352 can be constructed from a thermoplastic elastomer material such as a polyether block amide (PEBA). One example of a PEBA material is PEBAX® foam. In a portion of the midfoot region 310 the cushion layer 352 tapers to a thickness of zero so that there is little to no cushion layer 352 present in the forefoot region 308. However, in some embodiments, the cushion layer 352 can extend at least partially into the forefoot region 308.

Continuing, FIGS. 6F and 6G show cross-sectional views of the forefoot region 308 of the article of footwear 300 along lines 6F-6F and 6G-6G in FIG. 6B. In both FIGS. 6F and 6G the sole plate 336 is shown positioned within a pocket 342 and exposed along the top of the midsole member 332 and in contact with the upper 302 (e.g., in the forefoot region 208). The sole plate 336 also extends between the medial side 316 and the lateral side 318. The cushion layer 352 is also positioned within the pocket 342.

FIGS. 6H and 6I illustrate cross-sectional views of the midfoot region 310 along lines 6H-6H and 6I-6I of FIG. 6B. In FIG. 6H, the sole plate 336 is shown positioned within the pocket 342 in the top of the midsole member 332. The cushion layer 352 is also positioned within the pocket 342 of the midsole member 332 and on top of the sole plate 336 (e.g., so that the sole plate 336 is embedded in the sole structure 304, with the cushion layer 352 positioned generally above the midsole member 332). Accordingly, the sole plate 336 is positioned between the midsole member 332 and the cushion layer 352. Put another way, the cushion layer 352 is positioned generally above the midsole member 352 and the sole plate 336 so that the cushion layer 352 is between the upper 302 and each of the midsole member 352 and the sole plate 336. Further, the midsole member 332 extends from the medial side 316 to the lateral side 318 and the outsole 330 extends across the bottom of the midsole member 332. Looking at FIGS. 6A, 6C, and 6D, and as mentioned above, this portion of the sole structure 304 is located underneath the ball of a user's foot (shown in FIG. 4) and creates a rocking member (i.e., a rocking region) with a fulcrum proximate to the metatarsal bones of the user. The position of the sole plate 336 in relationship to the midsole member 332 effectively adjusts the running posture of the user to be a forward tilt and moves the running motion of the user toward their forefoot.

In FIG. 6G, the sole plate 336 is also shown positioned within the pocket 342 of the midsole member 332 and exposed through the cutout portion 338. The cushion layer 352 is also positioned within the pocket 342 and on top of the sole plate 336. Along the medial side 316, the midsole member 332 is spaced from the ground surface 324 and is configured to be capable of engaging an elevated ground surface or other external surface at the midfoot region 310.

Further, FIGS. 6J and 6K show cross-sectional views of the heel region 312 along lines 6J-6J and 6K-6K of FIG. 6B. In FIG. 6J, the sole plate 336 is shown positioned within the pocket 342 of the midsole member 332 and exposed through the cutout portion 338. The pocket 342 and the sole plate 336 are correspondingly shaped such that a peripheral envelope of the pocket 342 bounds and can be in contact with an outer periphery of the sole plate 336. As such, the pocket 342 can be shaped to receive the sole plate 336, and the sole plate 336 can be shaped to be received within the pocket 336. Additionally, the cushion layer 352 is also positioned within the pocket 342 and on top of the sole plate 336. Accordingly, the sole plate 336 can be contained in the pocket 342 by the cushion layer 352. Further, the midsole member 332 on the medial side 316 is spaced from the ground surface, but less spaced than in the part of the midfoot region 310 shown in FIG. 6I. In FIG. 6K, the sole plate 336 is shown positioned within the pocket 342 of the midsole member 332. Additionally, the cushion layer 352 is also positioned within the pocket 342 and on top of the sole plate 336. Further, the midsole member 332 extends continuously from the medial side 316 to the lateral side 318.

Figure 6L:
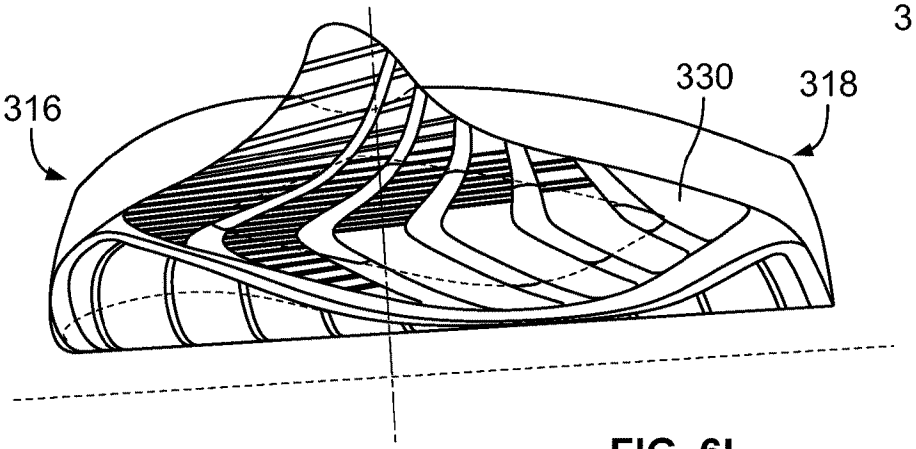
FIG. 6L is a toe view of the sole structure of FIG. 6A.

FIGS. 6L and 6G illustrate a toe view and a heel view, respectively, of the article of footwear 300. The outsole 330 extends up and around the midsole member 332 and at least a portion of the upper 302 in the front of the forefoot region 308 (shown in FIGS. 6A, 6C and 6D).

Figures 7A, 7B, 7C:
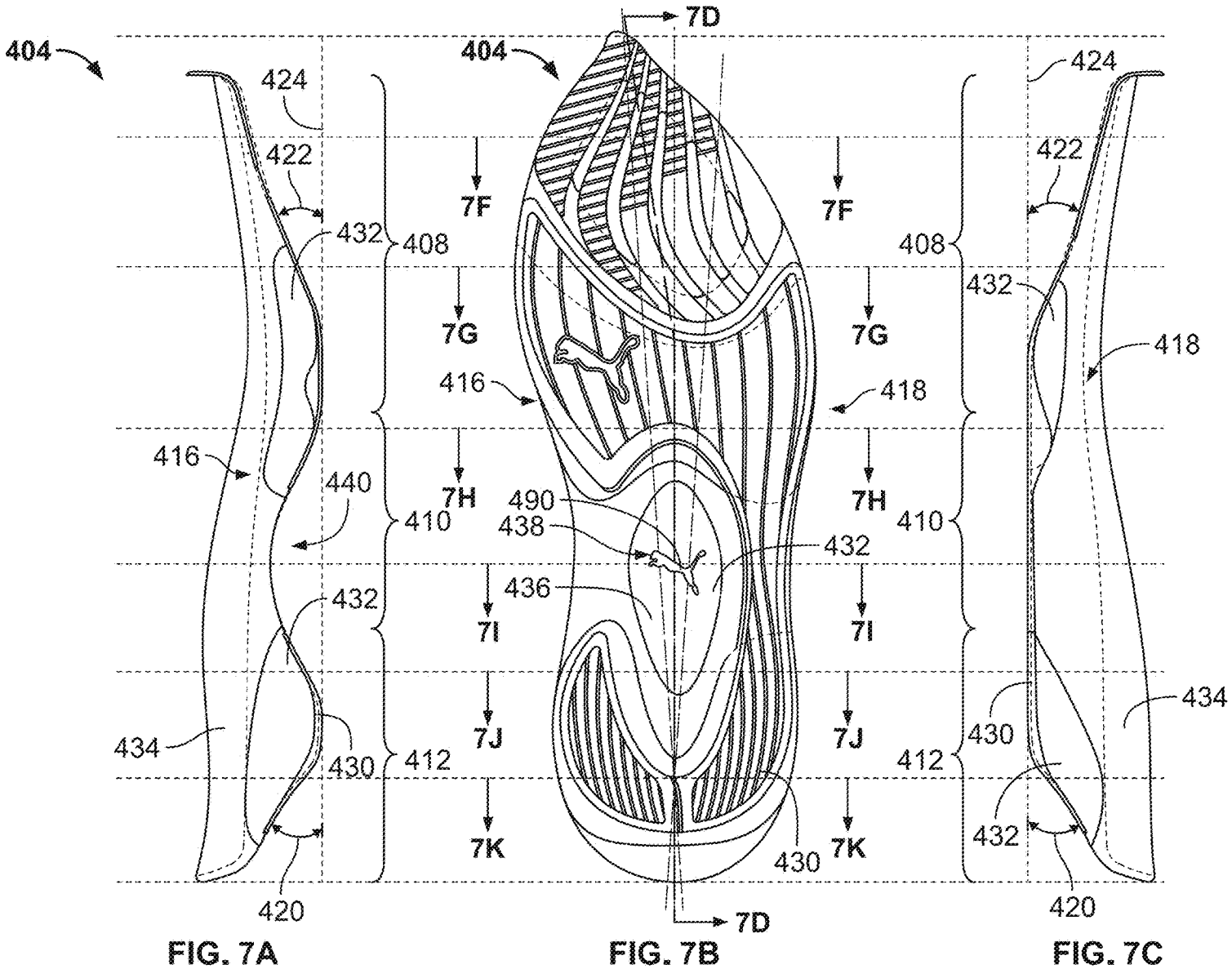
FIG. 7A is a medial side view of a sole structure of an article of footwear that includes a sole plate according to an embodiment of the disclosure.
FIG. 7B is a bottom view of the sole structure of FIG. 7A.
FIG. 7C is a lateral side view of the sole structure of FIG. 7A.
Figures 7D, 7E:
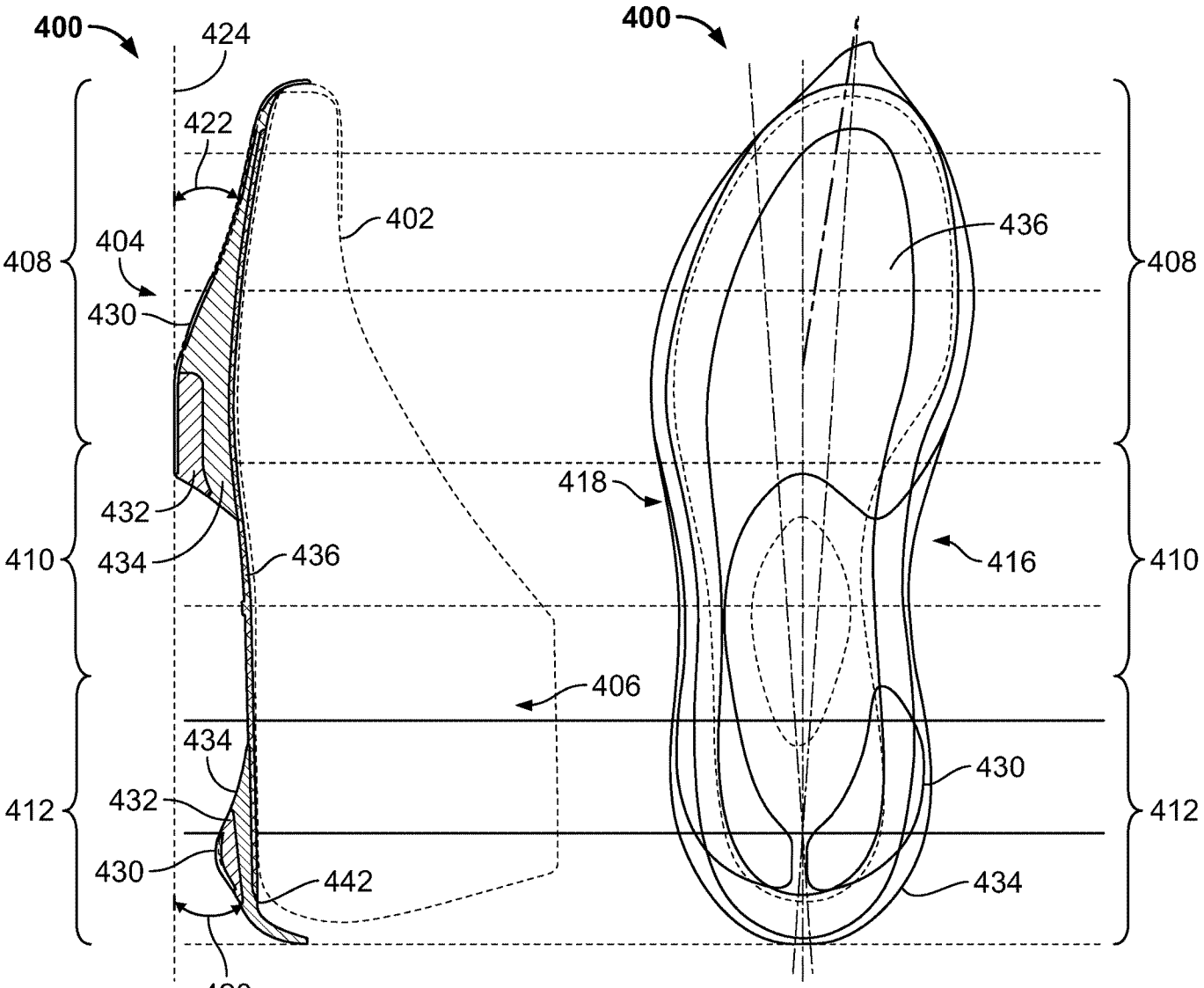
FIG. 7D is a cross-sectional view of the sole structure of FIG. 7A taken along line 7D-7D of FIG. 7B.
FIG. 7E is a top view of the sole structure of FIG. 7A.
Figure 7G:
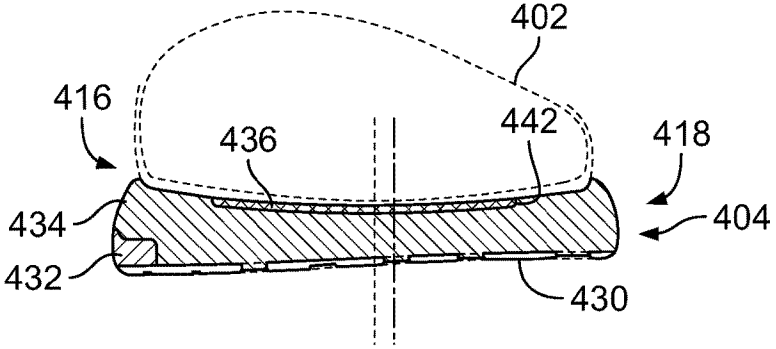
FIG. 7G is a cross-sectional view of the sole structure of FIG. 7A taken along the line 7G-7G of FIG. 7B.
Figure 7F:
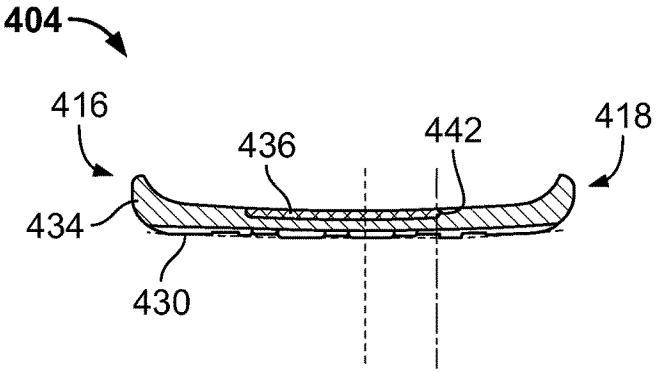
FIG. 7F is a cross-sectional view of the sole structure of FIG. 7A taken along line 7F-7F of FIG. 7B.
Figure 7I:
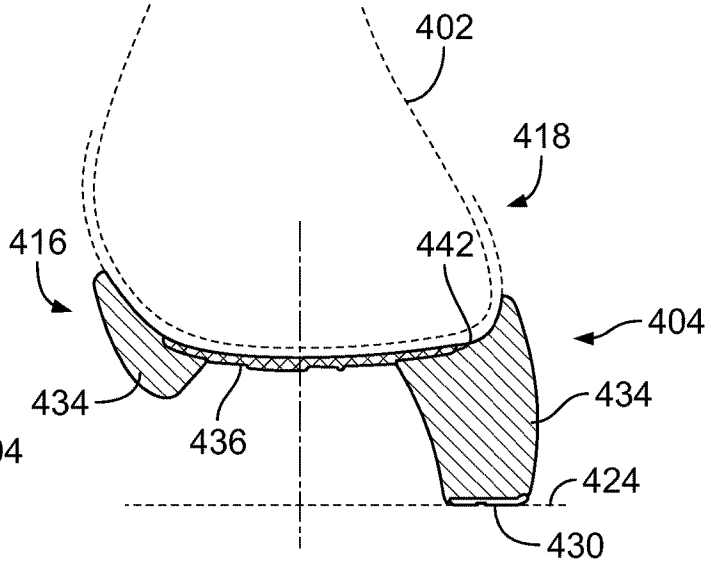
FIG. 7I is a cross sectional view of the sole structure of FIG. 7A taken along the line 7I-7I of FIG. 7B.
Figure 7H:
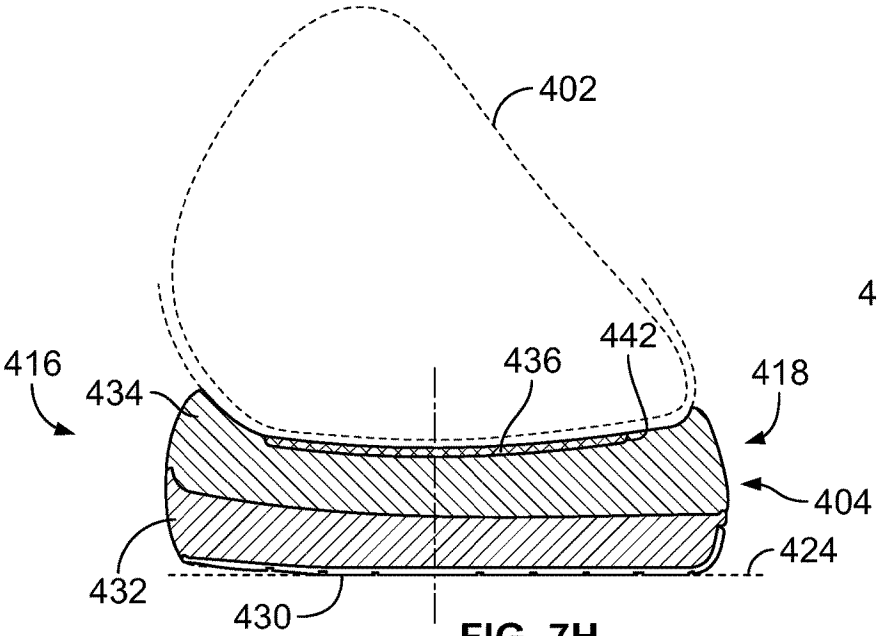
FIG. 7H is a cross-sectional view of the sole structure of FIG. 7A taken along the line 7H-7H of FIG. 7B.
Figure 7K:
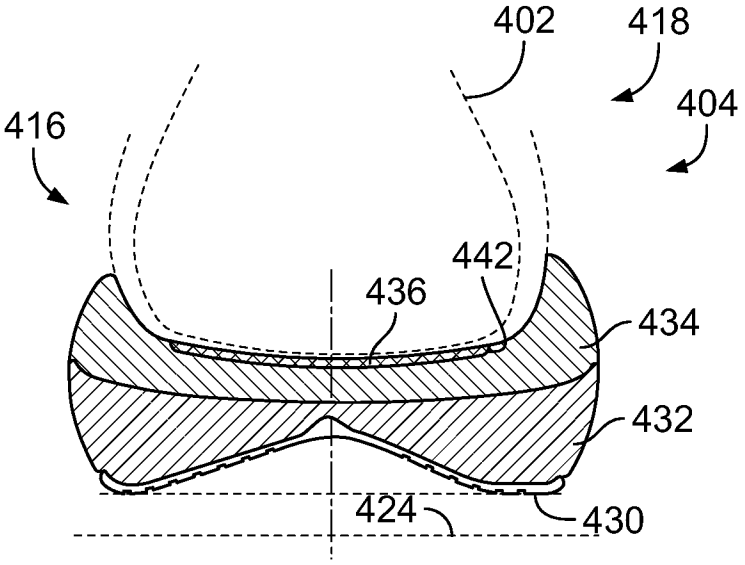
FIG. 7K is a cross-sectional view of the sole structure of FIG. 7A taken along the line 7K-7K of FIG. 7B.
Figure 7M:
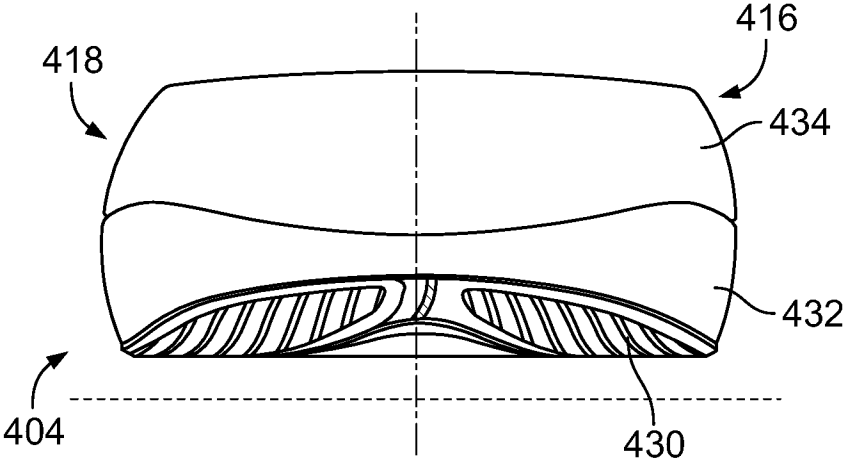
FIG. 7M is a heel view of the sole structure of FIG. 7A.
Figure 7J:
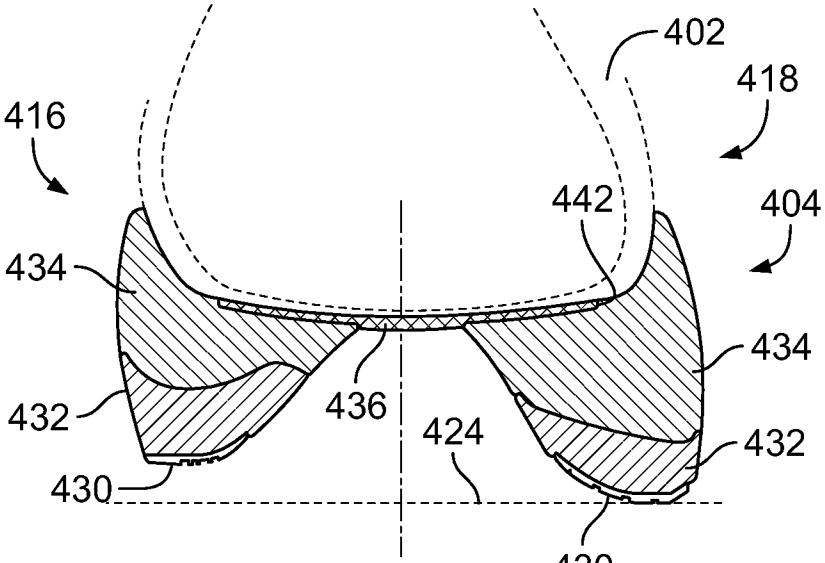
FIG. 7J is a cross-sectional view of the sole structure of FIG. 7A taken along the line 7J-7J of FIG. 7B.
Figure 7L:
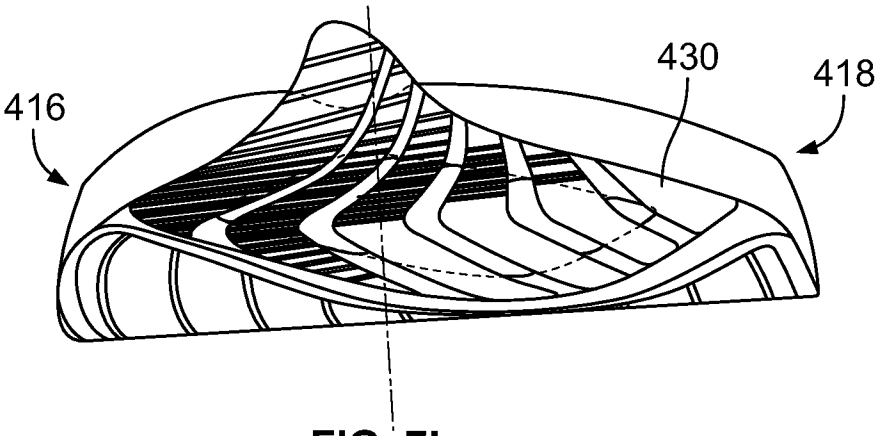
FIG. 7L is a toe view of the sole structure of FIG. 7A.

FIGS. 7A through 7M illustrate another embodiment of an article of footwear 400 according to the invention. In many aspects, the article of footwear 400 is similar to the article of footwear 200 described above and similar numbering in the 400 series is used for the article of footwear 400. For example, the article of footwear 400 has an upper 402, a sole structure 404, an interior cavity 406 defined by the combination of the upper 402 and the sole structure 404, a forefoot region 408, a midfoot region 410, a heel region 412, a medial side 416, and a lateral side 418. Further, the sole structure 404 has an outsole 430, a first midsole member 432 (e.g., a first cushion layer), a second midsole member 434 (e.g., a second cushion layer) with a pocket 442, a sole plate 436, an arched section 440, and a cutout portion 438. The first midsole member 432, the second midsole member 434, and the sole plate 436 can form a cushioning system of the sole structure 404 (e.g., a midsole of the sole structure 404). Additionally, the sole structure 404 is shaped to define an entry angle 420 in the heel region 412 and an exit angle 422 in the forefoot region 408 with respect to a flat ground surface 424. Similarly, in some embodiments, the entry angle 420 can be about 30 degrees and the sole structure 404 can start angling away from the ground surface 424 approximate the area underneath the heel of a user's foot (shown in FIG. 4). Further, in some embodiments, the exit angle 422 can be about 15 degrees and can start angling away from the ground surface 424 approximate the area underneath the balls of a user's foot (shown in FIG. 4). As illustrated in FIG. 7B, the sole plate 436 comprises an insignia 490 that is visible through the cutout portion 438.

Additionally, the first midsole member 432, the second midsole member 434, and the sole plate 436 can be similarly constructed as the first midsole member 232, the second midsole member 234, and the sole plate 236. For example, the first and second midsole members 432, 434 can be formed from a PU plastic, such as a thermoplastic polyurethane (TPU) material, ethylene-vinyl acetate (EVA) polymer, copolymers thereof, or a similar type of material and the sole plate 436 can be formed from a PU plastic, such as a thermoplastic polyurethane (TPU) material, thermoplastic elastomers and fiber reinforced thermoplastics consisting of block copolymers, carbon fiber, or other rigid, semi-rigid, or spring-like materials and combinations thereof.

In some aspects, however, the articles of footwear 200, 400 differ from each other. For example, the sole plate 436 has a shape that is similar to but proportionally smaller than the midsole member 432 throughout the forefoot, midfoot, and heel regions 408, 410, 412 (shown in FIG. 7E).

Additionally, as shown in FIG. 7D and FIGS. 7G, 7I, and 7J, which are cross-sectional views taken along lines 7G-7G, 7I-7I, and 7J-7J in FIG. 7B within the forefoot region 408, the midfoot region 410, and the heel region 412, respectively, the first midsole member 432 and the second midsole member 434 are positioned differently within the sole structure 404 than the first midsole member 232 and the second midsole member 234 in the sole structure 204. For example, the second midsole member 434 extends around the front of the first midsole member 432 in the forefoot region 408 (shown in FIG. 7D).

FIGS. 8A through 8M illustrate another embodiment of an article of footwear 500 according to the invention. In many aspects, the article of footwear 500 is similar to the article of footwear 300 described above and similar numbering in the 500 series is used for the article of footwear 500. For example, the article of footwear 500 has an upper 502, a sole structure 504, an interior cavity 506 defined by the combination of the upper 502 and the sole structure 504, a forefoot region 508, a midfoot region 510, a heel region 512, a medial side 516, and a lateral side 518. Further, the sole structure 504 has an outsole 530, a midsole member 532 (i.e., a first midsole member or cushion layer of a midsole) with a pocket 542, a sole plate 536, a cushion layer 552 (i.e., a second midsole member or cushion layer of a midsole), an arched section 540, and a cutout portion 538. The sole plate 536 is disposed between the midsole member 532 and the cushion layer 552 and the cushion layer 552 is positioned between the upper 502 and each of the midsole member 532 and the sole plate 536. Both the sole plate 536 and the cushion layer 532 are disposed within the pocket 542 in the midsole member 532. More specifically, the cushion layer 532 is positioned on top of the sole plate 536 (e.g., to secure the sole plate 536 in the pocket 542), such that the sole plate 536 is disposed within the pocket 542 between the midsole member 532 and the cushion layer 552 so that a first side 537 of the sole plate 536 contacts the midsole member 532 (e.g., to be directly coupled to the midsole member 532) and a second side 539 of the sole plate 536 contacts the cushion layer 552 (e.g., to be directly coupled to the cushion layer 552). The first side 537 of the sole plate 536 is opposite the second side 539 of the sole plate 536. In the illustrated example, the first side 537 of the sole plate 536 faces the ground-engaging surface and the second side 539 of the sole plate 536 faces the upper 502. The sole plate 536 extends at least partially through the midfoot region 510 and is exposed at the cutout portion 538 of the midsole member 532. The midsole member 532, the cushion layer 552, and the sole plate 536 can form a cushioning system of the sole structure 504 (e.g., a midsole of the sole structure 504). Additionally, the sole structure 504 is shaped to define an entry angle 520 in the heel region 512 and an exit angle 522 in the forefoot region 508 with respect to a flat ground surface 524. Similarly, in some embodiments, the entry angle 520 can be about 30 degrees and the sole structure 504 can start angling away from the ground surface 524 approximate the area underneath the heel of a user's foot (shown in FIG. 4). Further, in some embodiments, the exit angle 522 can be about 15 degrees and can start angling away from the ground surface 524 approximate the area underneath the balls of a user's foot (shown in FIG. 4).

Figures 8A, 8B, 8C:
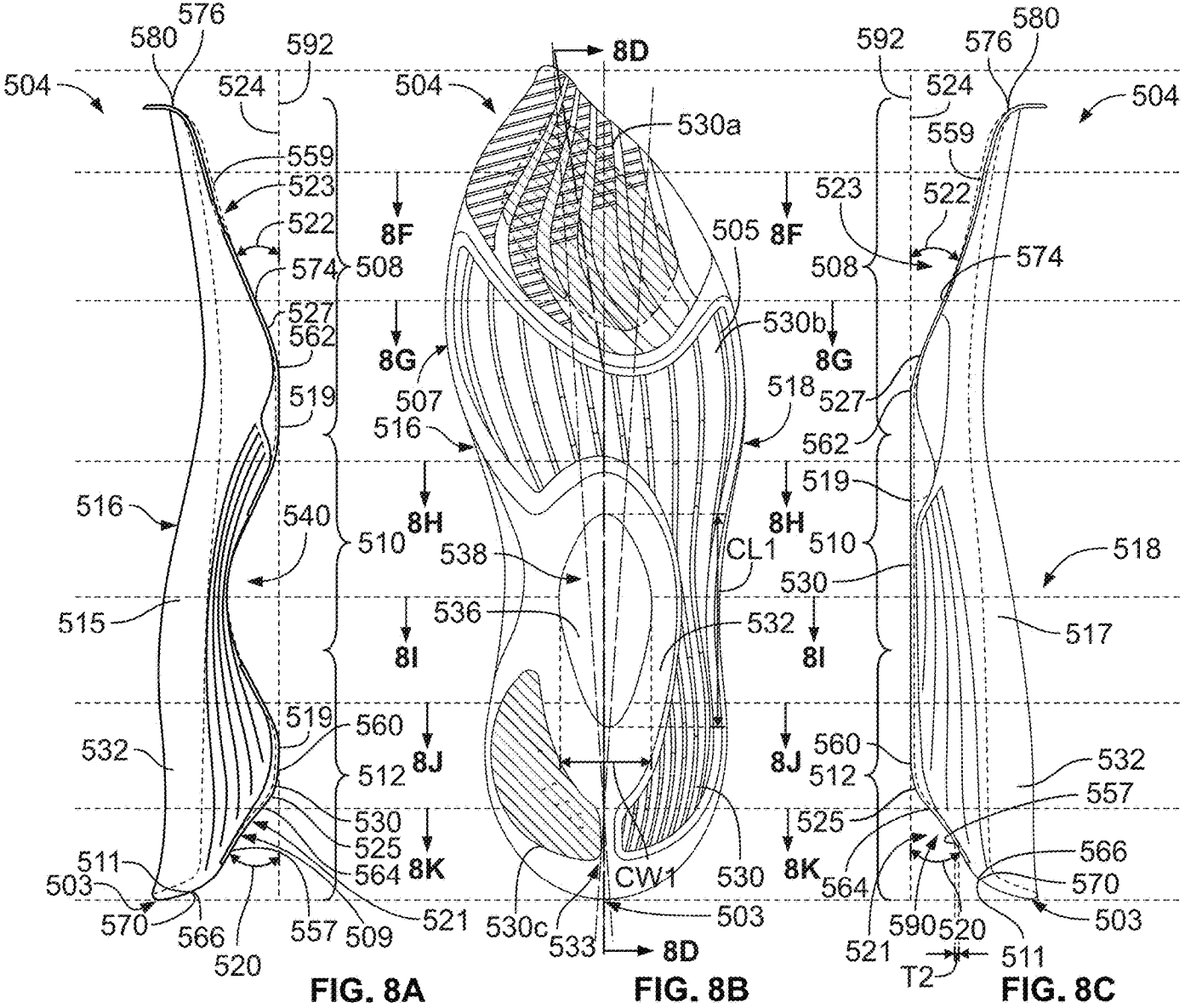
FIG. 8A is a medial side view of a sole structure of an article of footwear that includes a sole plate and a foam layer according to an embodiment of the disclosure.
FIG. 8B is a bottom view of the sole structure of FIG. 8A.
FIG. 8C is a lateral side view of the sole structure of FIG. 8A.
Figures 8D, 8E:
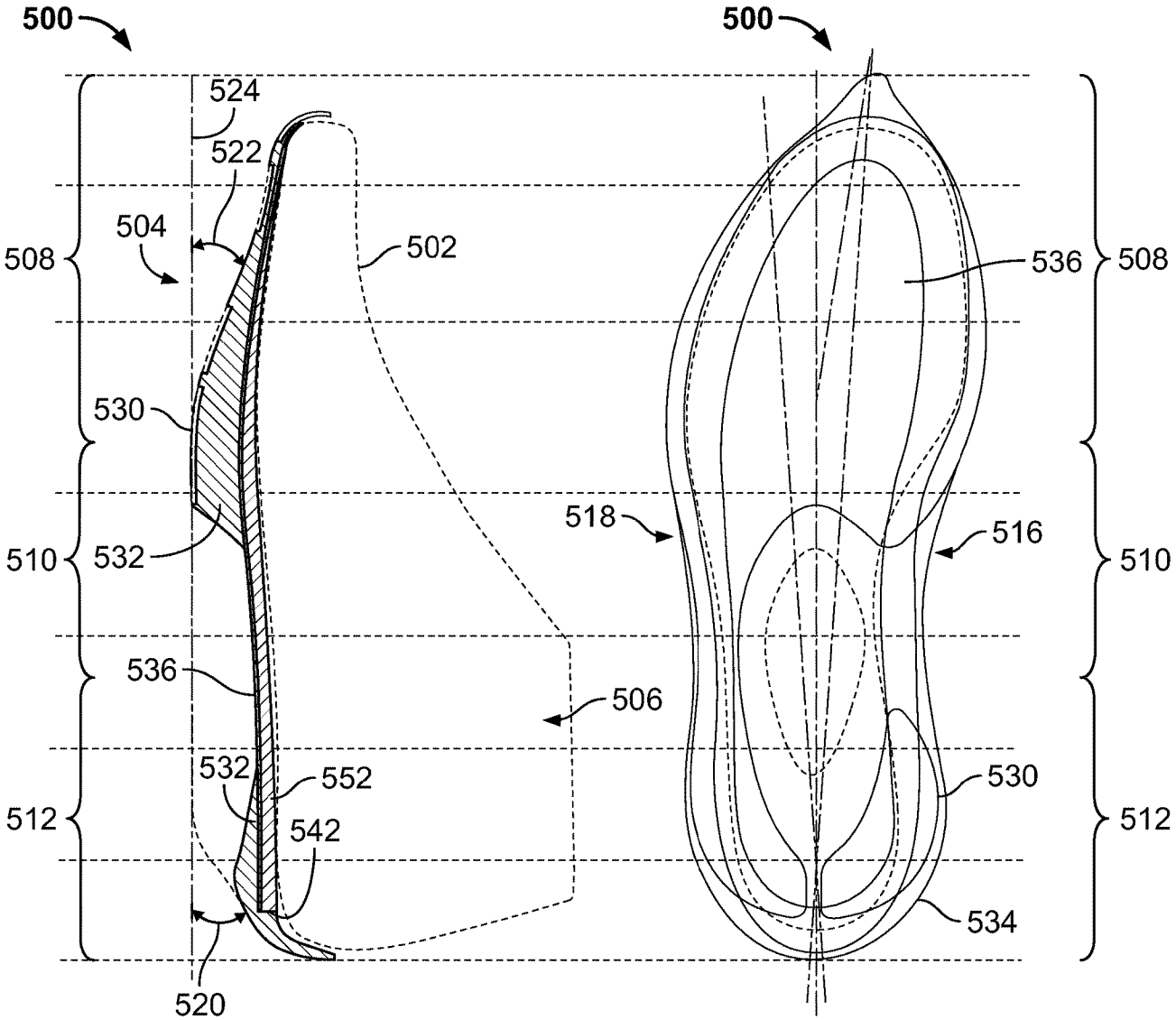
FIG. 8D is a cross-sectional view of the sole structure of FIG. 8A taken along line 8D-8D of FIG. 8B.
FIG. 8E is a top view of the sole structure of FIG. 8A.

Accordingly, when in a rested state as shown in FIGS. 8A-8M, the sole structure 504 is shaped to define an entry angle 520 in the heel region 512 and an exit angle 522 in the forefoot region 508 with respect to a flat ground surface 524. The sole structure 504 can also define a substantially flat region 519 that is approximately parallel with the flat ground surface 524. The substantially flat region 519 can extend from a first end 560 to a second end 562. As illustrated in FIGS. 8A, 8C, and 8D, the first end 560 can be in the heel region 512 and the second end 562 can be in the forefoot region 508.

Correspondingly, the sole structure 504 can define an entry region 521 in which a bottom surface 505 (e.g., a ground engaging surface) of the sole structure 504 curves upwardly to start angling away from the ground surface 524 approximate the area underneath the heel of a user's foot (shown in FIG. 4) by at least the entry angle 520. In that regard, the entry region 521 can include an angled portion 557 (e.g., an angled region). The angled portion 557 extends from a first end 564 to a second end 566. The first end 564 is positioned proximate the substantially flat region 519 such that the first end 564 is positioned below a heel end 568 of the sole plate 536 and such that the first end 564 is closer to the forefoot region 508 than is the heel end 568 of the sole plate 536. The second end 566 is positioned above the heel end 568 of the sole plate 536 and the second end 566 is positioned farther from the forefoot region 508 than is the heel end 568 of the sole plate 536. Accordingly, the heel end 568 of the sole plate 536 is positioned between the first end 564 of angled portion 557 and the second end 566 of the angled portion 557 relative to a vertical direction, and the heel end 568 of the sole plate 536 is positioned between the first end 564 of angled portion 557 and the second end 566 of the angled portion 557 relative to a longitudinal direction (e.g., a heel-to-toe direction). As such, the first end 564 of the angled portion 557 is configured to be located at an area underneath an approximate location of a heel of a user's foot, second end 566 of the angled portion 557 is configured to be positioned above or behind a heel of a user's foot. The angled portion 557 is substantially flat between the first end 564 and the second end 566. For example, between the first end 564 and the second end 566, the angled portion 557, and thus the entry region 521, can be at about the entry angle 520 to enhance contact with a user's heel during a heel strike. In that regard, the angled portion 557 forms a portion of the bottom surface 505 of the sole structure 504 that is configured to engage the ground during a heel strike. In some cases, the second end 566 of the angled portion 557, and thus the entry region 521, defines a heel end 570 of the bottom surface 505. Accordingly, the ground-engaging bottom surface 505 extends above the heel end 568 of the sole plate 536.

Relatedly, referring to FIG. 8D, the pocket 542 defines a base surface 543. The sole plate 526 is received in the pocket 542 so that the first side 537 of the sole plate 536 contacts the base surface 543 and the second side 539 of the sole plate 536 contacts a first side 551 (e.g., a lower surface) of the cushion layer 552. The cushion layer 552 includes a second side 555 (e.g., an upper surface) that is opposite the first side 551 and is coupled to the upper 502. Within the heel region 512, a portion of the base surface 543 is positioned so that the first end 564 of the angled portion 557 is below the base surface 543 and the second end 566 of the angled portion 557 is above the base surface 543 (e.g., the base surface 543 is between the first end 564 and the second end 566 of the angled portion 557). More specifically, within the heel region 512, the base surface 543 is entirely between the first end 564 and the second end 564 of the angled portion 557.

Still referring to FIG. 8D, the midsole member 532 includes a heel end 535 and the cushion layer 552 includes a heel end 553. The heel end 553 of the cushion layer 552 is closer to the forefoot region 508 than is the heel end 535 of the midsole member 532. Additionally, the heel end 535 of the midsole member 532 extends above the heel end 553 of the cushion layer 552. Correspondingly, at the heel end 553 of the cushion layer 552, the second surface 555 of the cushion layer 552 is above the second end 566 of the angled portion 557 (e.g. so that a heel-most end of the second surface 555 is above the second end 566 of the angled portion). Additionally, the heel-most end of the second surface 555 (e.g., at the heel end 553 of the cushion layer 552) is below a portion of the midsole member 532 that is coupled to the upper 502 (e.g., a heel-most end of the midsole member 532. Put another way, the midsole member 532 extends above the second surface 555 of the cushion layer 552.

Referring again to the rested state as shown in FIGS. 8A-8M, the sole structure 504 can also define an exit region 523 in which the bottom surface 505 of the sole structure 504 curves upwardly to start angling away from the ground surface 524 approximate the area underneath the balls of a user's foot (shown in FIG. 4) by at least the exit angle 522. In that regard, the exit region 523 can include an angled portion 559 (e.g., an angled region). The angled portion 559 extends from a first end 574 to a second end 576. The first end 574 is positioned proximate the substantially flat region 519 such that the first end 574 is positioned below a toe end 578 of the sole plate 536 and such that the first end 574 is closer to the heel region 512 than is the toe end 578 of the sole plate 536. The angled portion 559 is substantially flat between the first end 574 and the second end 576. For example, between the first end 574 and the second end 576 the angled portion 559, and thus the exit region 523, can be at about the exit angle 522 to adjust the running posture of the user to be a forward tilt to move the running motion of the user toward their forefoot to propel the use forward. In that regard the angled portion 559 forms a portion of the bottom surface 505 of the sole structure 504 that is configured to engage the ground during toe-off. In some cases, the second end 576 of the angled portion 559, and thus the exit region 523, defines a toe end 580 of the bottom surface 505. In some cases, the sole plate 526 is arranged so that the toe end 578 of the sole plate 536 is positioned above the heel end 568 of the sole plate 536 when the substantially flat region 519 is in contact with the ground surface 524.

The entry and exit angles 520, 522 can be configured to enhance contact with a user's heel during a heel strike and promoting engagement of a large surface area of the outsole 530 in the forefoot region 508 during a push-off by the user. Accordingly, the entry region 521 can extend rearward from the substantially flat region 519 and the exit region 523 can extend forward from the substantially flat region 519. In some embodiments, the junction between the substantially flat region 519 and the exit region 523 can be located at a widest portion 507 of the sole structure 504 (e.g., at a greatest distance between the medial and lateral sides 516, 518), so as to be aligned proximate to the metatarsal bones of the user.

As illustrated in FIGS. 8C and 8D, the entry region 521 is configured to form a gap 590 between the midsole 532 and the flat ground surface 524. The flat ground surface 524 corresponds with a resting plane 592 upon which the article of footwear is configured to rest when set on the flat ground surface 524. In this case, the resting plane 592 is defined by the substantially flat region 519. The heel end 568 of the sole plate 536 is positioned over the gap 590. At the heel end 568 of the sole plate 536, the gap 590 has a thickness (T1) that is greater than a thickness (T2) of the outsole 530 (see FIG. 8C). As noted herein, the thickness (T1) of the gap 590 and the thickness (T2) of the outsole 530 are taken in a direction that is normal to the resting plane 592. As illustrated in FIG. 8B, the cutout portion 538 defines a cutout length (CL1) at a longest portion of the cutout portion 538. The cutout length (CL1) extends in a heel-toe direction and parallel with respect to the flat ground surface 524 when the sole structure 504 is resting on the flat ground surface 524. The cutout portion 538 also defines a cutout width (CW1) at a widest portion of the cutout portion 538. The cutout width (CW1) extends in a medial-lateral direction and parallel with respect to the flat ground surface 524 when the sole structure 504 is resting on the flat ground surface 524. The cutout length (CL1) is greater than the cutout width (CW1).

Due to the curved nature of each of the entry region 521 and the exit region 523, the respective junctions with the substantially flat region 519 can form rocking regions 525, 527 (e.g., rocking members). The rocking regions 525, 527 are formed as convex regions of the bottom surface 505 that can create a fulcrum for the sole plate 536. For example, the fulcrum created by the rocking region 525 can create a propulsion lever with the sole plate 536 between a midfoot region and a heel region of the wearer that allows the wearer to accelerate faster and create a toe-off movement where the forefoot region of the wearer propels the wearer forward. More specifically, the fulcrum created by the rocking region 525 can create a propulsion lever with the sole plate 536 between the entry region 521 and the substantially flat region 519. The rocking region 525 is an entirely convex region that extends between the first end 560 of the substantially flat region 519 and the first end 564 of the substantially flat angled portion 557. The entry region 521 includes the rocking region 525 and the angled portion 557, such that the entry region 521 curves upwardly from the substantially flat region 519 at the rocking region 525 to form the angled portion 557. In that regard, the rocking region 525 forms an upwardly curved portion (e.g., an upwardly curved entry region). The fulcrum created by the rocking region 527 can also act as a propulsion lever with the sole plate 536 proximate to the metatarsal bones of the user by adjusting the running posture of the user to be a forward tilt and moves the running motion of the user toward their forefoot. The fulcrum created by the rocking region 527 can create a propulsion lever with the sole plate 536 between the exit region 523 and the substantially flat region 519. The rocking region 527 is an entirely convex region that extends between the second end 562 of the substantially flat region 519 and the first end 574 of the substantially flat angled portion 559. The exit region 523 includes the rocking region 527 and the angled portion 559, such that the exit region 523 curves upwardly from the substantially flat region 519 at the rocking region 527 to form the angled portion 559. In that regard, the rocking region 527 forms an upwardly curved portion (e.g., an upwardly curved exit region).

Additionally, the midsole member 532, the sole plate 536, and the cushion layer 552 can be similarly constructed as the midsole member 332, the sole plate 336, and the cushion layer 352. For example, the midsole member 532 can be formed from a PU plastic, such as a thermoplastic polyurethane (TPU) material; the sole plate 536 can be formed from a PU plastic, such as a thermoplastic polyurethane (TPU) material, thermoplastic elastomers and fiber reinforced thermoplastics consisting of block copolymers, carbon fiber, or other rigid, semi-rigid, or spring-like materials and combinations thereof, and the cushion layer 552 can be formed from a thermoplastic elastomer material, for example, a polyether block amide (PEBA), including PEBAX® foam. In some embodiments, the cushion layer 552 can be constructed from an EVA-Solid-Sponge ("ESS") material, an EVA foam (e.g., PUMA® ProFoam Lite™, IGNITE Foam), polyurethane, polyether, an olefin block copolymer, a thermoplastic material (e.g., a thermoplastic polyurethane, a thermoplastic elastomer, a thermoplastic polyolefin, etc.), or a supercritical foam.

Another similarity is that the sole plate 536 has a shape that is similar to but proportionally smaller than the midsole member 532 throughout the forefoot, midfoot, and heel regions 508, 510, 512 (shown in FIG. 8E). Additionally, the pocket 542 and the sole plate 536 are correspondingly shaped such that a peripheral envelope of the pocket 542 bounds and can be in contact with an outer periphery of the sole plate 536. Put another way, the pocket 542 can be shaped to receive the sole plate 536, and the sole plate 536 can be shaped to be received in the pocket 542. Further, the cushion layer 552 can also be positioned within the pocket 542, such that the sole plate 536 can be secured in the pocket 542 by the cushion layer 552. Additionally, as shown in FIGS. 8F-8K, the peripheral envelope of the pocket 542 can be in contact with the cushion layer 552. In particular, the sole plate 536 can be secured between the midsole member 532 and the cushion layer 552, with the midsole member 532 in contact with a first side 537 of the sole plate 536 and the cushion layer 552 in contact with a second side 539 of the sole plate 536 that is opposite the first side. It is appreciated that the cushioning layer 552 can be coupled to the midsole member 532. Moreover, the position of the sole plate 536 in relation to the midsole member 532 and the cushion layer 552 can effectively adjust the running posture of the user to be a forward tilt and moves the running motion of the user toward their forefoot.

Figure 8G:
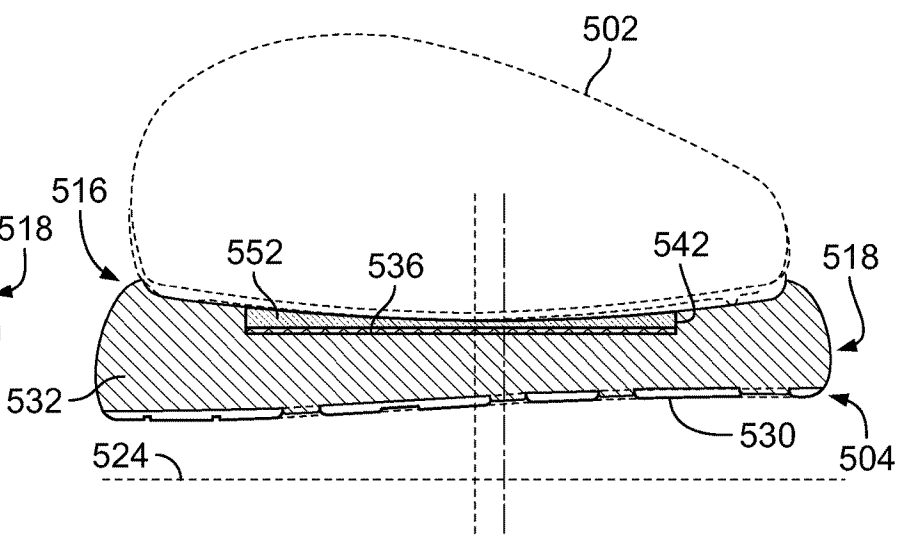
FIG. 8G is a cross-sectional view of the sole structure of FIG. 8A taken along the line 8G-8G of FIG. 8B.
Figure 8F:
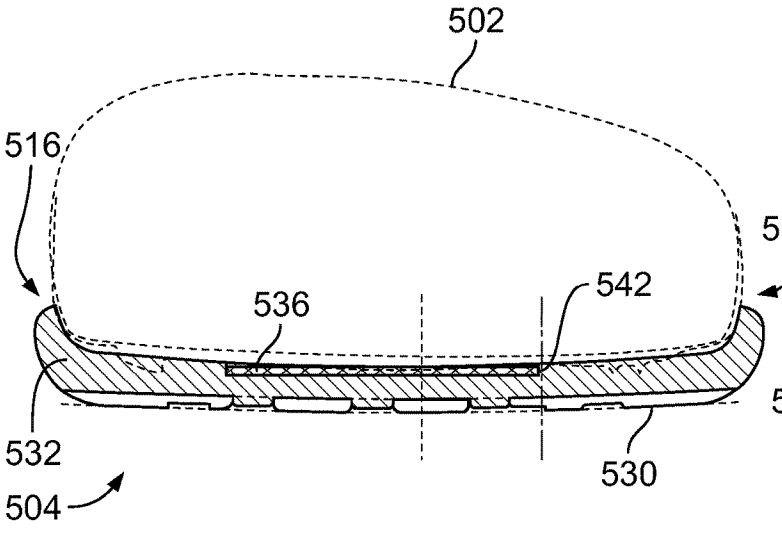
FIG. 8F is a cross-sectional view of the sole structure of FIG. 8A taken along line 8F-8F of FIG. 8B.
Figure 8I:
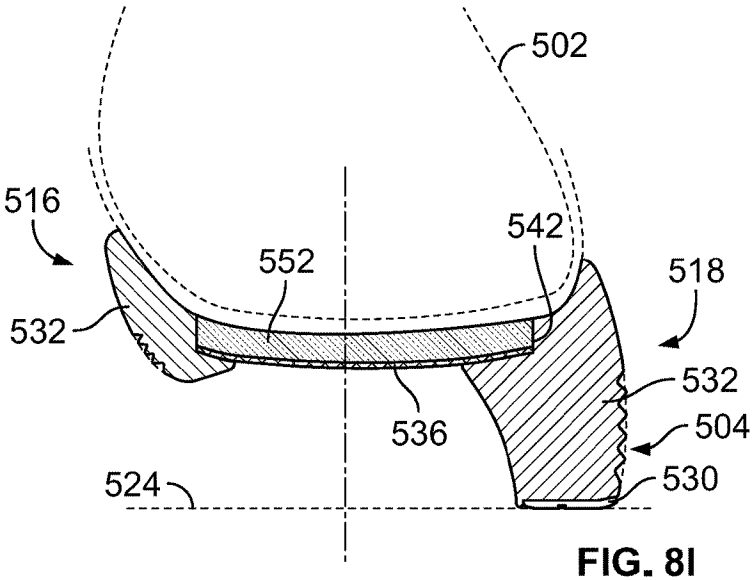
FIG. 8I is a cross sectional view of the sole structure of FIG. 8A taken along the line 8I-8I of FIG. 8B.
Figure 8H:
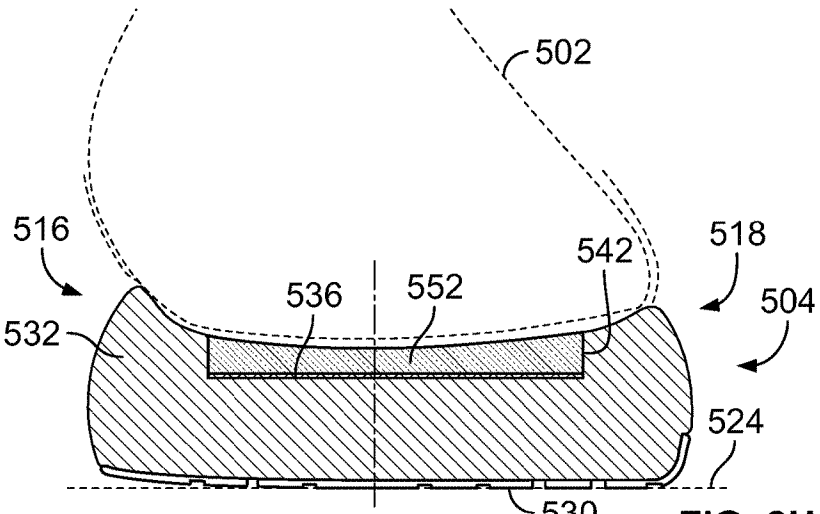
FIG. 8H is a cross-sectional view of the sole structure of FIG. 8A taken along the line 8H-8H of FIG. 8B.
Figure 8K:
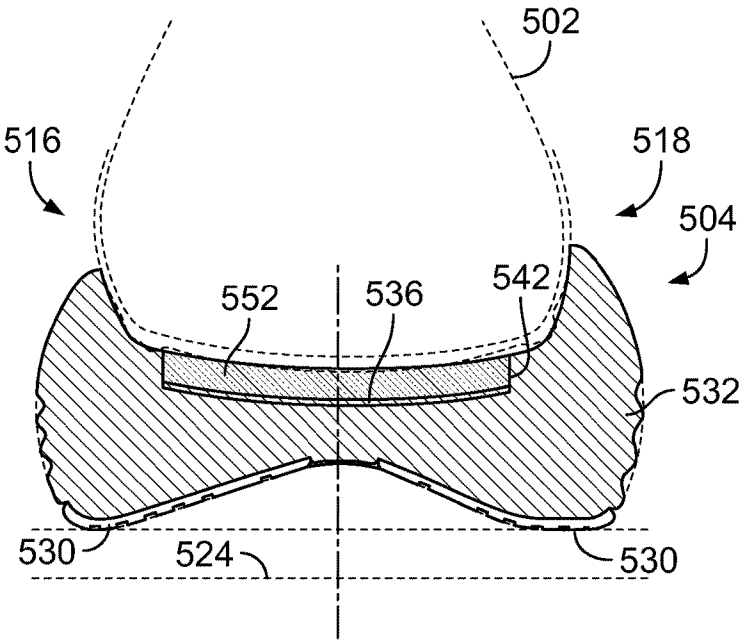
FIG. 8K is a cross-sectional view of the sole structure of FIG. 8A taken along the line 8K-8K of FIG. 8B.
Figure 8J:
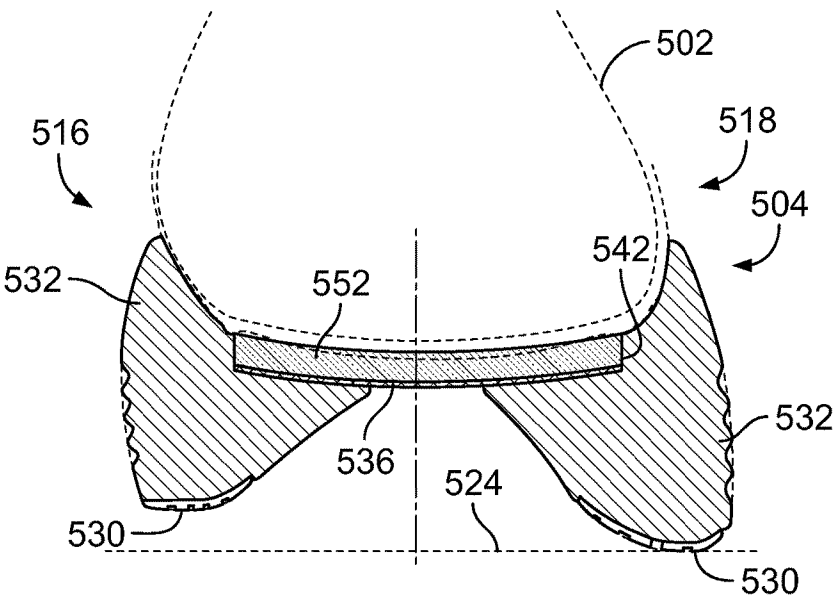
FIG. 8J is a cross-sectional view of the sole structure of FIG. 8A taken along the line 8J-8J of FIG. 8B.

In some aspects, however, the articles of footwear 300, 500 differ from each other. For example, the cushion layer is different. As shown in FIGS. 8D and 8G, which is a cross-sectional view taken along line 8G-8G in FIG. 8B within the forefoot region 508, the cushion layer 552 extends into the forefoot region 508.

Further, in some embodiments, the ground-engaging surface is not continuous along the medial side 516 of the midfoot region 510 of the article of footwear 500. Correspondingly, the outsole 530 may comprise multiple outsole portions that are spaced apart from one another, such that the ground engaging surface is not continuous between the outsole portions. For example, as illustrated in FIG. 8B, the outsole 530 includes a first outsole portion 530*a* positioned in the forefoot region 508 and generally forward of the widest portion 507 (e.g., to extend into the exit region 523). Additionally, the outsole 530 includes a second outsole portion 530*b* extending from the widest portion 507 and along the lateral side 518 of the midfoot region 410 to the heel region 512. Further, the outsole 530 can include a third outsole portion 530*c* that is coupled to the medial side 516 of the midsole member 532 in the heel region 512 (e.g., to extend into the entry region 521).

In some embodiments, for example, as illustrated in FIGS. 8B, and 8I-8M, the midsole member 532 can define a longitudinal channel 533 that extends from the heel region 512 (e.g., from the heel end of the sole structure 204)_and into the midfoot region 510 (e.g., into the cutout portion 538). As illustrated, the second and third outsole portions 530*b*, 530*c* are positioned on opposite sides of the longitudinal channel 533 so that the ground engaging surface is not continuous between the medial and lateral sides 516, 518 in the heel region 512.

Referring specifically to FIG. 8D, the longitudinal channel 533 defines a height 561 measured perpendicular from the flat ground surface 524 (e.g., the resting plane 592) to a top surface 563 of the longitudinal channel 533. Directly below the heel end 553 of the cushion layer 552, the height 561 of longitudinal channel 533 is such that the top surface 563 is above the first end 564 of the angled portion 557 and below the second end 566 of the angled portion 557. The top surface 563 of the longitudinal channel 533 defines a peak 565 (e.g., a local minimum of the height 561) that extends toward the ground surface 524. The peak 565 is positioned closer to the forefoot region 508 than is the heel end 553 of the cushion layer 552. Relatedly, the heel end 553 of the cushion layer 552 is between a heel end 567 of the longitudinal channel 533 and the cutout portion 538.

As shown in FIGS. 8A-8D, the sole structure 504 includes a lower surface 509 that is visible when the article of footwear 500 is viewed from the bottom of the article of footwear 500. The lower surface 509 faces the ground surface 524 (e.g., toward the resting plane 592) and away from the upper 502 when the article of footwear 500 is resting on the ground surface 524. The lower surface 509 includes the bottom surface 505, as well as other surfaces that are visible from the bottom of the article of footwear 500. For example, the lower surface 509 includes surfaces of the sole plate 536 that are visible through the cutout portion 538. That is, the sole plate 536 is visible through the cutout portion 538. The lower surface 509 also defines the substantially flat region 219, the resting plane 592 the entry region 221, and the exit region 223.

Correspondingly, the sole structure 504 further includes side surfaces that extend between the lower surface 509 and the upper 502. More specifically, the sole structure 504 includes a medial side surface 515 (see FIG. 8A) and a lateral side surface 517 (see FIG. 8C) that are visible from the medial side 516 and the lateral side 518, respectively. The medial side surface 515 and the lateral side surface 517 adjoin one another at a heel end 503 of the article of footwear 500 (see also FIGS. 8D and 8M). Accordingly, as viewed from the medial side 516 and the lateral side 518, the side surfaces 515, 517 extend between the angled portion 557 (e.g., the second end 566 of the angled portion) and the upper 502. The second end 566 corresponds with a heel end 511 of the lower surface 509 and the heel end 570 of the bottom surface 505. As such, the second end 566 is configured to engage with the ground surface 524 during a heel strike.

FIGS. 9A through 9M illustrate another embodiment of an article of footwear 600 according to the invention. In many aspects, the article of footwear 600 is similar to the article of footwear 500 described above and similar numbering in the 600 series is used for the article of footwear 600. For example, the article of footwear 600 has an upper 602, a sole structure 604, an interior cavity 606 defined by the combination of the upper 602 and the sole structure 604, a forefoot region 608, a midfoot region 610, a heel region 612, a medial side 616, and a lateral side 618. Further, the sole structure 604 has an outsole 630, a midsole member 632 (e.g., a first midsole member or cushion layer of a midsole) with a pocket 642, a sole plate 636, a cushion layer 652 (e.g., a second midsole member or cushion layer of a midsole), an arched section 640, and a cutout portion 638. The sole plate 636 is disposed between the midsole member 632 and the cushion layer 652 and the cushion layer 652 is positioned between the upper 602 and each of the midsole member 632 and the sole plate 636. Both the sole plate 636 and the cushion layer 632 are disposed within the pocket 642 in the midsole member 632. More specifically, the cushion layer 632 is positioned on top of the sole plate 636 (e.g., to secure the sole plate 636 in the pocket 642), such that the sole plate 636 is disposed within the pocket 642 between the midsole member 632 and the cushion layer 652 so that a first side 637 of the sole plate 636 contacts the midsole member 632 (e.g., to be directly coupled to the midsole member 632) and a second side 639 of the sole plate 636 contacts the cushion layer 652 (e.g., to be directly coupled to the cushion layer 652). The first side 637 of the sole plate 636 is opposite the second side 639 of the sole plate 636. In the illustrated example, the first side 637 of the sole plate 636 faces the ground-engaging surface and the second side 639 of the sole plate 636 faces the upper 602. The sole plate 636 extends at least partially through the midfoot region 610 and is exposed at the cutout portion 638 of the midsole member 632. The cushion layer 652 is positioned between the upper 602 and each of the midsole member 632 and the sole plate 636. The midsole member 632, the cushion layer 652, and the sole plate 636 can form a cushioning system of the sole structure 604 (e.g., a midsole of the sole structure 604). Additionally, the sole structure 604 is shaped to define an entry angle 620 in the heel region 612 and an exit angle 622 in the forefoot region 608 with respect to a flat ground surface 624. Similarly, in some embodiments, the entry angle 620 can be about 30 degrees and the sole structure 604 can start angling away from the ground surface 624 approximate the area underneath the heel of a user's foot (shown in FIG. 4). Further, in some embodiments, the exit angle 622 can be about 15 degrees and can start angling away from the ground surface 624 approximate the area underneath the balls of a user's foot (shown in FIG. 4).

Accordingly, when in a rested state as shown in FIGS. 9A-9M, the sole structure 604 is shaped to define an entry angle 620 in the heel region 612 and an exit angle 622 in the forefoot region 608 with respect to a flat ground surface 624. The sole structure 604 can also define a substantially flat region 619 that is approximately parallel with respect to the flat ground surface 624. The substantially flat region 619 can extend from a first end 660 to a second end 662. As illustrated in FIGS. 8A, 8C, and 8D, the first end 660 can be in the heel region 612 and the second end 662 can be in the forefoot region 608.

Correspondingly, the sole structure 604 can define an entry region 621 in which a bottom surface 605 (e.g., a ground engaging surface) of the sole structure 604 curves upwardly to start angling away from the ground surface 624 approximate the area underneath the heel of a user's foot (shown in FIG. 4) by at least the entry angle 620. In that regard, the entry region 621 can include an angled portion 657 (e.g., an angled region). The angled portion 657 extends from a first end 664 to a second end 666. The first end 664 is positioned proximate the substantially flat region 619 such that the first end 664 is positioned below a heel end 668 of the sole plate 636 and such that the first end 664 is closer to the forefoot region 608 than is the heel end 668 of the sole plate 636. The second end 666 is positioned above the heel end 668 of the sole plate 636 and the second end 666 is positioned farther from the forefoot region 608 than is the heel end 668 of the sole plate 636. Accordingly, the heel end 668 of the sole plate 636 is positioned between the first end 664 of angled portion 657 and the second end 666 of the angled portion 657 relative to a vertical direction, and the heel end 668 of the sole plate 636 is positioned between the first end 664 of angled portion 657 and the second end 666 of the angled portion 657 relative to a longitudinal direction (e.g., a heel-to-toe direction). As such, the first end 664 of the angled portion 657 is configured to be located at an area underneath an approximate location of a heel of a user's foot, second end 666 of the angled portion 657 is configured to be positioned above or behind a heel of a user's foot. The angled portion 657 is substantially flat between the first end 664 and the second end 666. For example, between the first end 664 and the second end 666, the angled portion 657, and thus the entry region 621, can be at about the entry angle 620 to enhance contact with a user's heel during a heel strike. In that regard, the angled portion 657 forms a portion of the bottom surface 605 of the sole structure 604 that is configured to engage the ground during a heel strike. In some cases, the second end 666 of the angled portion 657, and thus the entry region 621, defines a heel end 670 of the bottom surface 605. Accordingly, the ground-engaging bottom surface 605 extends above the heel end 668 of the sole plate 636.

Figures 9A, 9B, 9C:
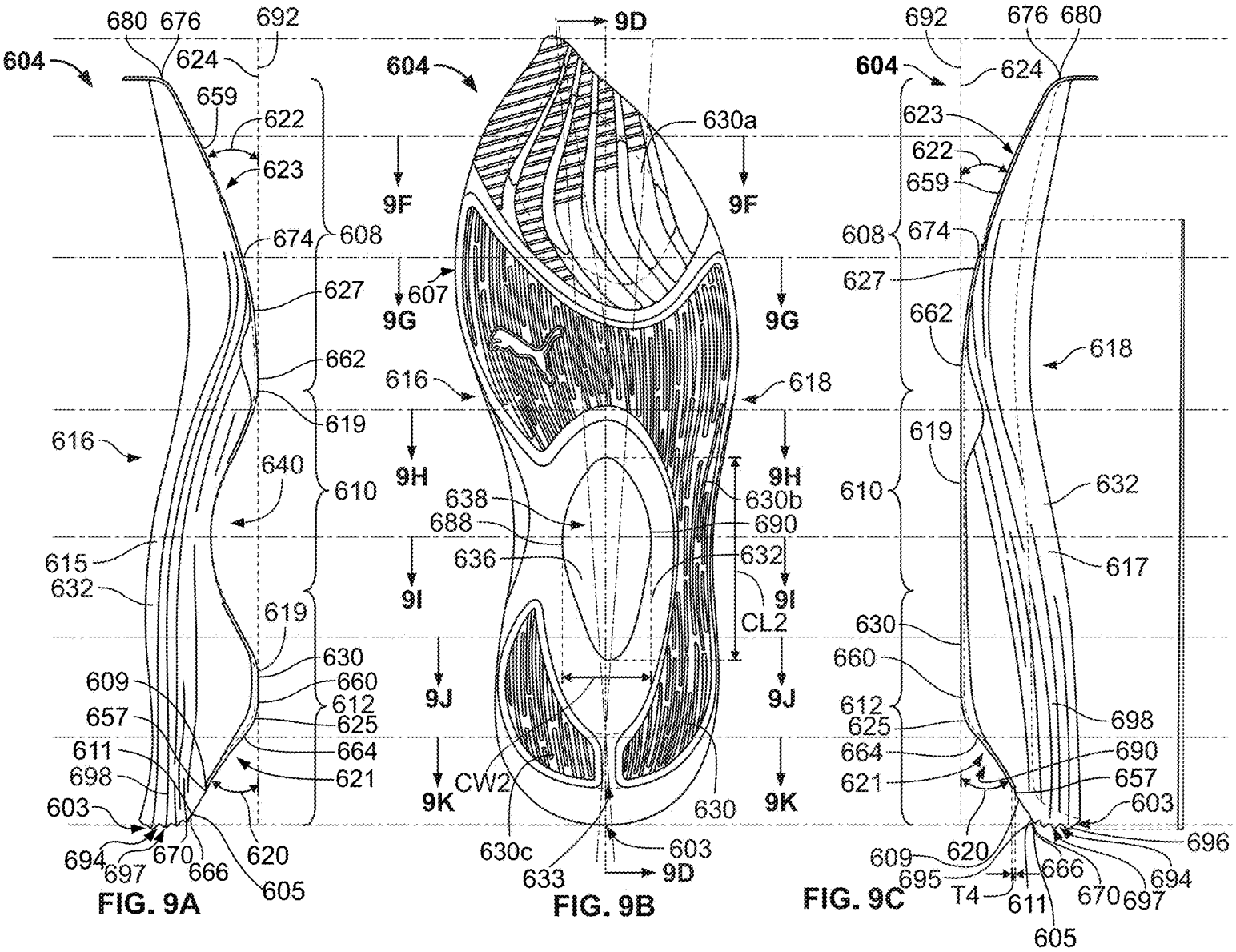
FIG. 9A is a medial side view of a sole structure of an article of footwear that includes a sole plate and a foam layer according to an embodiment of the disclosure.
FIG. 9B is a bottom view of the sole structure of FIG. 9A.
FIG. 9C is a lateral side view of the sole structure of FIG. 9A.
Figures 9D, 9E:
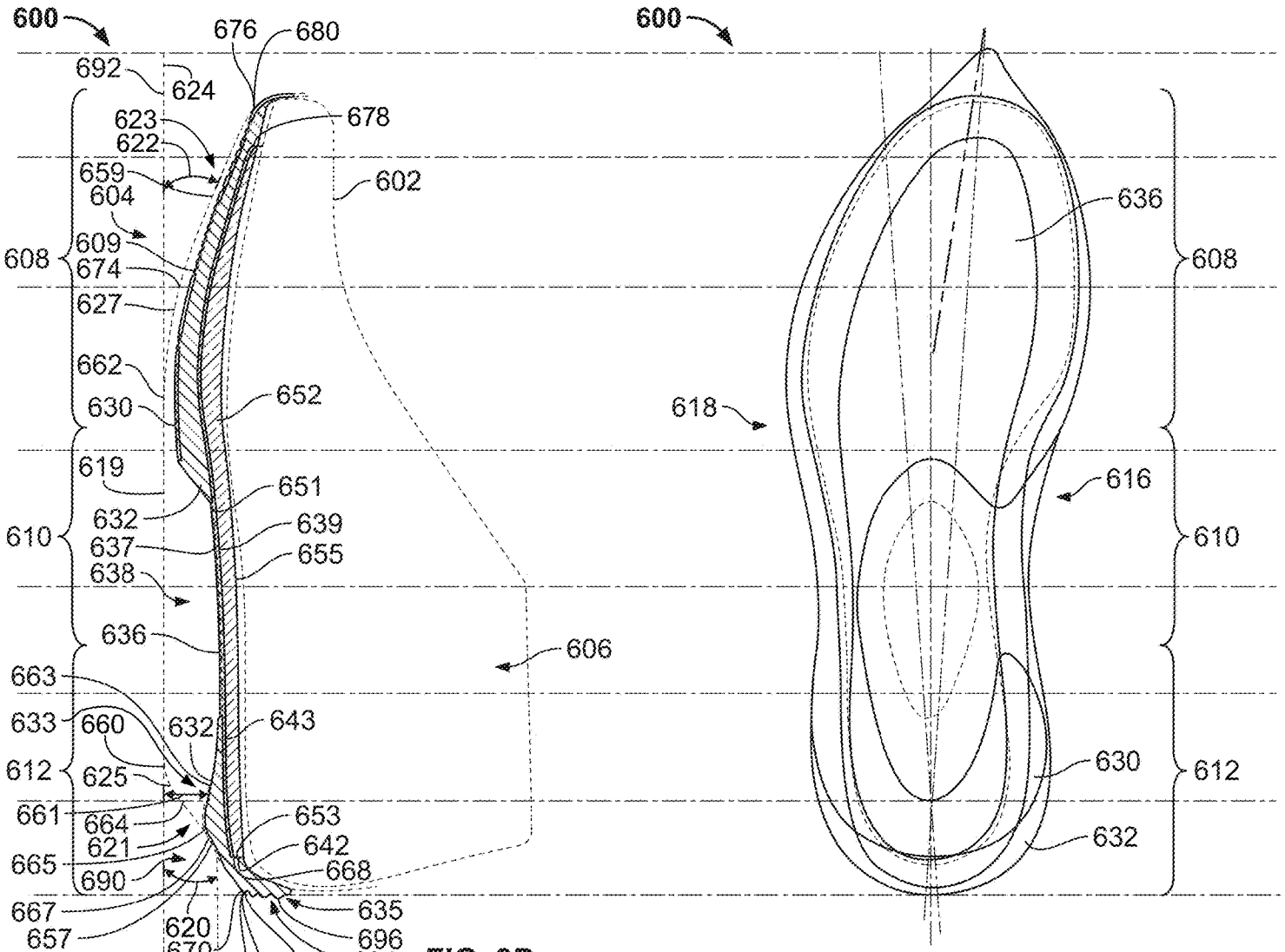
FIG. 9D is a cross-sectional view of the sole structure of FIG. 9A taken along line 9D-9D of FIG. 9B.
FIG. 9E is a top view of the sole structure of FIG. 9A.
Figure 9G:
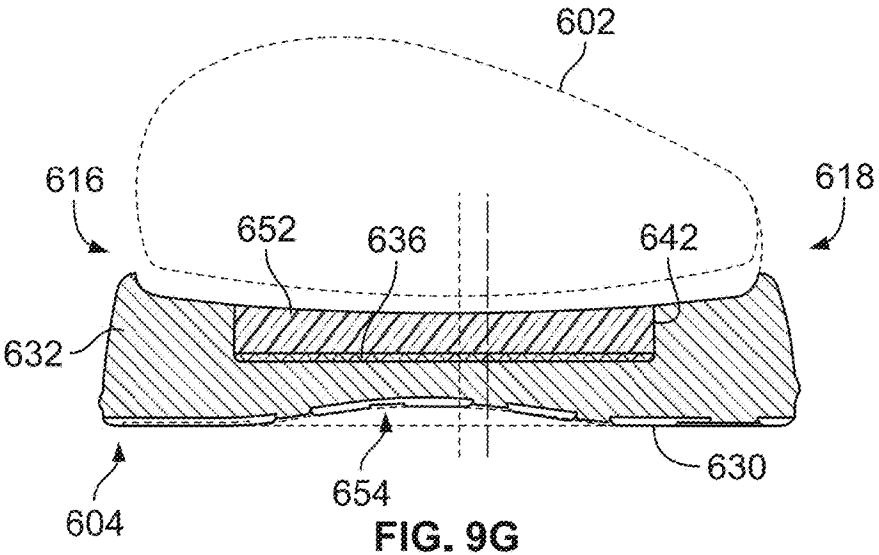
FIG. 9G is a cross-sectional view of the sole structure of FIG. 9A taken along the line 9G-9G of FIG. 9B.

Relatedly, referring to FIG. 9D, the pocket 642 defines a base surface 643. The sole plate 626 is received in the pocket 642 so that the first side 637 of the sole plate 636 contacts the base surface 643 and the second side 639 of the sole plate 636 contacts a first side 651 (e.g., a lower surface) of the cushion layer 652. The cushion layer 652 includes a second side 655 (e.g., an upper surface) that is opposite the first side 651 and is configured to couple to the upper 602. Within the heel region 612, a portion of the base surface 643 is positioned so that the first end 664 of the angled portion 657 is below the base surface 643 and the second end 666 of the angled portion 657 is above the base surface 643 (e.g., the base surface 643 is between the first end 664 and the second end 666 of the angled portion 657). More specifically, within the heel region 612, the base surface 643 is disposed entirely between the first end 664 and the second end 664 of the angled portion 657.

Still referring to FIG. 9D, the midsole member 632 includes a heel end 635 and the cushion layer 652 includes a heel end 653. The heel end 653 of the cushion layer 652 is located closer to the forefoot region 608 than is the heel end 635 of the midsole member 632. Additionally, the heel end 635 of the midsole member 632 extends above the heel end 653 of the cushion layer 652. Correspondingly, at the heel end 653 of the cushion layer 652, the second surface 655 of the cushion layer 652 is above the second end 666 of the angled portion 657 (e.g. so that a heel-most end of the second surface 655 is above the second end 666 of the angled portion). Additionally, the heel-most end of the second surface 655 (e.g., at the heel end 653 of the cushion layer 652) is below a portion of the midsole member 632 that is coupled to the upper 602 (e.g., a heel-most end of the midsole member 632. Put another way, the midsole member 632 extends above the second surface 655 of the cushion layer 652.

Referring again to the rested state as shown in FIGS. 9A-9M, the sole structure 604 can also define an exit region 623 in which the bottom surface 605 of the sole structure 604 curves upwardly to start angling away from the ground surface 624 approximate the area underneath the balls of a user's foot (shown in FIG. 4) by at least the exit angle 622. In that regard, the exit region 623 can include an angled portion 659 (e.g., an angled region). The angled portion 659 extends from a first end 674 to a second end 676. The first end 674 is positioned proximate the substantially flat region 619 such that the first end 674 is positioned below a toe end 678 of the sole plate 636 and such that the first end 674 is closer to the heel region 612 than is the toe end 678 of the sole plate 636. The second end 676 is positioned above the toe end 678 of the sole plate 636 and the second end 676 is positioned farther from the heel region 612 than is the toe end 678 of the sole plate 636. The angled portion 659 is substantially flat between the first end 674 and the second end 676. For example, between the first end 674 and the second end 676, the angled portion 659, and thus the exit region 623, can be at about the exit angle 622 to adjust the running posture of the user to be a forward tilt to move the running motion of the user toward their forefoot to propel the user forward. In that regard the angled portion 659 forms a portion of the bottom surface 605 of the sole structure 604 that is configured to engage the ground during toe-off. In some cases, the second end 676 of the angled portion 659, and thus the exit region 623, defines a toe end 680 of the bottom surface 605. In some cases, the sole plate 626 is arranged so that the toe end 678 of the sole plate 636 is positioned above the heel end 668 of the sole plate 636 when the substantially flat region 619 is in contact with the ground surface 624.

The entry and exit angles 620, 622 can be configured to enhance contact with a user's heel during a heel strike and promoting engagement of a large surface area of the outsole 630 in the forefoot region 608 during a push-off by the user. Accordingly, the entry region 621 can extend rearward from the substantially flat region 619 and the exit region 623 can extend forward from the substantially flat region 619. In some embodiments, the junction between the substantially flat region 619 and the exit region 623 can be located at a widest portion 607 of the sole structure 604 (e.g., at a greatest distance between the medial and lateral sides 616, 618), so as to be aligned proximate to the metatarsal bones of the user. As illustrated in FIGS. 9C and 9D, the entry region 621 forms a gap 690 between the midsole 632 and the flat ground surface 624. The flat ground surface 624 corresponds with a resting plane 692 upon which the article of footwear rests when on the flat ground surface 624. In this case, the resting plane 692 is defined by the substantially flat region 619. The heel end 668 of the sole plate 636 is positioned over the gap 690. At the heel end 668 of the sole plate, the gap 690 has a thickness (T3) that is greater than a thickness (T4) of the outsole 630. As noted herein, the thickness (T3) of the gap 690 and the thickness (T4) of the outsole 630 are taken in a direction that is normal to the resting plane 692. As illustrated in FIG. 9B, the cutout portion 638 defines a cutout length (CL2) at a longest portion of the cutout portion 638. The cutout length (CL2) extends in a heel-toe direction and parallel with respect to the flat ground surface 624 when the sole structure 604 is resting on the flat ground surface 624. The cutout portion 638 also defines a cutout width (CW2) at a widest portion of the cutout portion 638. The cutout width (CW2) extends in a medial-lateral direction and parallel with respect to the flat ground surface 624 when the sole structure 604 is resting on the flat ground surface 624. The cutout length (CL2) is greater than the cutout width (CW2). As illustrated in FIGS. 9C and 9D, the midsole member 632 comprises an external groove 694 defined in the heel region 612. As illustrated in FIG. 9D, the external groove 694 at a heel end 696 of the sole structure 604 is positioned above the second end 666 of the angled portion 657 and is positioned entirely above the sole plate 636. Further, as illustrated in FIG. 9D, the external groove 694 is positioned above a portion of the upper 602. As illustrated in FIGS. 9A and 9C, a portion of the medial side 616 of the sole structure 604 and a portion of the lateral side 618 of the sole structure 604 each comprise a plurality of undulating surfaces 698.

Due to the curved nature of each of the entry region 621 and the exit region 623, the respective junctions with the substantially flat region 619 can form rocking regions 625, 627 (e.g., rocking members). The rocking regions 625, 627 are formed as convex regions of the bottom surface 505 that can create a fulcrum for the sole plate 636. For example, the fulcrum formed by the rocking region 625 can create a propulsion lever with the sole plate 636 between a midfoot region and a heel region of the wearer that allows the wearer to accelerate faster and create a toe-off movement where the forefoot region of the wearer propels the wearer forward. More specifically, the fulcrum created by the rocking region 625 can create a propulsion lever with the sole plate 636 between the entry region 621 and the substantially flat region 619. The rocking region 625 is an entirely convex region that extends between the first end 660 of the substantially flat region 619 and the first end 664 of the substantially flat angled portion 657. The entry region 621 includes the rocking region 625 and the angled portion 657, such that the entry region 621 curves upwardly from the substantially flat region 619 at the rocking region 625 to form the angled portion 657. In that regard, the rocking region 625 forms an upwardly curved portion (e.g., an upwardly curved entry region). The fulcrum formed by the rocking region 627 can also act as a propulsion level with the sole plate 636 proximate to the metatarsal bones of the user by adjusting the running posture of the user to be a forward tilt and moves the running motion of the user toward their forefoot. The fulcrum created by the rocking region 627 can create a propulsion lever with the sole plate 636 between the exit region 623 and the substantially flat region 619 (e.g., proximate the widest portion 607 of the sole structure 604). The rocking region 627 is an entirely convex region that extends between the second end 662 of the substantially flat region 619 and the first end 674 of the substantially flat angled portion 659. The exit region 623 includes the rocking region 627 and the angled portion 659, such that the exit region 623 curves upwardly from the substantially flat region 619 at the rocking region 627 to form the angled portion 659. In that regard, the rocking region 627 forms an upwardly curved portion (e.g., an upwardly curved exit region).

Additionally, the midsole member 632, the sole plate 636, and the cushion layer 652 can be similarly constructed as the midsole member 532, the sole plate 536, and the cushion layer 552. For example, the midsole member 632 can be formed from a PU plastic, such as a thermoplastic polyurethane (TPU) material; the sole plate 636 can be formed from a PU plastic, such as a thermoplastic polyurethane (TPU) material, thermoplastic elastomers and fiber reinforced thermoplastics consisting of block copolymers, carbon fiber, or other rigid, semi-rigid, or spring-like materials and combinations thereof, and the cushion layer 652 can be formed from a thermoplastic elastomer material, for example, a polyether block amide (PEBA), including PEBAX® foam.

Further, the sole plate 636 has a shape that is similar to but proportionally smaller than the midsole member 632 throughout the forefoot, midfoot, and heel regions 608, 610, 612 (shown in FIG. 9E). Additionally, the pocket 642 and the sole plate 636 are correspondingly shaped such that a peripheral envelope of the pocket 642 bounds and can be in contact with an outer periphery of the sole plate 636. Put another way, the pocket 642 can be shaped to receive the sole plate 636, and the sole plate 636 can be shaped to be received within the pocket 642. Further, the cushion layer 652 can also be positioned within the pocket 642, such that the sole plate 636 can be secured in the pocket 642 by the cushion layer 652. Additionally, as shown in FIGS. 9F-9K, the peripheral envelope of the pocket 642 can be in contact with the cushion layer 652. In particular, the sole plate 636 can be secured between the midsole member 632 and the cushion layer 652, with the midsole member 632 in contact with a first side 637 of the sole plate 636 and the cushion layer 652 in contact with a second side 639 of the sole plate 636 that is opposite the first side. The cushion layer 652 may extend to cover the entirety of the second side of the sole plate 636. It is appreciated that the cushioning layer 652 can be coupled to the midsole member 632. Moreover, the position of the sole plate 636 in relation to the midsole member 632 and the cushion layer 652 can effectively adjust the running posture of the user to be a forward tilt and moves the running motion of the user toward their forefoot. As illustrated in FIG. 9F-9K, the midsole member 632 is configured to define an open space between the ground surface 624 and the sole plate 636 when the article of footwear 600 is resting on the ground surface 624.

In some embodiments, the ground-engaging surface is not continuous along the medial side 616 of the midfoot region 610 of the article of footwear. Correspondingly, the outsole 630 may comprise multiple outsole portions that are spaced apart from one another, such that the ground engaging surface is not continuous between the outsole portions. For example, as illustrated in FIG. 9B, the outsole 630 includes a first outsole portion 630*a* positioned in the forefoot region 608 and generally forward of the widest portion 607 (e.g., to extend into the exit region 623). Additionally, the outsole 630 includes a second outsole portion 630*b* extending from the widest portion 607 and along the lateral side 618 of the midfoot region 410 to the heel region 612. Further, the outsole 630 can include a third outsole portion 630*c* that is coupled to the medial side 616 of the midsole member 632 in the heel region 612 (e.g., to extend into the entry region 621). As illustrated in FIG. 9B, the third outsole portion 630*c* and the second outsole portion 630*b* are disposed on opposing sides of the cutout portion 638 in the heel region 612. A portion of the third outsole portion 630*c* is disposed on a medial side 688 of the cutout portion 638 and a portion of the second outsole portion 630*b* is disposed on a lateral side 690 of the cutout portion 638. The third outsole portion 630*c* and the second outsole portion 630*b* are disposed across the cutout portion 638 from one another so that the outsole 630 is not continuous across the medial side 616 in the midfoot region 610. As illustrated in FIG. 9B, the sole plate 636 extends uninterrupted from the lateral side 690 of the cutout portion 638 to the medial side 688 of the cutout portion 638.

Figure 8M:
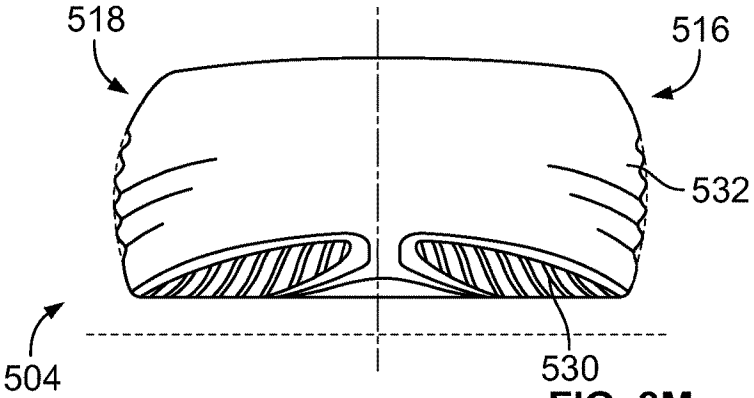
FIG. 8M is a heel view of the sole structure of FIG. 8A.
Figure 8L:
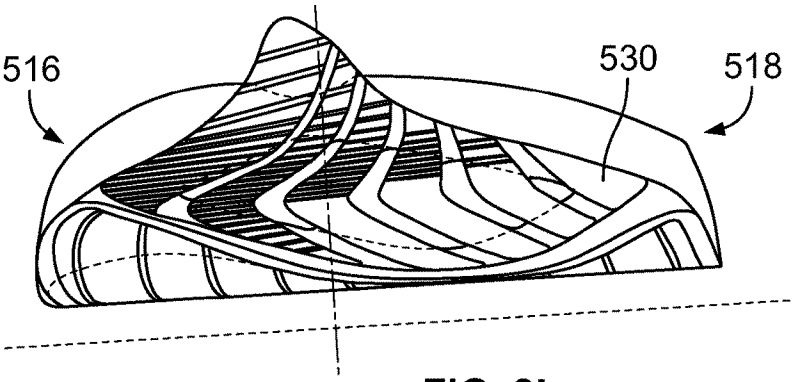
FIG. 8L is a toe view of the sole structure of FIG. 8A.
Figure 9I:
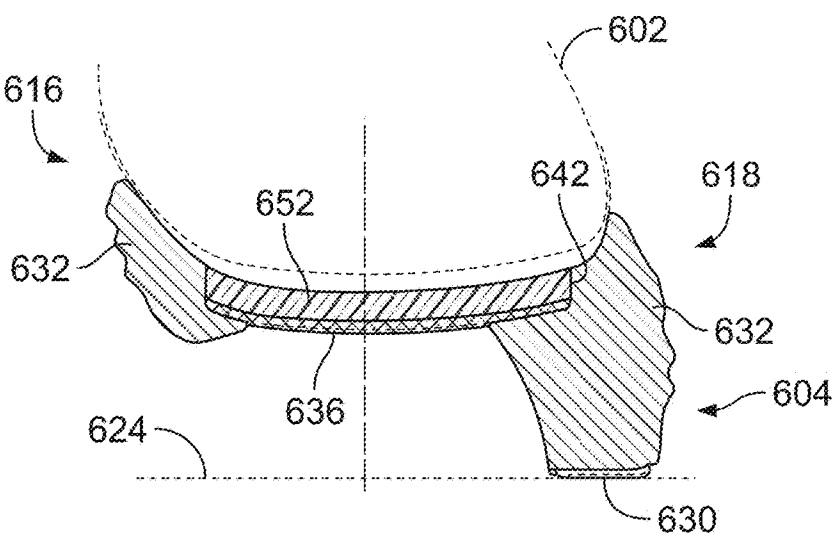
FIG. 9I is a cross sectional view of the sole structure of FIG. 9A taken along the line 9I-9I of FIG. 9B.

As illustrated in FIGS. 9B, and 9I-8M, the midsole member 632 defines a longitudinal channel 633 that extends from the heel region 612 (e.g., from the heel end of the sole structure 204) and into the midfoot region 610 (e.g., into the cutout portion 638). As illustrated, the second and third outsole portions 630*b*, 630*c* are positioned on opposite sides of the longitudinal channel 633 so that the ground engaging surface is not continuous between the medial and lateral sides 616, 618 in the heel region 612.

Referring specifically to FIG. 9D, the longitudinal channel 633 defines a height 661 measured perpendicular from the flat ground surface 624 (e.g., the resting plane 692) to a top surface 663 of the longitudinal channel 633. Directly below the heel end 653 of the cushion layer 652, the height 661 of longitudinal channel 633 is such that the top surface 663 is above the first end 664 of the angled portion 657 and below the second end 666 of the angled portion 657. The top surface 663 of the longitudinal channel 633 defines a peak 665 (e.g., a local minimum of the height 661) that extends toward the ground surface 624. The peak 665 is positioned closer to the forefoot region 608 than is the heel end 653 of the cushion layer 652. The heel end 653 of the cushion layer 652 is between a heel end 667 of the longitudinal channel 633 and the cutout portion 638.

As shown in FIGS. 9A-9D, the sole structure 604 includes a lower surface 609 that is visible when the article of footwear 600 is viewed from the bottom of the article of footwear 600. The lower surface 609 faces the ground surface 624 (e.g., toward the resting plane 692) and away from the upper 602 when the article of footwear 600 is resting on the ground surface 624. The lower surface 609 includes the bottom surface 605, as well as other surfaces that are visible from the bottom of the article of footwear 600. For example, the lower surface 609 includes surfaces of the sole plate 636 that are visible through the cutout portion 638. That is, the sole plate 636 is visible through the cutout portion 638. The lower surface 609 also defines the substantially flat region 219, the resting plane 692 the entry region 221, and the exit region 223.

The sole structure 604 further includes side surfaces that extend between the lower surface 609 and the upper 602. More specifically, the sole structure 604 includes a medial side surface 615 (see FIG. 9A) and a lateral side surface 617 (see FIG. 8C) that are visible from the medial side 616 and the lateral side 618, respectively. The medial side surface 615 and the lateral side surface 617 adjoin one another at a heel end 603 of the article of footwear 600 (see also FIGS. 9D and 9M). Accordingly, as viewed from the medial side 616 and the lateral side 618, the side surfaces extend between the angled portion 657 (e.g., the second end 666 of the angled portion) and the upper 602. The second end 666 corresponds with a heel end 611 of the lower surface 609 and the heel end 670 of the bottom surface 605. As such, the second end 666 is configured to engage with the ground surface 624 during a heel strike.

Each of the medial side surface 615 and the lateral side surface 617 include the plurality of undulating surfaces 698 that form a plurality of ridges 697. As shown in FIGS. 9A-9D, and 9M, at least some of the plurality of ridges extend around the heel end 603 of the article of footwear 600 to extend from the medial side surface 615 to the lateral side surface 617. At least one ridge of the plurality of ridges 297 extends between the second end 666 of the angled portion 657 and the upper 602. As shown in FIGS. 9A, 9C, and 9D, the second end 666 of the angled portion 657 is at a point 695 formed by the sole structure 602 (e.g., the midsole member 632) when viewed from one of the lateral side 618 and the medial side 616. The point 695 is an apex of a ridge of the plurality of ridges 697 that extends from the lateral side 618 to the medial side 616.

Figure 9F:
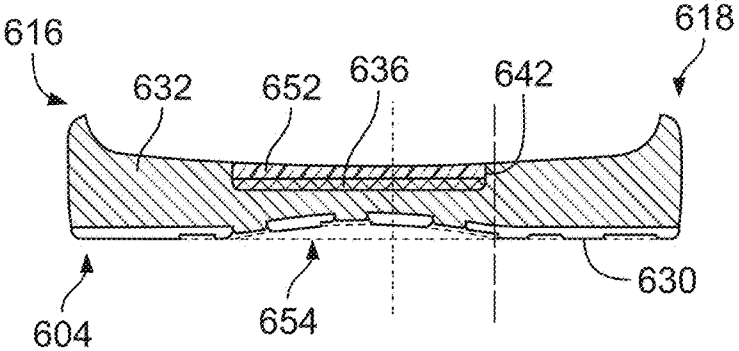
FIG. 9F is a cross-sectional view of the sole structure of FIG. 9A taken along line 9F-9F of FIG. 9B.
Figure 9H:
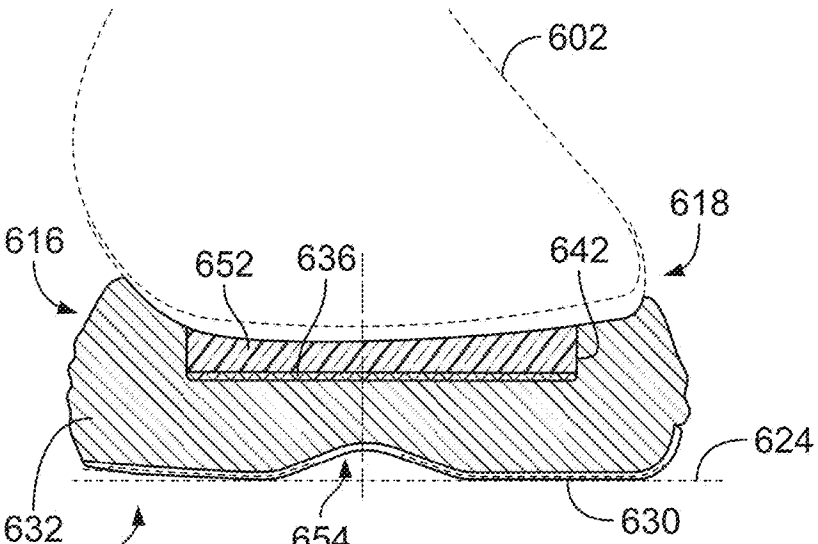
FIG. 9H is a cross-sectional view of the sole structure of FIG. 9A taken along the line 9H-9H of FIG. 9B.
Figure 9K:
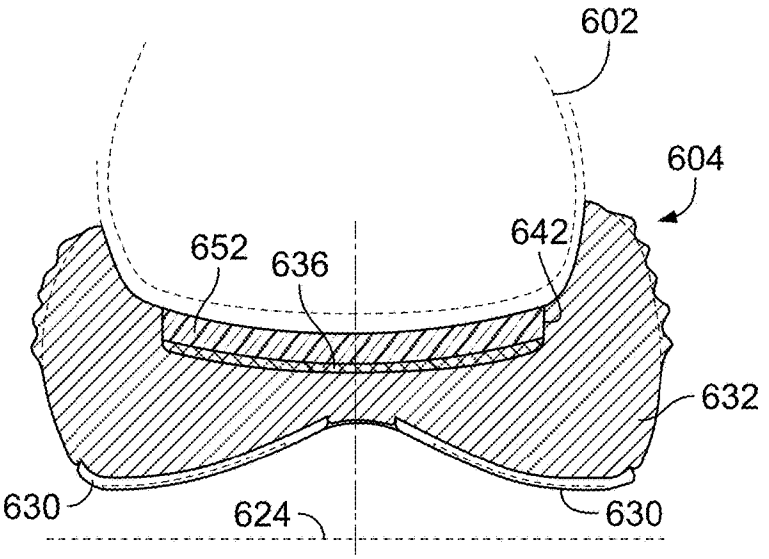
FIG. 9K is a cross-sectional view of the sole structure of FIG. 9A taken along the line 9K-9K of FIG. 9B.
Figure 9J:
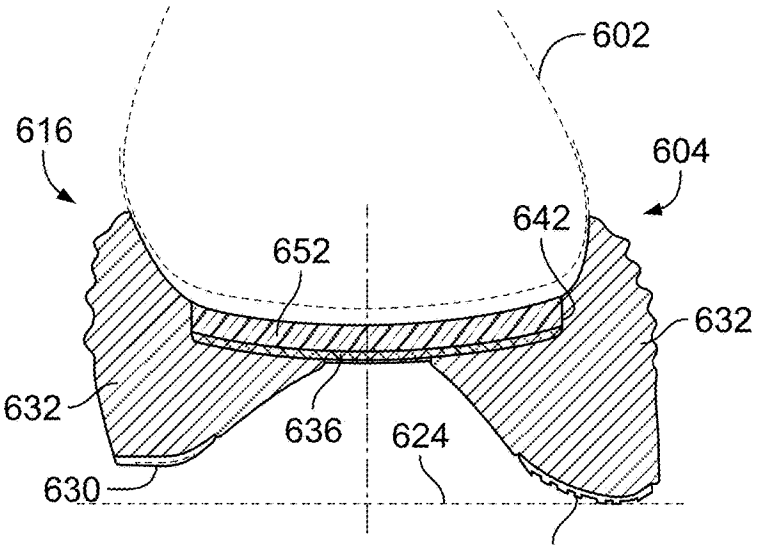
FIG. 9J is a cross-sectional view of the sole structure of FIG. 9A taken along the line 9J-9J of FIG. 9B.
Figure 9M:
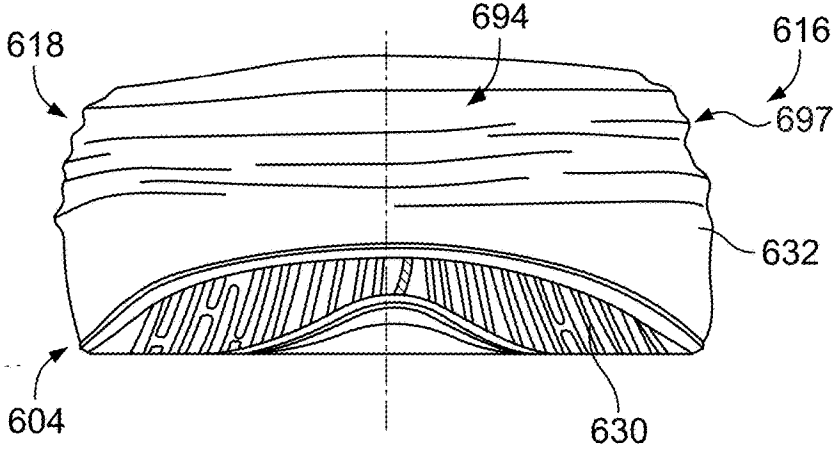
FIG. 9M is a heel view of the sole structure of FIG. 9A.
Figure 9L:
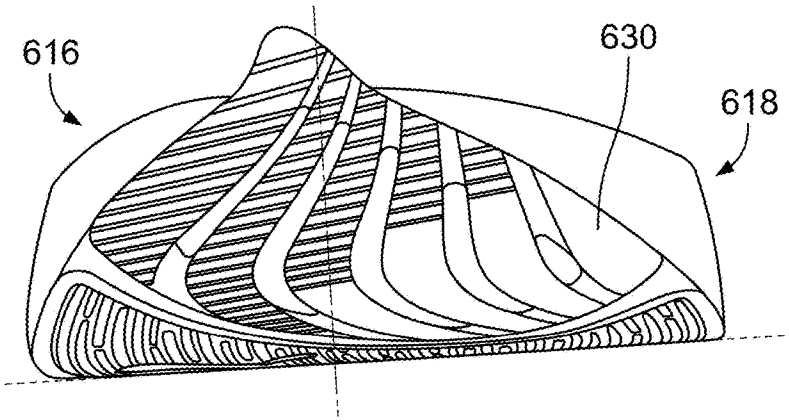
FIG. 9L is a toe view of the sole structure of FIG. 9A.

In some aspects, however, the articles of footwear 500, 600 differ from each other. For example, as shown in FIGS. 9D, 9E and FIG. 9F, which is a cross-sectional view taken along line 9F-9F in FIG. 9B within the forefoot region 608, the cushion layer 652 extends even farther into the forefoot region 608. Further, as shown in FIGS. 9D-9M, the cushion layer 652 can be configured to cover the entirety of the second side of the sole plate 636 when the sole plate 636 and the cushion layer 652 are received within the pocket 642. Additionally, the midsole member 632 has a more consistent thickness from the midfoot region 610 through the forefoot region 608 and is thinner than the midsole member 532 near the midfoot region 610 and thicker in the portion beneath a user's toes in the forefoot region 608. The midsole member 632 also has a chamber 654 extending upward into the midsole member 632 and extending from the forefoot region 608 into the cutout portion 638. In some embodiments, the chamber 654 can be arch-shaped. Looking at FIGS. 9F-9H, in those embodiments, the height of the chamber 654 (defined as measured from the ground surface 624 to the top of the chamber 654 taken along the shortest path) can be about half the thickness of the midsole member 632 (defined as measured from the top of the chamber 654 to the top of the midsole member 632 taken along the shortest path). In some embodiments, the width of the chamber 654 can decrease moving from the forefoot region 608 to the cutout portion 638. In some embodiments the area of the cross-section of the chamber 654 can remain constant moving from the forefoot region 608 to the cutout portion 638 (e.g., as the width of the chamber 654 decreases, the height of the chamber 654 increases).

FIGS. 10A through 10M illustrate another embodiment of an article of footwear 700 according to the invention. In many aspects, the article of footwear 700 is similar to the article of footwear 300 described above and similar numbering in the 700 series is used for the article of footwear 700. For example, the article of footwear 700 has an upper 702, a sole structure 704, an interior cavity 706 defined by the combination of the upper 702 and the sole structure 704, a forefoot region 708, a midfoot region 710, a heel region 712, a medial side 716, and a lateral side 718. Further, the sole structure 704 has an outsole 730, a midsole member 732 (e.g., a first midsole member or cushion layer) with a pocket 742, a sole plate 736, a cushion layer 752 (e.g., a second midsole member or cushion layer), an arched section 740, and a cutout portion 738. The midsole member 732, the cushion layer 752, and the sole plate 736 can form a cushioning system of the sole structure 704 (e.g., a midsole of the sole structure 704). Additionally, the sole structure 704 is shaped to define an entry angle 720 in the heel region 712 and an exit angle 722 in the forefoot region 708 with respect to a flat ground surface 724. Similarly, in some embodiments, the entry angle 720 can be about 30 degrees and the sole structure 704 can start angling away from the ground surface 724 approximate the area underneath the heel of a user's foot (shown in FIG. 4). Further, in some embodiments, the exit angle 722 can be about 15 degrees and can start angling away from the ground surface 724 approximate the area underneath the balls of a user's foot (shown in FIG. 4).

Additionally, the midsole member 732, the sole plate 736, and the cushion layer 752 can be similarly constructed as the midsole member 332, the sole plate 336, and the cushion layer 352. For example, the midsole member 732 can be formed from a PU plastic, such as a thermoplastic polyurethane (TPU) material; the sole plate 736 can be formed from a PU plastic, such as a thermoplastic polyurethane (TPU) material, thermoplastic elastomers and fiber reinforced thermoplastics consisting of block copolymers, carbon fiber, or other rigid, semi-rigid, or spring-like materials and combinations thereof, and the cushion layer 752 can be formed from a thermoplastic elastomer material, for example, a polyether block amide (PEBA), including PEBAX® foam.

Figures 10A, 10B, 10C:
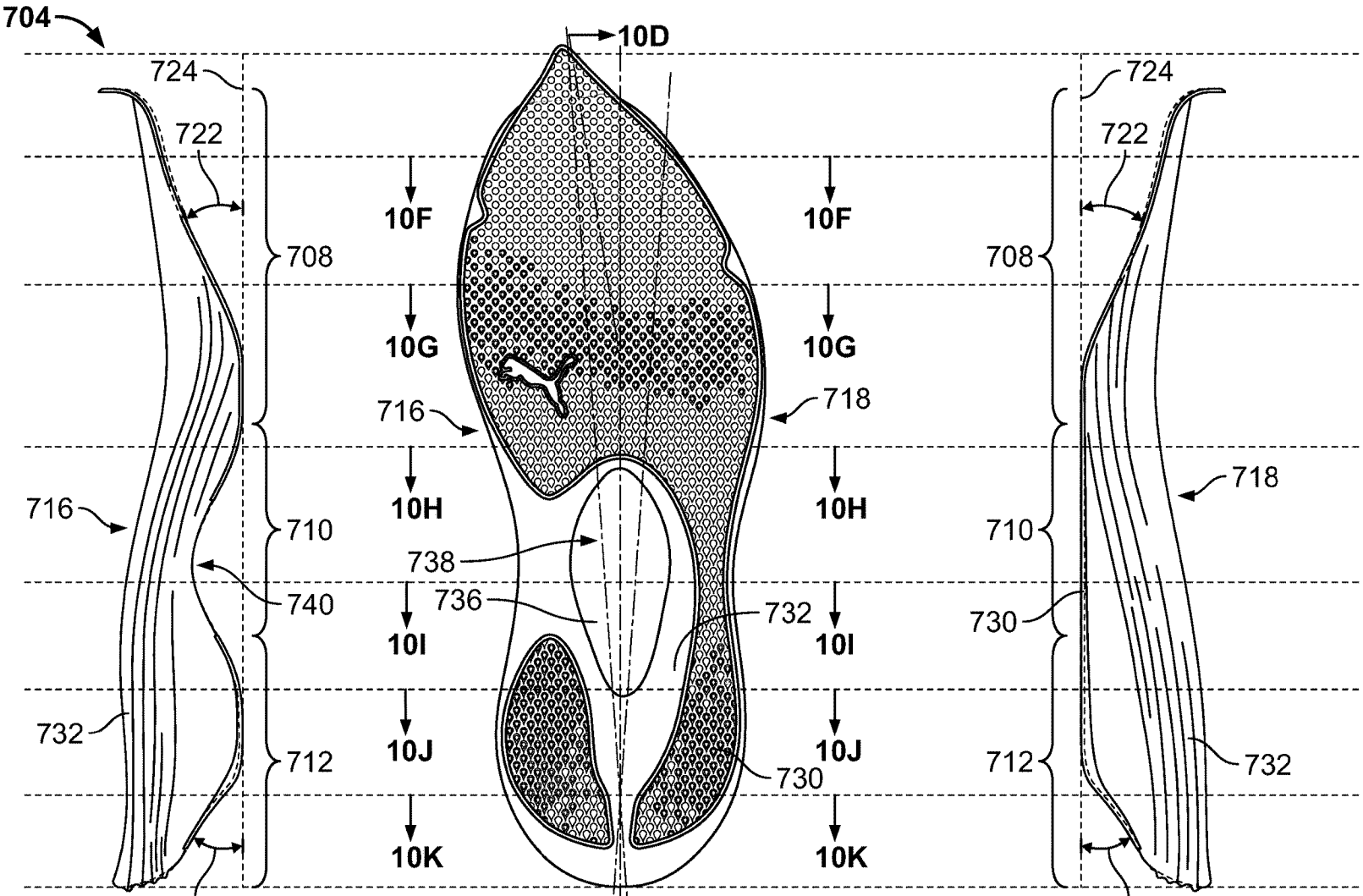
FIG. 10A is a medial side view of a sole structure of an article of footwear that includes a sole plate and a foam layer according to an embodiment of the disclosure.
FIG. 10B is a bottom view of the sole structure of FIG. 10A.
FIG. 10C is a lateral side view of the sole structure of FIG. 10A.
Figures 10D, 10E:
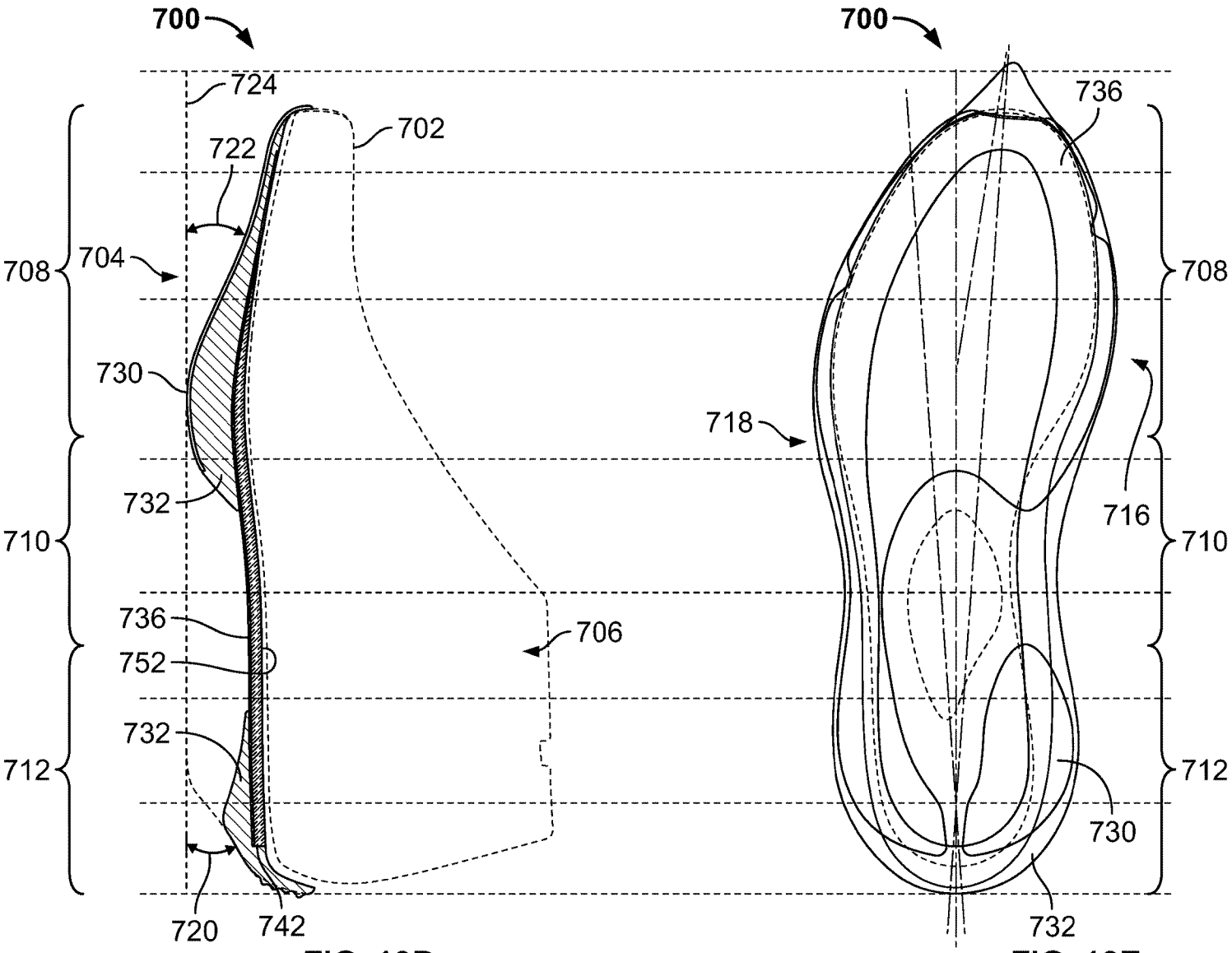
FIG. 10D is a cross-sectional view of the sole structure of FIG. 10A taken along line 10D-10D of FIG. 10B.
FIG. 10E is a top view of the sole structure of FIG. 10A.
Figure 10G:
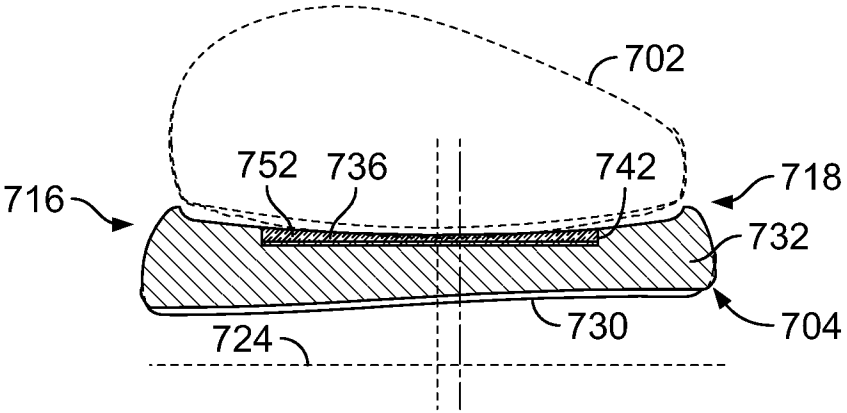
FIG. 10G is a cross-sectional view of the sole structure of FIG. 10A taken along the line 10G-10G of FIG. 10B.
Figure 10I:
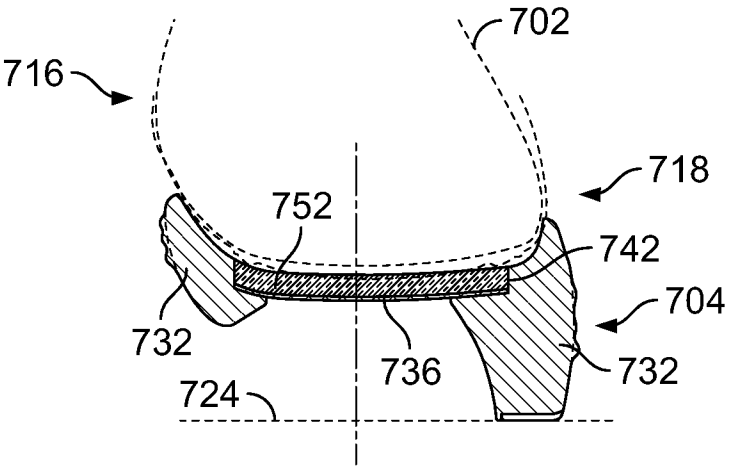
FIG. 10I is a cross sectional view of the sole structure of FIG. 10A taken along the line 10I-10I of FIG. 10B.

Another similarity is that the sole plate 736 has a shape that is similar to but proportionally smaller than the midsole member 732 throughout the forefoot, midfoot, and heel regions 708, 710, 712 (shown in FIG. 10E). Additionally, the pocket 742 and the sole plate 736 are correspondingly shaped such that a peripheral envelope of the pocket 742 bounds and can be in contact with an outer periphery of the sole plate 736. Put another way, the pocket 742 can be shaped to receive the sole plate 736, and the sole plate 736 can be shaped to be received in the pocket 742. Further, the cushion layer 752 can also be positioned within the pocket 742, such that the sole plate 736 can be secured in the pocket 742 by the cushion layer 352. In particular, the sole plate 736 can be secured between the midsole member 732 and the cushion layer 752, with the midsole member 732 in contact with a first side of the sole plate 736 and the cushion layer 752 in contact with a second side of the sole plate 736 that is opposite the first side. It is appreciated that the cushioning layer 752 can be coupled to the midsole member 732. Moreover, the position of the sole plate 736 in relation to the first midsole member 732 and the cushion layer 752 can effectively adjust the running posture of the user to be a forward tilt and moves the running motion of the user toward their forefoot.

Figure 10F:
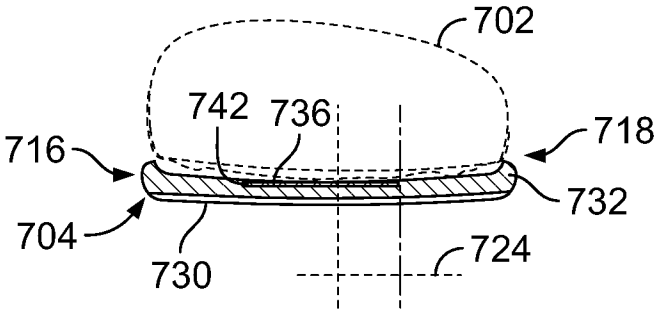
FIG. 10F is a cross-sectional view of the sole structure of FIG. 10A taken along line 10F-10F of FIG. 10B.
Figure 10H:
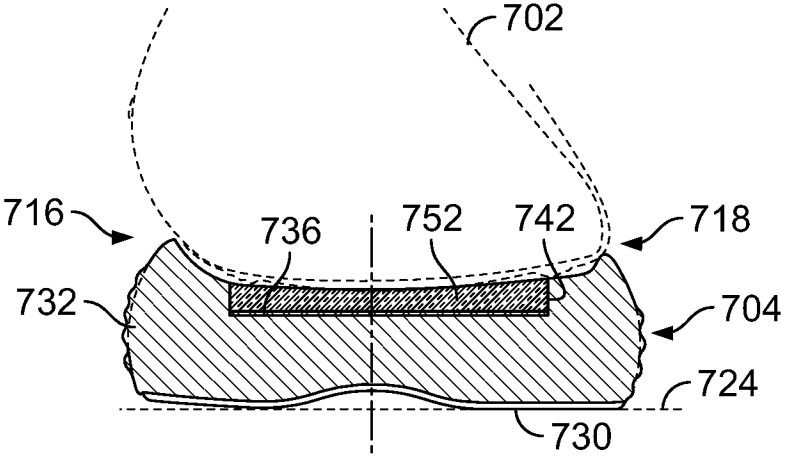
FIG. 10H is a cross-sectional view of the sole structure of FIG. 10A taken along the line 10H-10H of FIG. 10B.
Figure 10K:
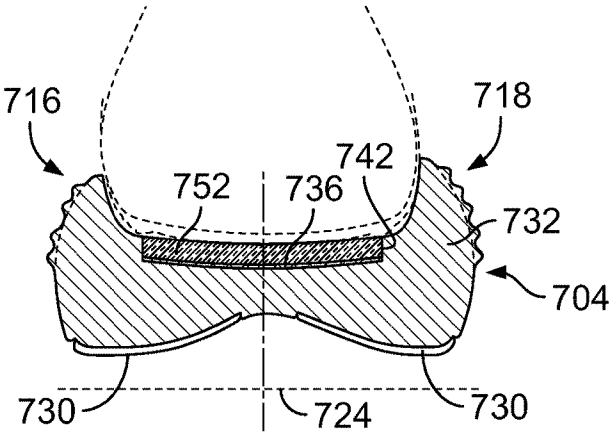
FIG. 10K is a cross-sectional view of the sole structure of FIG. 10A taken along the line 10K-10K of FIG. 10B.
Figure 10M:
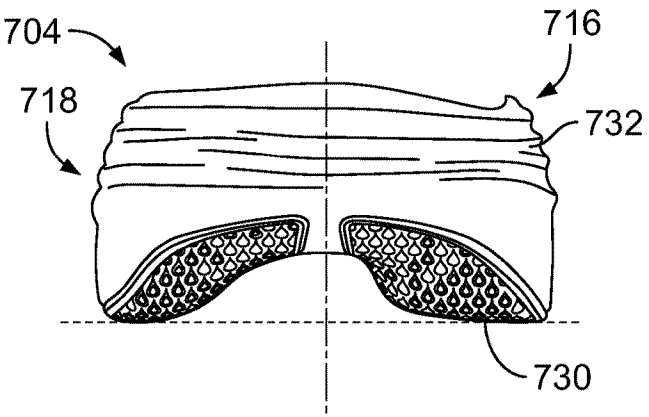
FIG. 10M is a heel view of the sole structure of FIG. 10A.
Figure 10J:
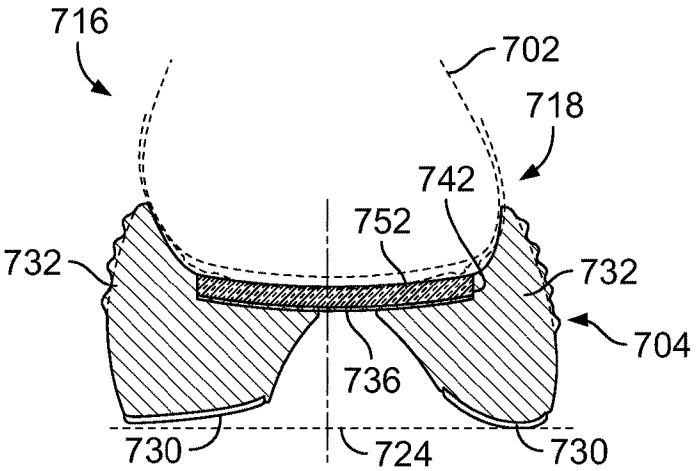
FIG. 10J is a cross-sectional view of the sole structure of FIG. 10A taken along the line 10J-10J of FIG. 10B.
Figure 10L:
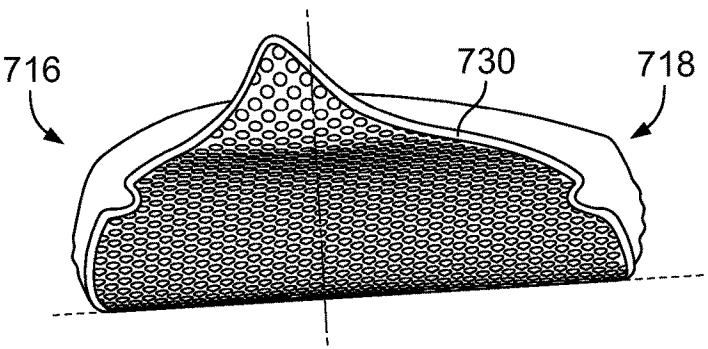
FIG. 10L is a toe view of the sole structure of FIG. 10A.

In some aspects, however, the articles of footwear 300, 700 differ from each other. For example, the cushion layer is different. As shown in FIGS. 10D and 10F, which is a cross-sectional view taken along line 10G-10G in FIG. 10B within the forefoot region 708, the cushion layer 752 extends into the forefoot region 708.

The above-described sole plates, such as sole plates 136, 236, 336, 436, 536, 636, and 736 provide a rigid sole that can promote a faster takeoff when running. In particular, the fulcrum of the rocking member creates a propulsion lever between a midfoot region and a heel region of the wearer that allows the wearer to accelerate faster and create a toe-off movement where the forefoot region of the wearer propels the wearer forward. Further, embodiments of the sole structures described herein can provide a training aid or tool that can be used to strengthen entire leg and foot muscles of a wearer and adjust their running posture to a forward-tilt position that promotes constant muscle tension.

Any of the embodiments described herein may be modified to include any of the structures or methodologies disclosed in connection with different embodiments. Further, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A sole structure for an article of footwear having an upper, and defining a medial side, a lateral side, a forefoot region, a midfoot region, and a heel region, the sole structure coupled to the upper and defining a lower surface that is configured to face away from the upper and toward a ground surface, the sole structure comprising:

an outsole; and a midsole disposed between the outsole and the upper, the midsole defining an entry region within the heel region of the article of footwear, the entry region extending upward from a substantially flat region upon which the article of footwear is configured to rest when on a flat ground surface, the entry region including a rocking region that is entirely convex and that extends between the substantially flat region and a first end of an angled portion, the angled portion extending at an entry angle relative to the substantially flat region from the first end to a second end that defines a heel end of the lower surface, the angled portion being angled when viewed from one of the lateral side and the medial side of the article of footwear, wherein the midsole defines a pocket having a base surface that is disposed within the heel region and positioned so that the first end of the angled portion is below the base surface of the pocket.

2. The sole structure of claim 1, wherein the midsole includes a first midsole member that is coupled to the outsole and that defines the pocket, and a second midsole member that is positioned within the pocket.

3. An article of footwear with a medial side, lateral side, forefoot region, a midfoot region, and a heel region, the article of footwear comprising:

an upper defining a top of the article of footwear, and a sole structure coupled to the upper and defining a lower surface that is visible when the article of footwear is viewed from a bottom of the article of footwear, the lower surface defines a resting plane upon which the article of footwear is configured to rest when on a flat ground surface and a rocking region that is convex and extends between the resting plane and a first end of an angled portion that extends to a second end at an entry angle relative to the resting plane when viewed from one of the lateral side and the medial side of the article of footwear, the sole structure including:

a first midsole member that defines a pocket having a base surface that is disposed within the heel region and positioned so that the first end of the angled portion is below the base surface of the pocket and the second end of the angled portion is above the base surface of the pocket, and, a second midsole member disposed within the pocket.

4. The sole structure of claim 1, wherein the midsole includes a side surface extending between the lower surface and the upper, the side surface including a plurality of ridges, at least one of the plurality of ridges extending around the midsole from the lateral side to the medial side in the heel region.

5. The sole structure of claim 2, wherein the first midsole member is made of a first material and the second midsole member is made of a second material that is different from the first material.

6. The sole structure of claim 2, wherein only the first midsole member defines the angled portion.

7. The sole structure of claim 2, wherein the second midsole member is visible when viewed from a bottom of the article of footwear.

8. The article of footwear of claim 3, wherein the first midsole member defines the first end and the second end of the angled portion.

9. The article of footwear of claim 3, wherein the rocking region is entirely convex.

10. The article of footwear of claim 9, wherein the sole structure further includes a first outsole portion and a second outsole portion that are coupled to the first midsole member within the rocking region, the first outsole portion and the second outsole portion positioned on opposing sides of a longitudinal channel that extends through the angled portion.

11. The article of footwear of claim 3, wherein the lower surface defines an exit region that curves away from the resting plane in the forefoot region.

12. The article of footwear of claim 3, wherein the sole structure includes an external groove that wraps around the sole structure from the lateral side to the medial side, the external groove passing between the second end of the angled portion and the upper.

13. An article of footwear with a medial side, lateral side, forefoot region, a midfoot region, and a heel region, the article of footwear comprising:

an upper defining a top of the article of footwear, and a sole structure coupled to the upper and defining a lower surface that is visible when the article of footwear is viewed from a bottom of the article of footwear, the sole structure including:

a first midsole member that defines the lower surface, the lower surface defining:

a resting plane in the heel region upon which the article of footwear is configured to rest when on a flat ground surface, and a rocking region that is convex and extends between the resting plane and a first end of an angled portion that extends to a second end at an entry angle relative to the resting plane when viewed from one of the lateral side and the medial side of the article of footwear, wherein the first midsole member defines a pocket with a base surface that extends from the forefoot region and through the midfoot region into the heel region, and a second midsole member disposed within the pocket, wherein, within the heel region, the base surface is positioned between the first end and the second end of the angled portion.

14. The sole structure of claim 4, wherein the at least one of the plurality of ridges is positioned between the second end of the angled portion and the upper.

15. The sole structure of claim 1, wherein the midsole defines a longitudinal channel extending from a heel end of the sole structure and into the midfoot region, and wherein the outsole includes a first outsole portion and a second outsole portion that are separated from one another by the longitudinal channel.

16. The sole structure of claim 15, wherein the substantially flat region defines a resting plane, and wherein, within the heel region, the longitudinal channel defines a height measured perpendicular from the resting plane to a top surface of the longitudinal channel such that the top surface of the longitudinal channel is above the first end of the angled portion.

17. The article of footwear of claim 12, wherein the external groove is defined entirely by the first midsole member.

18. The article of footwear of claim 3, wherein a heel end of an upper surface of the second midsole member is above the second end of the angled portion.

19. The article of footwear of claim 18, wherein the first midsole member defines a cutout, and wherein the sole structure further includes a sole plate positioned in the pocket between the first midsole member and the second midsole member, the sole plate being visible through the cutout.

20. The article of footwear of claim 13, wherein the first midsole member defines a plurality of ridges on each of a medial side surface and a lateral side surface of the sole structure, and the lower surface is devoid of the plurality of ridges.

21. The article of footwear of claim 13, wherein the second end of the angled portion is a heel end of a ground-engaging surface.

22. The article of footwear of claim 13, wherein the sole structure further includes a sole plate that is disposed within the pocket and visible from the bottom of the article of footwear.

23. The article of footwear of claim 22, wherein, at a heel end of the sole plate, the base surface is positioned between the first end and the second end of the angled portion.

24. The sole structure of claim 1, wherein the sole structure further includes a sole plate positioned within the pocket and in contact with the base surface so that the first end of the angled portion is below a heel end of the sole plate and the second end of the angled portion is above the heel end of the sole plate.

25. The sole structure of claim 1, wherein the second end of the angled portion is a heel end of a ground engaging surface that is configured to contact the ground surface during a heel strike.

26. The sole structure of claim 1, wherein, within the heel region, the base surface is entirely between the first end and the second end of the angled portion.

27. The sole structure of claim 1, wherein the midsole includes a first midsole member defining a cutout and a second midsole member that is visible through the cutout when viewed from a bottom of the article of footwear.

28. The sole structure of claim 1, wherein, within the heel region, the base surface is positioned so that the second end of the angled portion is above the base surface of the pocket.

29. An article of footwear defining a heel region, a midfoot region, a forefoot region, a medial side, and a lateral side, the article of footwear comprising:

an upper defining a top of the article of footwear; and a sole structure coupled to the upper and defining a lower surface that is visible when the article of footwear is viewed from a bottom of the article of footwear, the sole structure shaped so that, within the heel region of the article of footwear, the lower surface defines a resting plane upon which the article of footwear is configured to rest when on a flat ground surface and a rocking region that is convex and extends between the resting plane and a first end of and an angled portion that extends to a second end at an entry angle relative to the resting plane when viewed from one of the lateral side and the medial side of the article of footwear, the sole structure including:

a first midsole member that defines:

a pocket having a base surface that is disposed within the heel region such that a section of the base surface is positioned between the first end and the second end of the angled portion, and a longitudinal channel that extends from a heel end of the sole structure toward the midfoot region, the longitudinal channel defining a height measured perpendicular from the resting plane to a top surface of the longitudinal channel such that the top surface of the longitudinal channel is between the first end of the angled portion and the second end of the angled portion, and a second midsole member disposed within the pocket, the second midsole member having a first surface that is between the first end of the angled portion and the second end of the angled portion, and a second surface opposite the first surface, wherein a heel end of the second surface is above the second end of the angled portion, and an outsole coupled to the first midsole member, the outsole including a first outsole portion and a second outsole portion that is spaced apart across the longitudinal channel.

* * * * *